US012253335B2

(12) United States Patent
Campbell

(10) Patent No.: US 12,253,335 B2
(45) **Date of Patent: *Mar. 18, 2025**

(54) SIGHT ADJUSTABLE DISPLAY MOUNT FOR FIREARMS

(71) Applicant: Robert Marshall Campbell, Miami, FL (US)

(72) Inventor: Robert Marshall Campbell, Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/568,692

(22) Filed: Jan. 4, 2022

(65) Prior Publication Data

US 2022/0128337 A1 Apr. 28, 2022

Related U.S. Application Data

(63) Continuation of application No. 16/807,118, filed on Mar. 2, 2020, now Pat. No. 11,215,426, which is a continuation-in-part of application No. 15/977,581, filed on May 11, 2018, now Pat. No. 10,578,405, which is a continuation of application No. 15/398,582, filed on Jan. 4, 2017, now Pat. No. 10,006,742.

(60) Provisional application No. 62/387,783, filed on Jan. 4, 2016, provisional application No. 62/387,779, filed on Jan. 4, 2016, provisional application No. 62/387,782, filed on Jan. 4, 2016, provisional application No. 62/387,781, filed on Jan. 4, 2016.

(51) Int. Cl.
*F41G 11/00* (2006.01)
*F41G 3/16* (2006.01)

(52) U.S. Cl.
CPC ..... *F41G 11/003* (2013.01); *F41G 3/165* (2013.01)

(58) Field of Classification Search
CPC ..... F41G 11/003; F41G 3/165
USPC ..... 42/126
See application file for complete search history.

(56) References Cited

U.S. PATENT DOCUMENTS

| | | | | |
|---|---|---|---|---|
| 8,327,574 | B2 * | 12/2012 | Sandler | F41G 11/003 42/126 |
| 9,416,914 | B1 * | 8/2016 | Fan | F16M 11/2021 |
| 10,323,939 | B1 * | 6/2019 | Vinande | G01C 17/02 |
| 10,477,619 | B2 * | 11/2019 | Downing | H04W 84/12 |
| 11,215,426 | B1 * | 1/2022 | Campbell | F41G 11/003 |
| 2013/0251358 | A1 * | 9/2013 | Kuehl | G02B 7/02 396/428 |

(Continued)

*Primary Examiner* — Joshua E Freeman
(74) *Attorney, Agent, or Firm* — Javier Sobrado; The Brickell IP Group, PLLC

(57) ABSTRACT

This application is a continuation in part comprising two versions of two different kinds of display and display device mounts. comprising two versions of a multi positional and multi image displaying, tactical and non tactical camera and display device mounts, as well as two versions of a multi positional and multi image displaying, tactical and non tactical displays with a camera, mountable on the various mounting rails on firearms with the ability to maintain, both the perfect lineal and biaxial lineal alignment of the lens of the digital sensor with the target reticle of sights and scopes on a firearm as well as a visual of video targeting and surveilling images acquired through and around other target viewing devices on a firearm and do so, from any position the user would have to position himself in relation to the firearm.

17 Claims, 38 Drawing Sheets

(56) References Cited

U.S. PATENT DOCUMENTS

| | | | | |
|---|---|---|---|---|
| 2014/0317987 | A1* | 10/2014 | Kuehl | F16M 11/105 42/90 |
| 2016/0265879 | A1* | 9/2016 | Pasfield | F41G 11/003 |
| 2017/0227322 | A1* | 8/2017 | Franklin | F16M 13/00 |
| 2017/0299327 | A1* | 10/2017 | Albrecht | F41C 27/00 |

* cited by examiner

FIG. 9-A
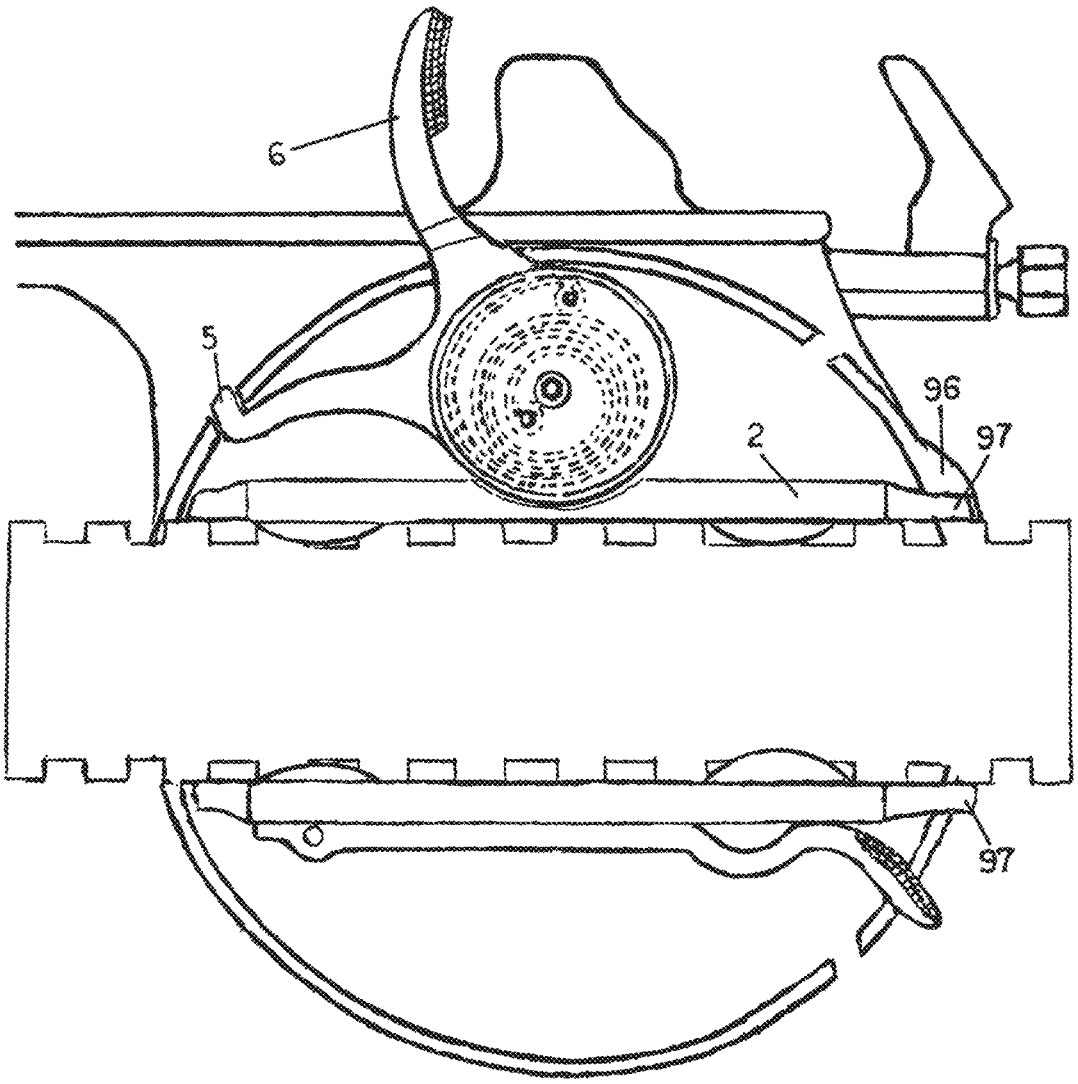

FIG. 9-B
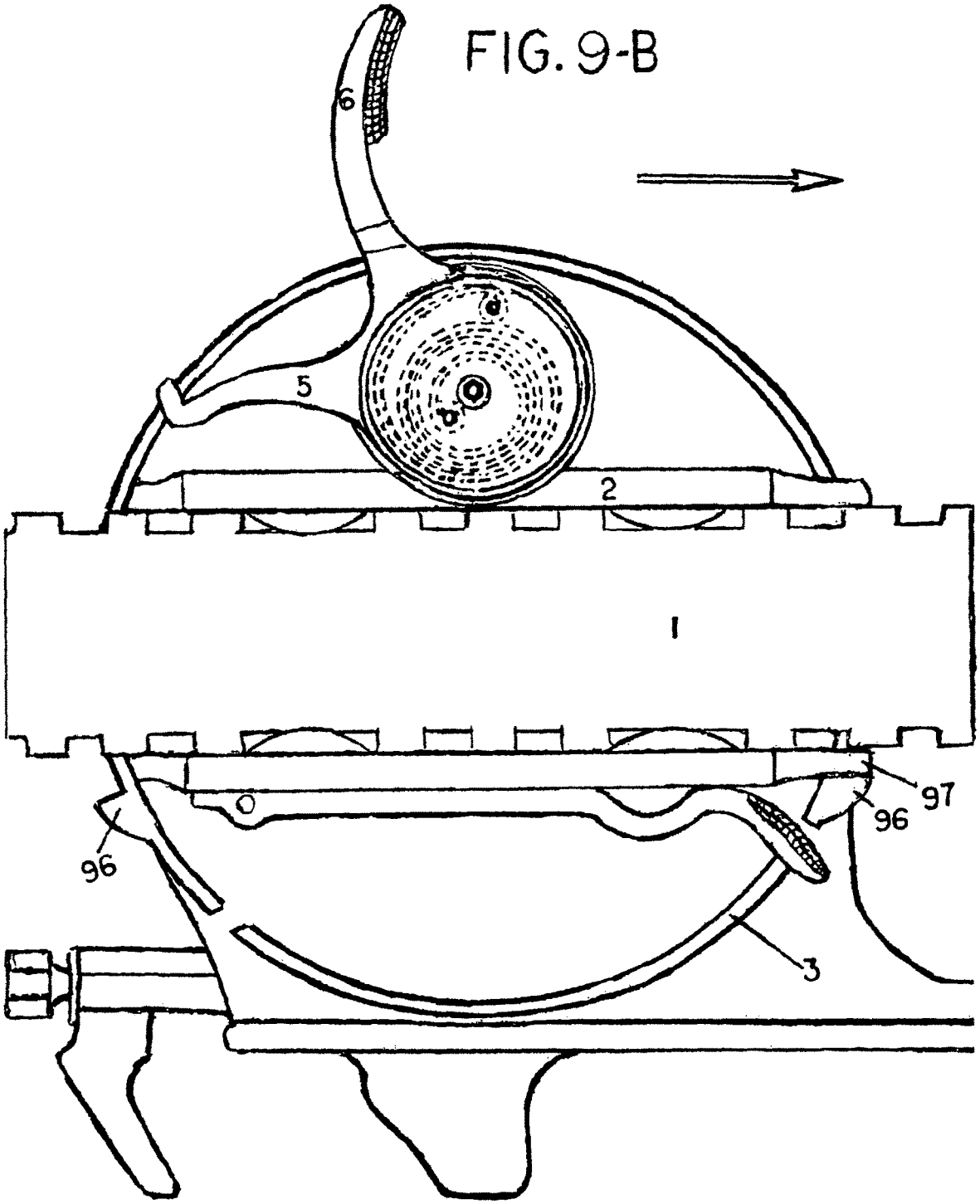

FIG. 9-C
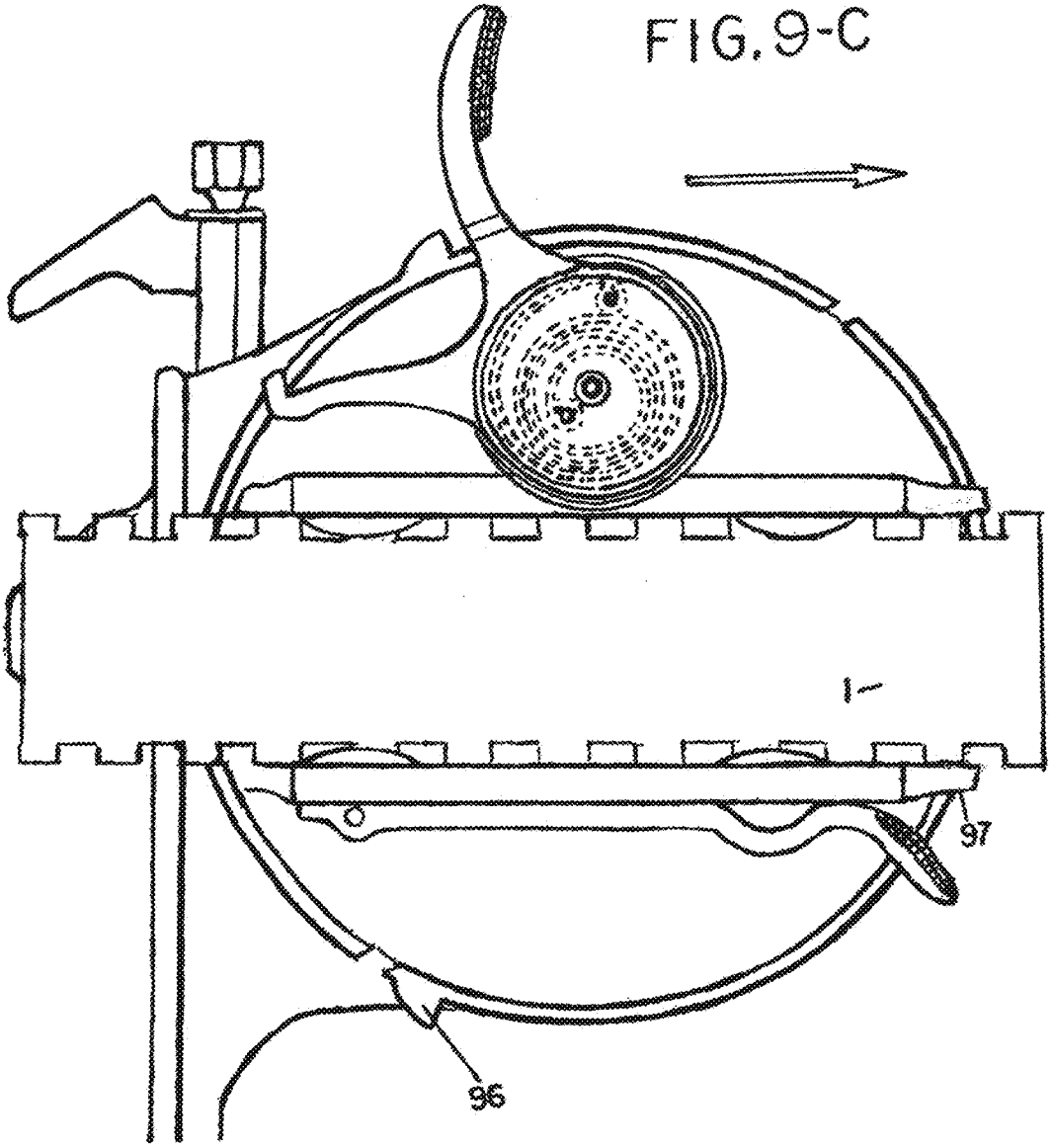

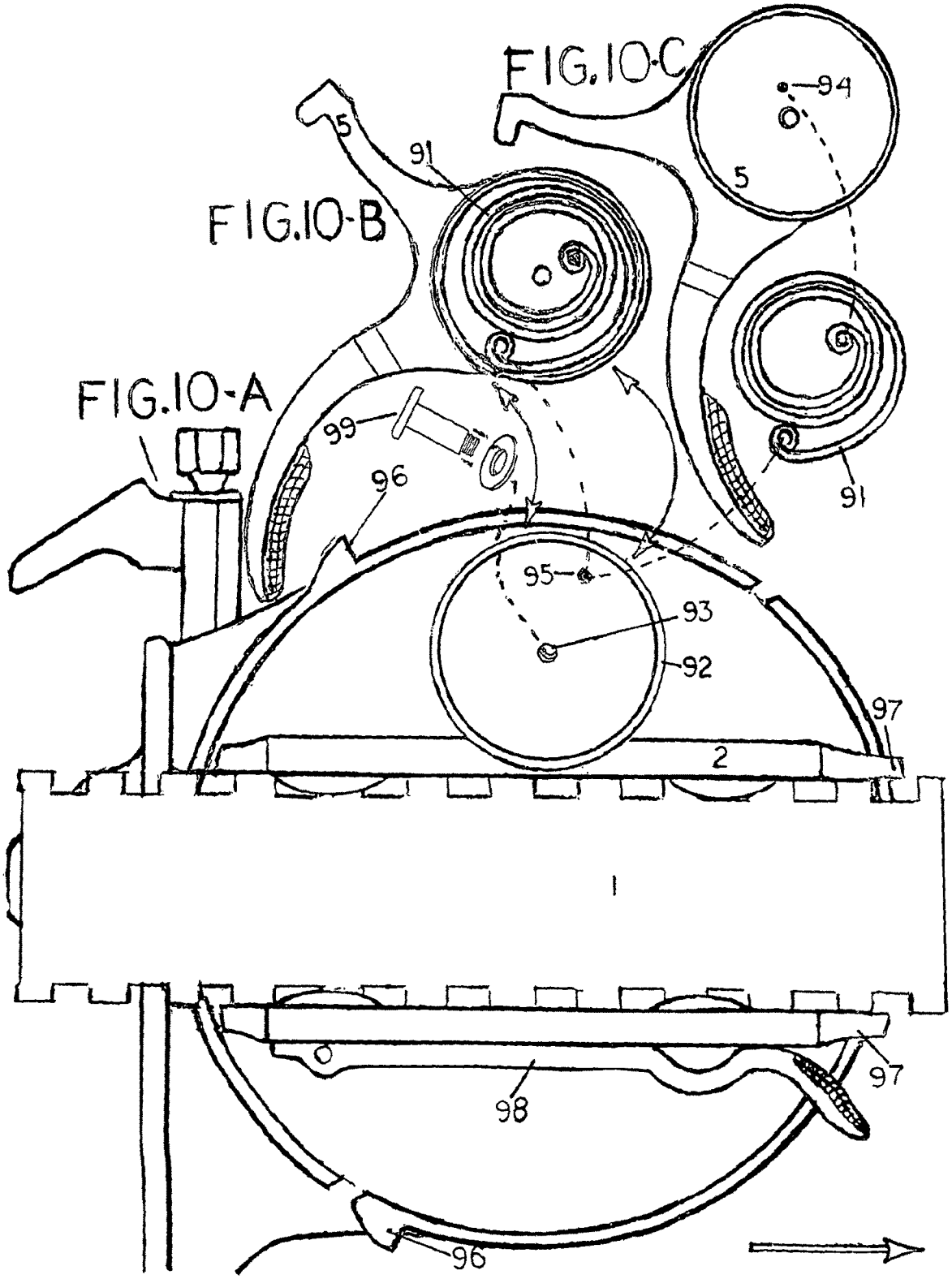
FIG.10-C
FIG.10-B
FIG.10-A
94
5
91
5
99
96
91
95
93
92
97
2
1
97
98
96

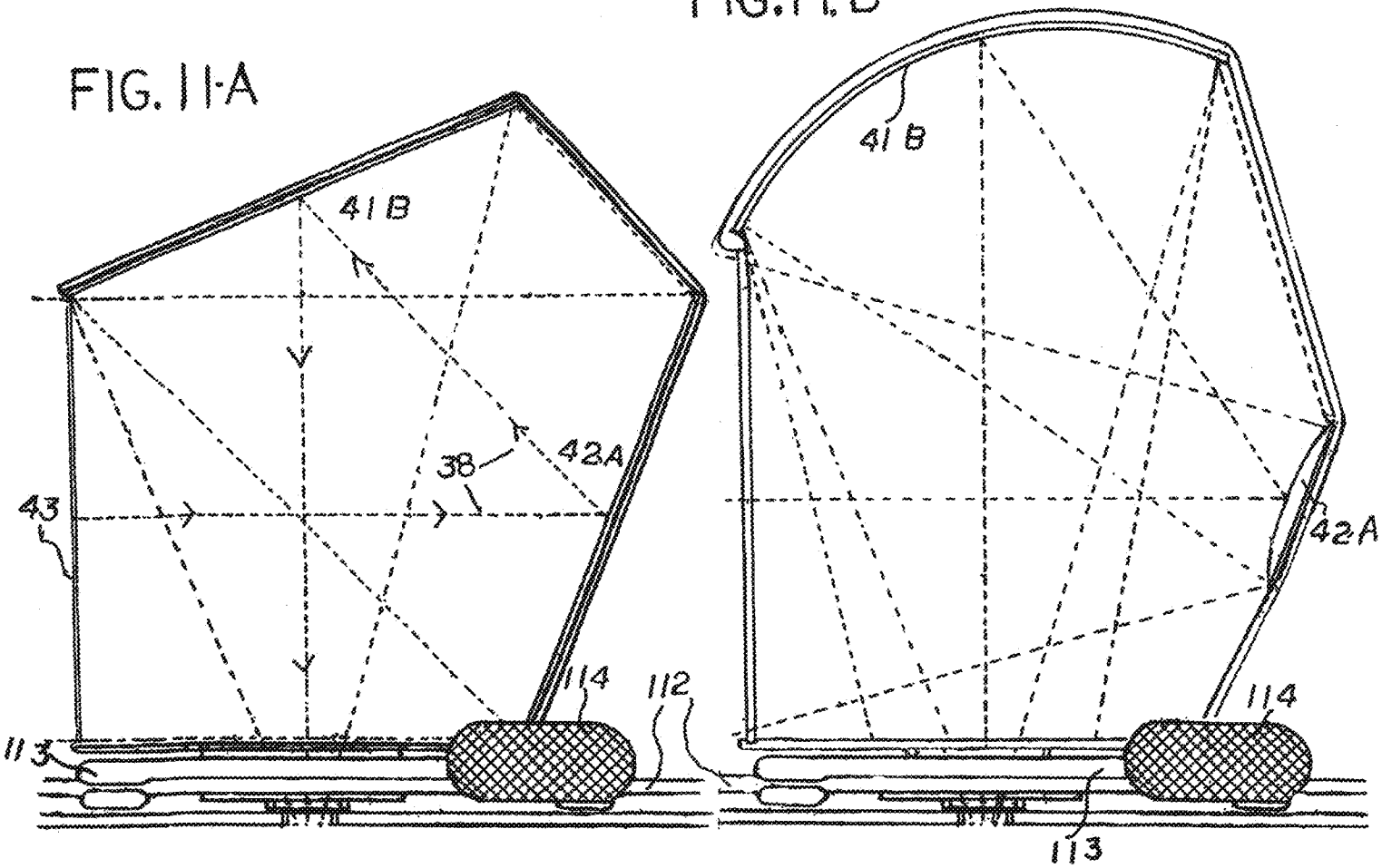
FIG. 11-B
FIG. 11-A

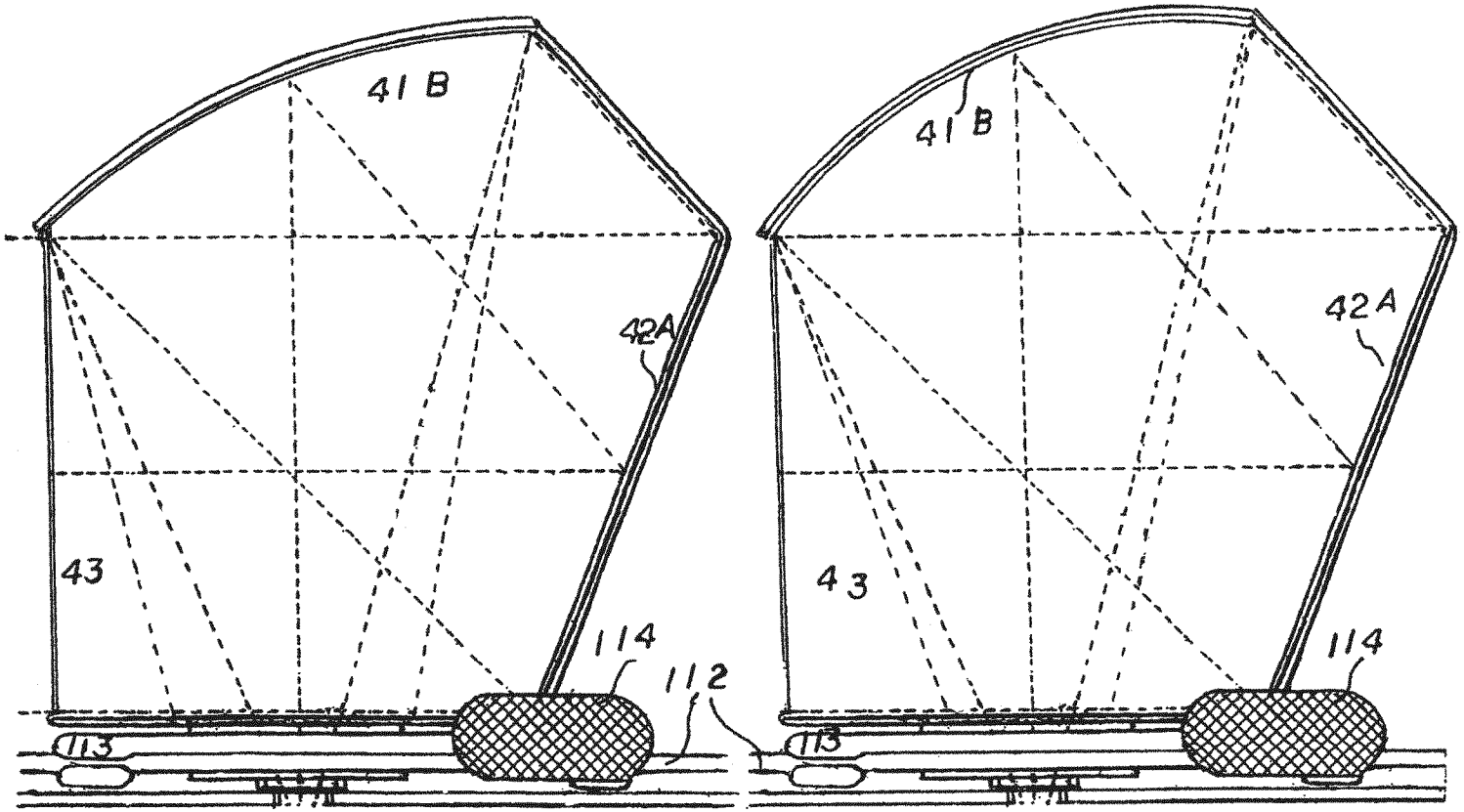
FIG.11-D
FIG.11-C

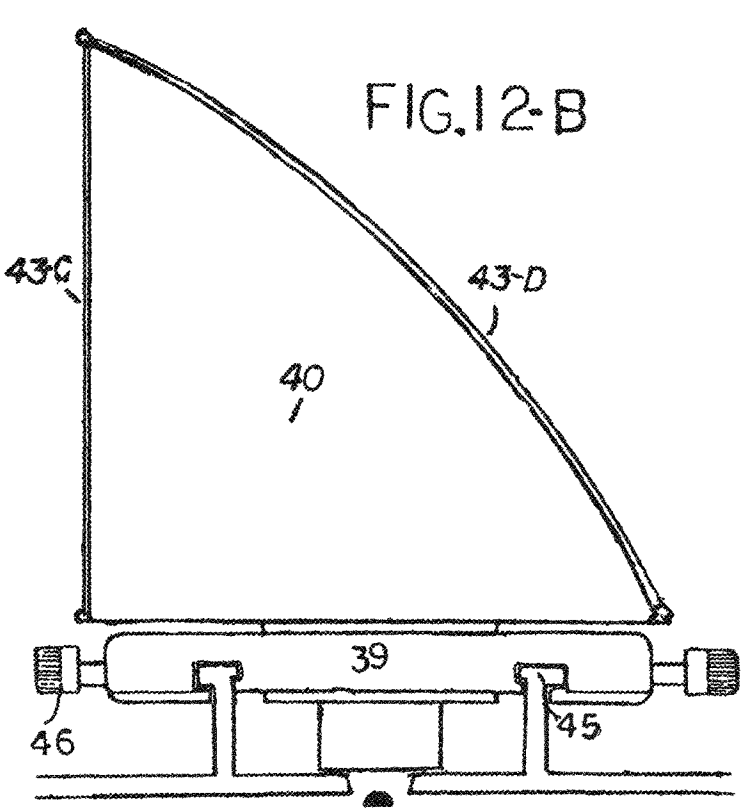
FIG.12-B
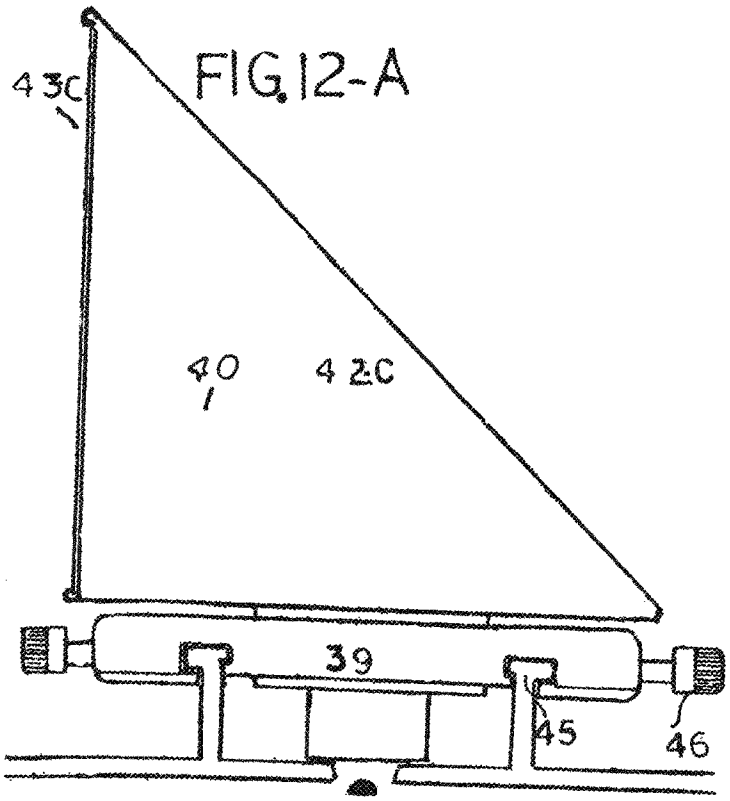
FIG.12-A

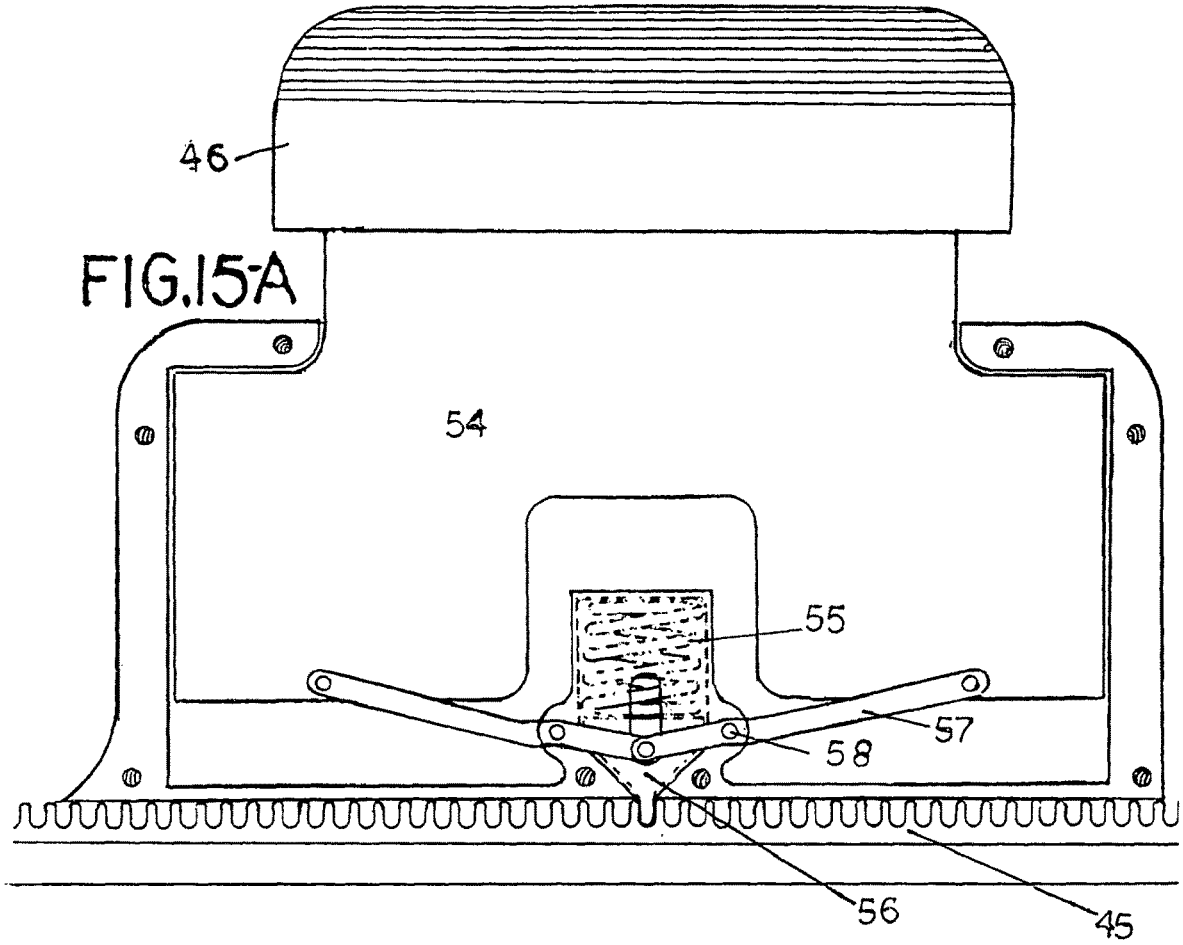
FIG.15-A
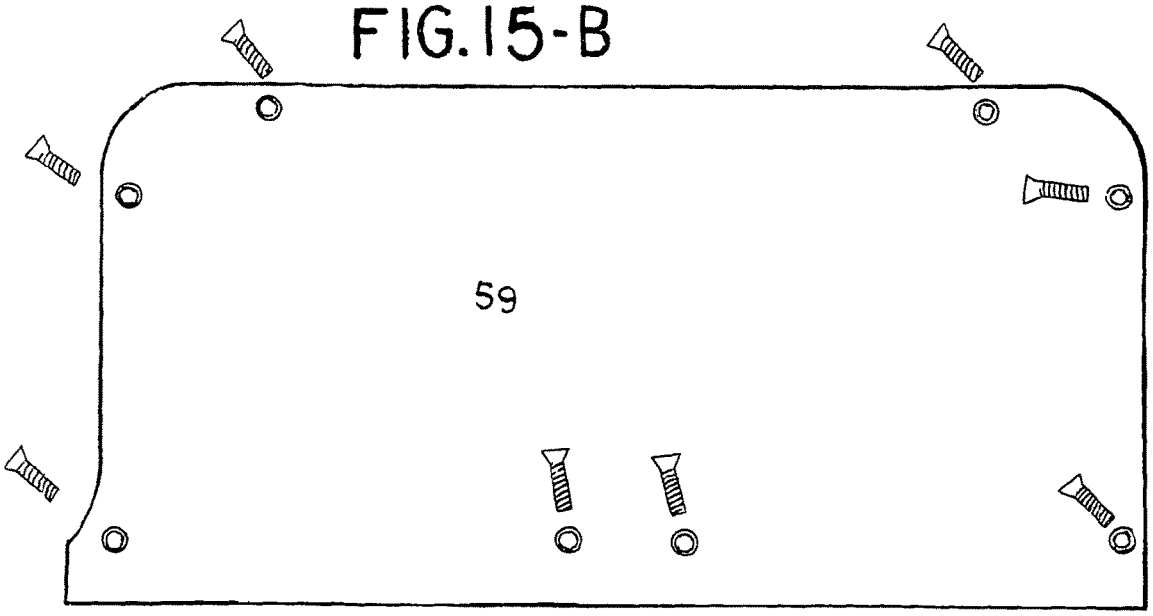
FIG.15-B

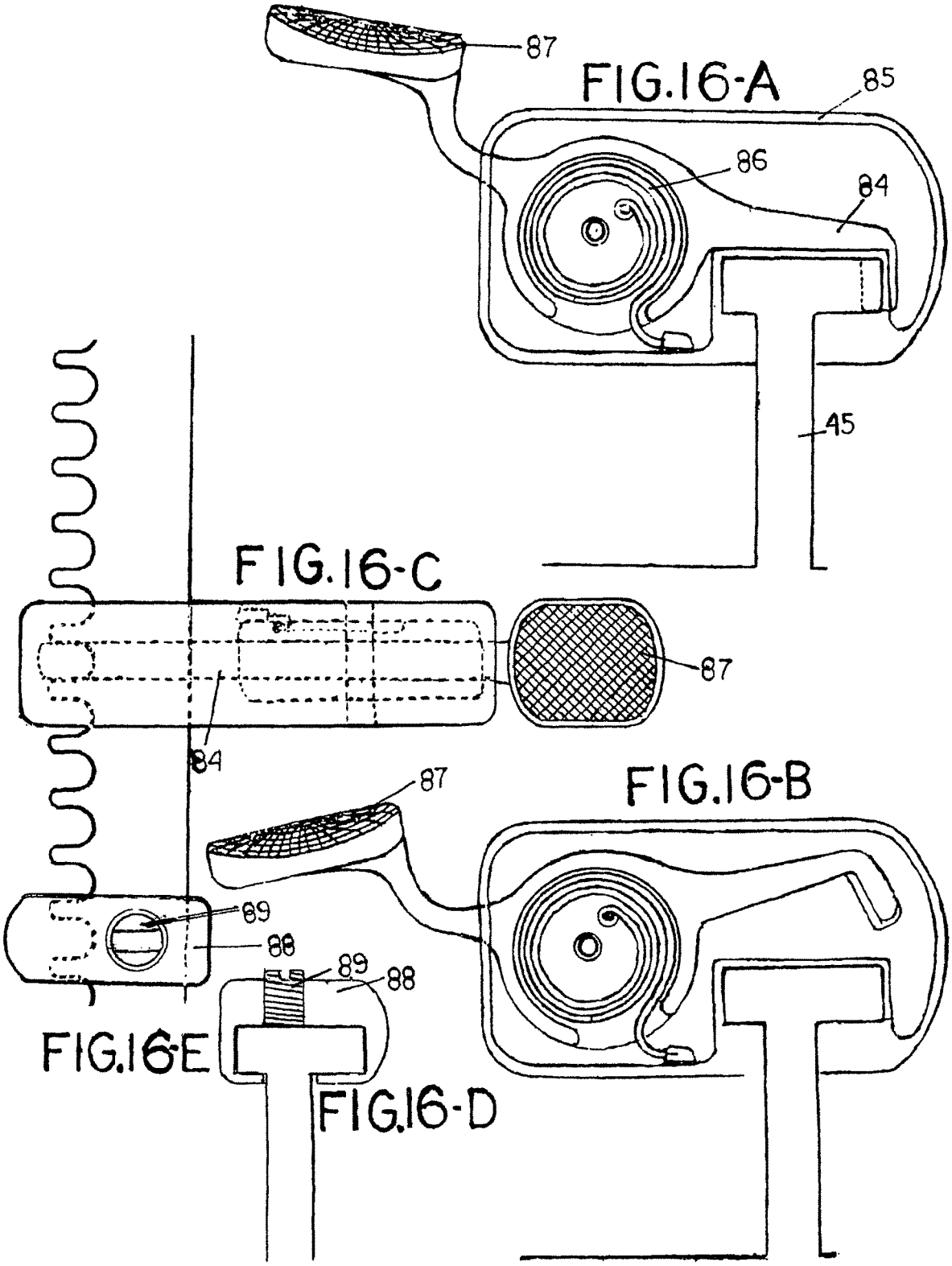
87
FIG.16-A
85
86
84
45
FIG.16-C
87
84
87
FIG.16-B
89
88
89
88
FIG.16-E
FIG.16-D

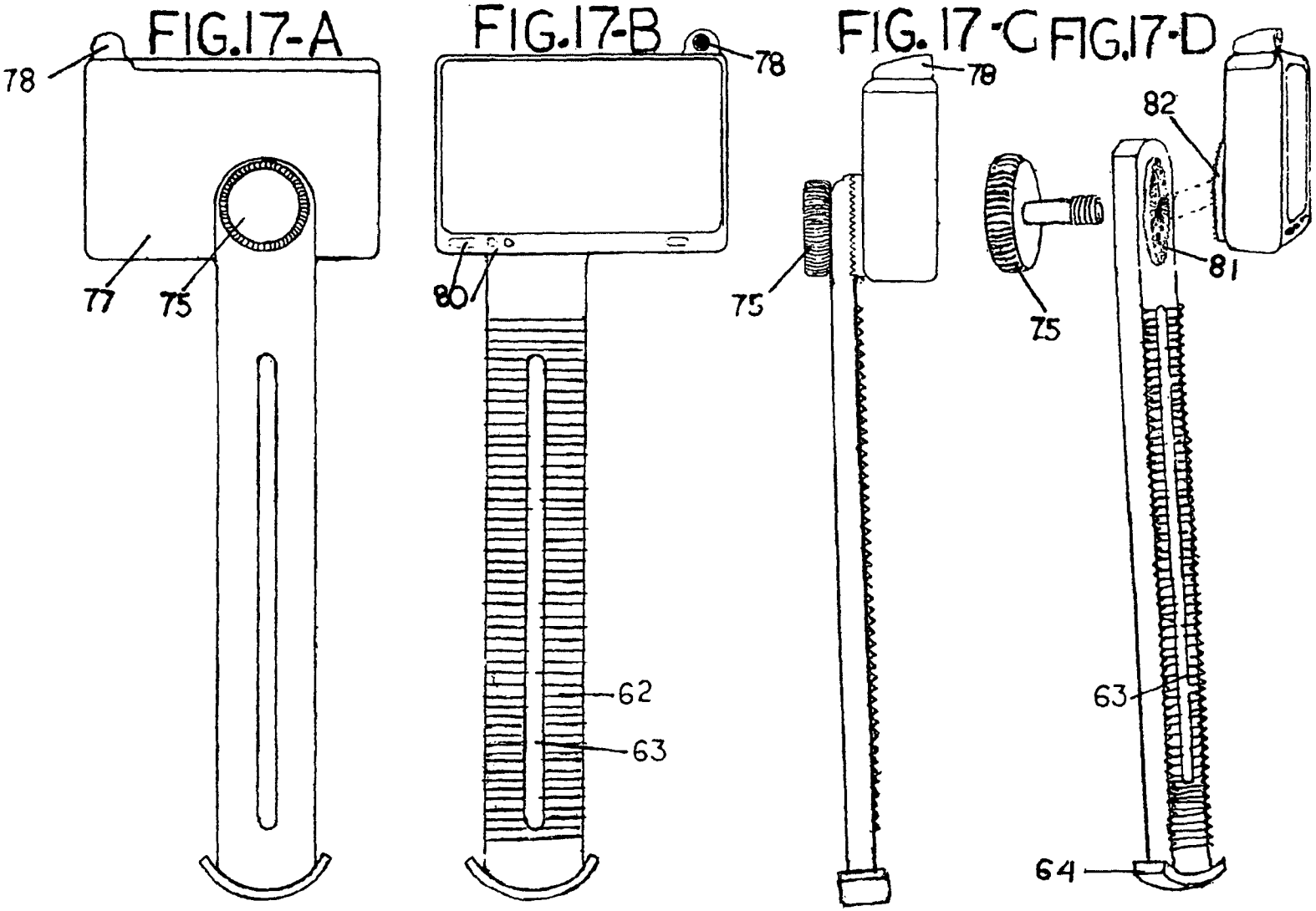
FIG.17-A
FIG.17-B
FIG.17-C
FIG.17-D
78
77
75
80
62
63
78
75
75
64
82
81

FIG. 18-A
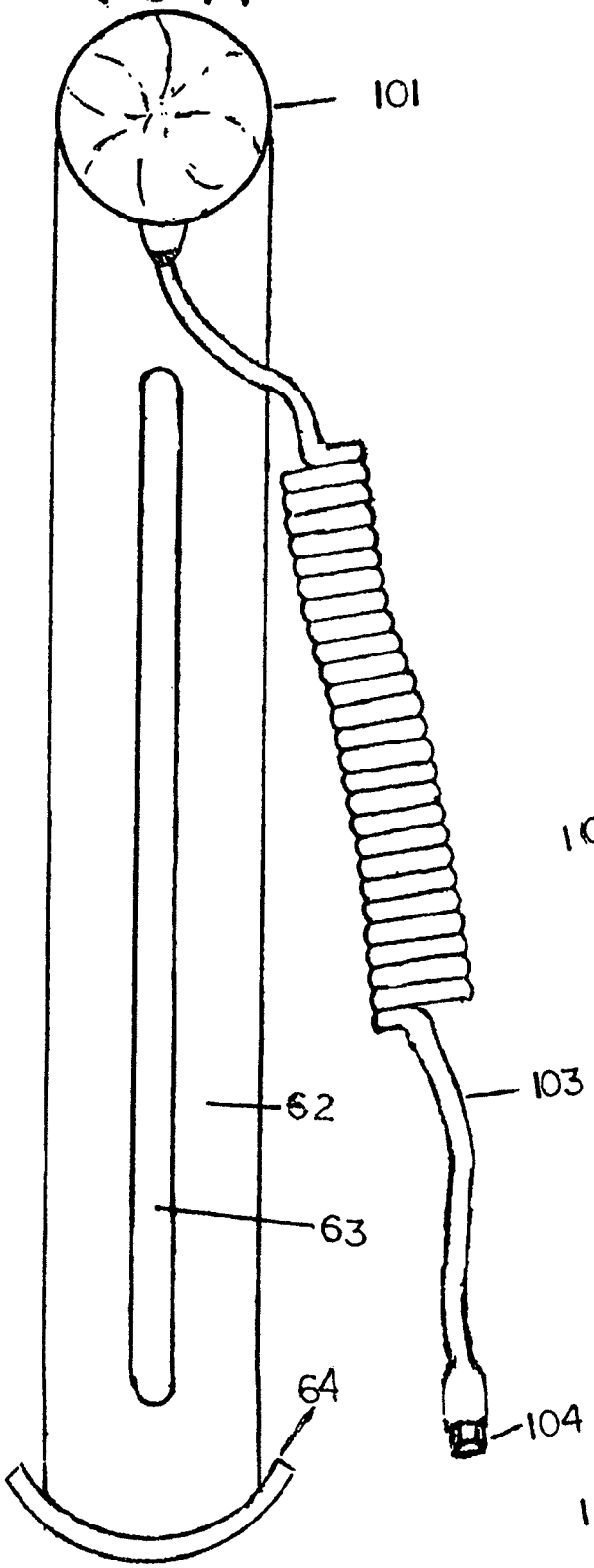
FIG. 18-B
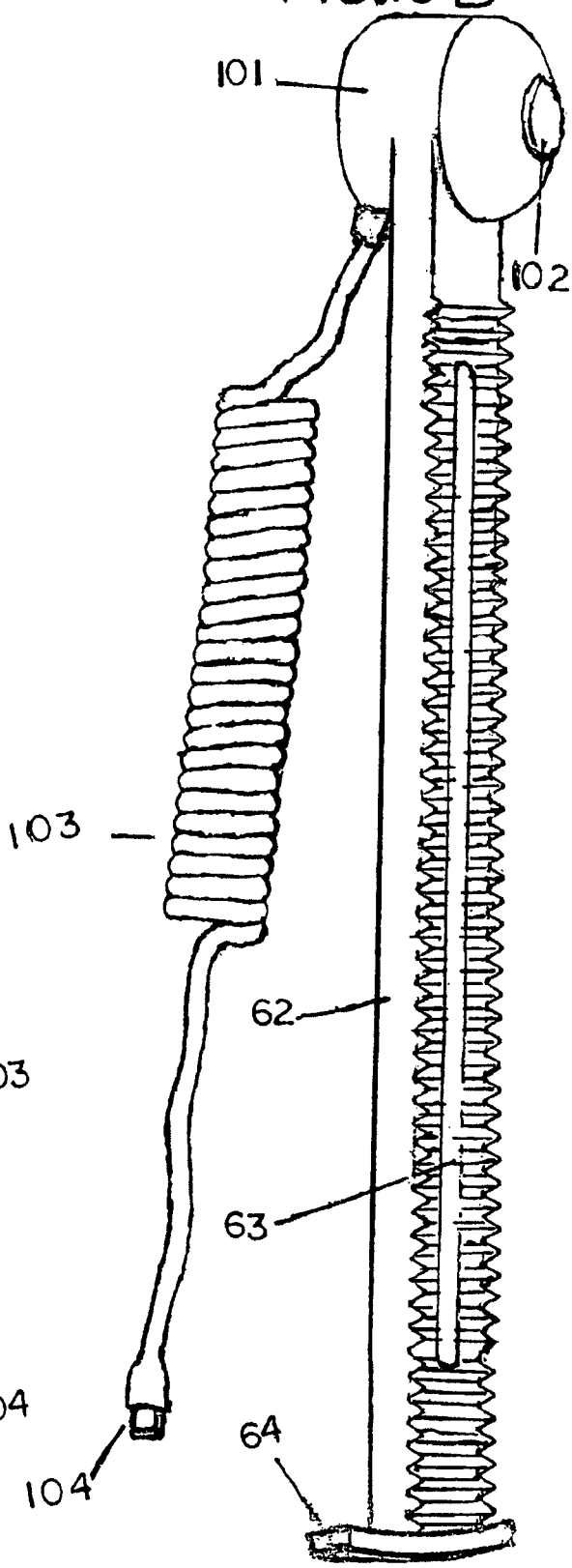

14
24
13
12
7
15
10
11
14
7
24
3
1

SIGHT ADJUSTABLE DISPLAY MOUNT FOR FIREARMS

This application is a continuation of U.S. application Ser. No. 16/807,118 filed Mar. 2, 2020 which is a continuation in part of U.S. application Ser. No. 15/977,581 filed May 11, 2018 which is a continuation of Ser. No. 15/398,582 filed Jan. 4, 2017 which claims priority to U.S. Provisional App. No. 62/387,779 filed Jan. 4, 2016, U.S. Provisional App. No. 62/387,781 filed Jan. 4, 2016, U.S. Provisional App. No. 62/387,782 filed Jan. 4, 2016 and U.S. Provisional App. No. 62/387,783 filed Jan. 4, 2016.

FIELD OF INVENTION

The present invention generally relates to the field of firearm accessories. Firearm accessories consist of a wide range of devices that attach to and enhance the performance of, or simply work in conjunction with a firearm, all of which are produced to enhance the abilities of the firearm in one way or another. These accessories consist of various types of sights, scopes, night vision, laser sights, range finders, etc. as well as things like regular or infrared high-powered lights, tripods, various types of mounting rail systems etc. This invention would fall more into the tactical surveillance sight acquiring display device mount category, which is sure to be a category unto itself, but more specifically. Included in this application is a continuation in part comprising two versions of two different kinds of display and display device mounts comprising two versions of a multi positional and multi image displaying, tactical and non tactical camera and display device mounts, as well as two versions of a multi positional and multi image displaying, tactical and non tactical displays with a camera, mountable on the various mounting rails on firearms with the ability to maintain, both the perfect lineal and biaxial lineal alignment of the lens of the digital sensor with the target reticle of sights and scopes on a firearm as well as a visual of video targeting and surveilling images acquired through and around other target viewing devices on a firearm and do so, from any position the user would have to position himself in relation to the firearm.

A combination camera and display device, when mounted in this tactical camera and display device mount is both, vertically and horizontally adjustable, as well as angularly adjustable into optional angles of adjustability, that enables the user to not only perfectly align and maintain the perfect alignment of the lens of the digital image sensor in the display with the target reticle or cross hairs in the sight or scope its acquiring targeting images from, but also maintains the perfect alignment and visual thereof, from both sides as well as from behind the firearm. This tactical camera and display device mount was primarily devised and engineered to provide ground troops with the ability to surveil an area and accurately return fire when engaged, from any position the user would have to position himself in relation to the firearm, and do so, from any position the user would have to position himself in relation to the firearm while remaining behind protective cover, and out of the line of fire, to alert the user of advancing hostile combatants to locate snipers or other developing enemy scenarios, but basically to provide our ground troops with the ability to remain behind protective cover while performing a broad range of duties required of them, on a daily basis from their least, to their most dangerous tasks, that unfortunately result in a large percentage of American casualties.

This invention was also developed to provide our armed forces, law enforcement, or others with advanced sighting abilities with extremely fast and accurate target acquisition as well as zooming capabilities, numerous sight enhancing and safety providing abilities, as well as countless additional abilities availed to a user when employing a smart display device, such as a smart phone or small tablet, or any other type of combination camera and display device which additionally avails them to countless additional advantages, abilities providable from developed or developable applications as well.

BACKGROUND OF THE INVENTION

This application is for additional embodiments, as well as other improvements made, and to be added to the patent application named, SIGHT ADJUSTABLE ROTATING SMART-PHONE MOUNT FOR FIREARMS. This new embodiment has been created as a result of the applicant's ongoing efforts to ever improve this invention's engineering and design, to provide our troops with the highest level of safety and control possible. This invention of the rail mounted, and rotatable tactical camera and display device mount has endured several improvements from it's original designs. The main changes described and illustrated in this application consist of several improvements and additions that radically improve its speed and ease of operation, as well as its range sighting and safety providing abilities.

Some of these improvements include but are certainly not limited to the provision of a non-reversed mirrored image, by means of a non-reversing mirrored device, that no longer requires the image reversing abilities of the smart device to re-reverse the image electronically. This mirrored device rotates and pops into position to view targets from either side of the firearm. This rotatable mirrored device is also engineered in a manner that provides a non-reversed image of the target, acquired from the sight, or scope its working in conjunction with as well as the surrounding area to the smart device, or dedicated display its working in conjunction within the smart device's un-zoomed, or full wide field of view. This mirrored device is additionally engineered in a manner that enables it with the ability to instantly provide the user with the image of the potential target and surrounding area from either side of the firearm, and is very quickly and easily rotated and popped into its proper position, to either side of the firearm, in a manner that enables it to be very rapidly and easily taken in and out of service as well.

This new type and variations of this invention are also drawn as if equipped with a rear viewing camera as well, and of which was invented as employable on this device but is not included in the claims, simply in that the applicant has already received a separate patent for it, however this rear viewing camera provides the soldier with the ability to maintain a visual of the area behind himself at all times as well when employed, so that not only will this device provide the user with the ability to acquire a visual of the area to either side, and in front, but also with the ability to maintain a visual of the area behind the user at all times while doing so, to forewarn ground troops of developing enemy scenarios such as advancing hostile combatants or any number of other dangers approaching from behind as well as from other directions, along with a full wide view of the target and the surrounding area, in a totally non-reversed image, and does so while also providing him with extremely fast, accurate and easy target acquisition as well.

These abilities being of paramount importance when needed, and of which, quite often critical to the user's very survival and the reason for all added subject matter included in this application, as well as the applicant's ongoing efforts to ever improve this invention, and to best provide our troops and others, with the highest level of safety and control providing abilities possible.

Many of the differences between this invention's original models, and these new embodiments of this invention, remain the same such as its mode of mounting any smartphone, small tablet or dedicated mil-spec or other display with a built in camera onto its mounting platform, and positionally adjust, both the mount, as well as the display device mounted therein, by means of the vertical and lateral positioning ability of the display device mount into any position needful, to attain the perfect lineal alignment of the camera's lens of the display device mounted therein, and maintains same when rotated and latched into position to each side of the firearm, and does so in a way in which the target reticle or crosshairs of any sight or scope its acquiring its targeting images from, thus being and maintaining the lens of the camera, into the exact position, needful to acquire the absolute highest level of accuracy attainable.

This, along with the invention's abilities to maintain same when rotated to each side of the firearm and locked into its positions of operation, and thus maintaining this device's ability to receive its target image from basically any target viewing device on the firearm, and displaying both its target image as well as its image of the surrounding area, with the sight's reticle always remaining perfectly centered in the screen thereof, in real time and from either side or from behind the firearm.

Included in this application is an additional engineering design option for the combination rail mount and rotatably or angularly adjustable platform portion of the tactical camera and display device mount thus showing one of many possible engineering options to affect this particular function of the device.

Also included in this application are many engineering options to affect this device's overall range of speed, ease, abilities, as well as its overall operational effect in its service to the user.

Some of the additional component differences of this new version of this invention and that of its previous versions, would firstly be the differences in the types and number of the mirrors they employ as well as the car and tracks that the various types of reflective devices ride, rotate and lock into the correct angle of service, when employed from one side of the firearm to the other, as well as when the target image and surrounding area is being viewed in the display from behind the firearm, as well as the manner same is taken in and out of service, and the level of speed and ease all aforementioned is accomplished.

This as well as the optically correct video images provided, and magnification options of the video images captured.

This along with the mode in which all adjustments on the device set up, need only to be done once, in that all remain constant after initial adjustments are made during set up and remain so, whenever the display device is removed and re installed, as well as when the reflective devices or their cars are exchanged or taken in and out of service all remain perfectly aligned to the camera's lens. The only time thereafter anything on the device would require re-adjustments to be made would be in the event of the employment of a different target viewing device, and then only in the vertical adjustment of the display platform itself. This new invention's modes of acquisition of the target images received from various target viewing devices on the firearm as well as their modes of image delivery, and in some embodiments that of image modification before same is delivered to the camera lens of the dedicated display or to the camera lens of the smart device or camera and display device mounted therein, is different in litterly every way from those previously devised by the applicant. This as well as all components comprising the mounting base and the angularly adjustable platform portion of the device as well as the mode in which all angular adjustments are accomplished to the device are all completely different than those previously devised by the applicant as well, of which is included in the drawings and their descriptions.

Included are drawings and their descriptions of several of the many optional mirrored devices devised by the applicant, that is just the portion that actually receives its target images from the target viewing device its working in conjunction with. These mirrored devices capture images from sights or scopes their working in conjunction with and provide images they capture to the lens of the camera of the smart device or display with a camera employed by the tactical camera and display device mount these mirrored devices are made as an integral portion of, or as an interchangeable accessory for.

This mirrored device is illustrated in four different types that all have certain advantages and disadvantages to each other. The first of these reflective device's housings illustrated in FIG. 11-A simply contains two flat reflective surfaces and arranged in a manner most commonly referred to as a pentamirror or a pentaprism. The first mirror reflects its mirrored or inverted image to another mirror where the image is inverted once again to its natural or non-inverted image where this image is presented and viewable to the camera lens as non-reversed and optically correct.

The second types of reflective devices illustrated are drawings of various other types of pentamirror or a pentaprism types of mirrored devices that the applicant has been working on in his efforts to produce different types of them that work much in the same manner as the first reflective device, in that the mirror housing houses two mirrors that provide a non-inverted image to the camera lens of the dedicated display with a camera, or smart device, however these drawings include modes that the applicant has been working on in his efforts to produce this same basic type of mirrored device that provided pre-optically magnified images to the lens portion of the camera employed with some showing as feasible mathematically, bench testing of same with the applicant's limited access to lenses and concave and convex mirrors of the proper size and magnification has proven as unattainable by the applicant, and as a result thereof bench testing of same, although some proving as functional, the applicant up to this point has not been capable in producing the image sizes or quality desired. Of course these things meaning very little in that all precise calculations would be worked out on a computer and manufactured to the precise configurations calculated by the manufacturers thereof or before having same manufactured, as a result thereof the drawings included in Figures are simply examples of the basic designs of some of the applicant's first rough prototypes bench tested by the applicant, and not to be construed as dimensionally correct, or the final, or the accepted design or mode for any, in that as of yet the applicant hasn't had these things worked out on a computer simply due to the extreme levels of confidentially associated with intellectual property, although the applicant has discovered other modes of attaining the same results by means of lens adaptations or attachments which would always be an easily achieved option. However the applicant's reluctance in the incorporation of same as an employment option is in that of size and possible overall lost levels of inefficiency to the device as a result thereof.

The applicant's efforts directed to the provision of a optically pre-magnified image, such as that of the optical magnification of a conventional scope is in that the provision thereof to the lens of the camera portion of the display device employed in the display device mount in turn multiplies the magnifying abilities and resiliency of digitally magnified images provided by the display device itself, and in turn helps maintain a very high level of resiliency when zoomed out at great distances.

FIGS. 12-C and 12-D are much more simplistic embodiments of this invention in that the mirror housing houses only one mirror, and in turn would provide a reversed image like the applicant's other inventions of this nature that require one of many very common free applications developed for taking selfies in a non-reversed image, which when employed also re-reverses the image provided by this single mirrored device back to a non reversed image. However, this does restrict display device employment to that of smart devices or a smart mil-spec display equipped with the ability to re-reverse its supplied image, in that target acquisition with a reversed image requires practice to and more than a little range time to get efficient at it, if the display device with a camera doesn't possess a mobile operating platform or embedded software providing the ability to re-reverse the image. FIGS. 12-C and 12-D show this car and mirrored device with a single mirror set at 45 degrees to view images at 90 degrees in relation to the firearm. FIG. 12-D is simply a version of FIG. 12-C that provides the first version of this device that provides a magnified image to the lens of the smart device or a display device equipped to re-reverse the images received by the device employed.

Plans are in the works for the development of an app for this device, that would have image reversal as one many image enhancing options, image reversing technology and applications enabling same have been out since shortly after the first cameras were employed in smart phones, and of which now are available in numerous free apps most of which were developed to use a smart device screen as a makeup mirror with a true or in other words a non-reversed image.

All of these reflective device options receive a view of the target image and its surrounding area and provide this image to the smart device or display with a camera along with the targeting images acquired from the sight or scope its working in conjunction with. The image of which, always remains perfectly centered in the screen of the display device employed, this of course intern meaning, the target reticle or crosshairs in the sight or scope of which the lens of the camera in the smart device or dedicated mil-spec display is initially aligned with, in turn always remains perfectly centered in the display the device is employing, which in turn makes target acquisition as fast and easy as one could point at the target.

This along with the level of defensive safety and control providing abilities this device provides, in that this little mechanical device along with its employment of a smart device, or other display device with a camera, or little mil-spec encrypted and embedded tablet, presently employed by our armed forces, will litterly provide the user with the ability to surveil his surroundings from positions of protective cover and totally out of the line of fire while doing so, which will doubtless prove significant, especially in theaters of urban combat which has proven to be extremely costly in American causalities, simply in-that much of which has resulted in sniper warfare by the enemy, and knowledge of the true threat demographics and the dangers surrounding them at all times, without having to become a target to discover same, means everything. These things prove evident not only after coming under fire and having take cover and then after having to not only locate the point of fire but to also maintain a visual of the area for developing enemy scenarios, or additional incoming hostiles when the enemy saw where you took cover and they are just waiting for you to peak around the corner, but also in the performance of a broad range of duties required of our troops to put themselves in harm's way to accomplish same. Whether simply having to traverse between one point to another and having to view down allies and around corners to access the dangers in the path they must take, or worse yet having to clear buildings of snipers and other hostile combatants that were just firing on them, and having to look down halls and into rooms without having to become a target to do so, or simply on watch, patrol, surveilling enemy strongholds as well as countless other duties and battlefield scenarios facing our troops at all times, especially in theaters of urban combat, where the ability to accurately access the true threat demographics and be made aware of many of the dangers surrounding them at all times, without having to become a target to do so, is paramount.

All of these various types of reflective devices are exclusive to the tactical versions of these display device mounts, but all of which are housed in their own housings, and are rotatably coupled to their own cars that ride on two tracks, of which these mirrored devices are height adjustable and rotatably positionable there on. These tracks as well as the track cars employed on them are illustrated in two different designs, of which the tracks thereof are made as an integral portion of the back side of the mounting platform that the smart device or dedicated display with a camera is mounted on. There is yet another type of these tracks as well as the track cars they employ included in FIG. 29 through FIG. 40 were devised as an integral portion of the back side of a height and angularly adjustable combination camera and display device, of which doesn't actually comprise a display mounting platform at all, but instead the display with a camera actually comprises a portion of the device, and of which said track car tracks are made as a portion of the back side of the display housing itself, but operate much in the same way.

Also included in this application in are simple illustrations of this invention with a non-rotatable rail mount, described as the non-tactical version of this device in the original patent application, seen in FIGS. 24 through 28.

All apparatuses and components thereof comprising a material included in this application was devised by the applicant, in an ongoing effort on his part to maximize the level of defensive safety and control providing abilities to our troops when under fire and time is critical, with all efforts devoted to enabling them with the ability to perform many of the most dangerous duties required of them, in the most effective mode accomplishable without them having to put themselves in harm's way to do so. This as well as to maximize the level, range and quality of over all service providable to those in such desperate need of the services providable by this new tactical version of the applicant's combination camera and display device mount of which provides the user with the ability to remain totally behind protective cover while maintaining a full visual, as well as full accurate use of the firearm, to either side of the user with user's entire body remaining behind the protective cover of a wall, building, tree, vehicle, trench, berm or other while doing so.

This leaving only one direction that the user couldn't maintain a visual of while in this position. This direction, of course, being behind approaching dangers from behind the user. This is accomplished by means of an additional rear viewing camera. This additional rear viewing camera provides the ability to maintain a full wide view of the area behind the user at the same time.

The drawings and definitions of which are included in FIG. 17-A through FIG. 23 are drawings of a rear viewing camera, that was invented to be employed on this invention as well as other inventions of the applicants, and of which has since then has been submitted with one of the other inventions of the applicants, and as a result thereof has already received a patent for it, and is simply being added now to provide clarity to what the full invention is, and to the full range of applications and services it was devised to provide. However, this rear viewing camera portion of the invention won't be included in the claims simply in that this invention has already received a patent for it.

This rear viewing camera's mounting base would be made as an integral part of the back portion of the tactical camera and display device mount. This mounting base, best seen in FIG. 22, with the camera portion of this rear viewing camera being mechanically fastened to, or made as an integral part of an armature, best seen in FIGS. 17 A and B as well as FIGS. 19 and 20. This armature is compressably secured, as well as height and angularly adjustable, to acquire the best vantage point of this camera to the area behind the user, as well as this rear viewing camera's viewing screen to the user by means of an armature clamp as best seen in FIGS. 22 and 23. This rear viewing camera always receives its image from 180 degrees, or from directly behind the viewing screen of the smart device mounted in the smart device's rotatable platform.

This would provide the user with the ability to remain totally behind protective cover while surveilling areas to either side, as well as in front and behind the user at the same time. This, all from protective cover, either while under heavy incoming enemy fire or simply surveilling the area for residing dangers before entering therein or after taking cover from same and having to locate the point of fire, or surveil the area for other developing enemy scenarios, or the advancement of hostile forces, or to zoom this image in to locate sniper positions etc.

This, without suffering loss of any of the functions and abilities of the firearm and maintain full accurate use thereof while doing so. This is accomplished simply by means of the user sticking the muzzle of the firearm out beyond the edge of a wall, building, tree, trench, berm or other that he's taking cover behind, to a point where the forward window or lens of the sight or scope that is being used in conjunction with can attain a clear view of the area, as well as adjusting the angle of the display to where the user can maintain a clear lineal view of the screen of the display mounted therein which is accomplished by the user with one quick easy motion with one hand smart device or combination camera and display device mounted in and being used as an integral part of this tactical camera and display device mount and even slightly angle the firearm inward if the soldier's position deems it necessary to keep his hands totally behind protective cover as well.

The camera portion of the display device employed always remains in perfect lineal alignment with the target reticle or crosshairs of the sight or scope its acquiring its surveilled and targeting images from and in turn, providing the soldier or law enforcement such as swat teams or other, with a level of safety and control never availed to them in the past, which is rather profound considering how small light and easy to produce it is in relation to the unique and profoundly efficient levels of defense, tactical and safety providing abilities this new sight acquiring and displaying device possesses, abilities the applicant is told will doubtless save many lives in that it will easily be providable to all of our ground troops an all new levels of safety and control, never previously availed to them, but as one officer stated, they'll not only enable our troops to fight a far more efficient but a far more humane war as well, where only the aggressor need suffer the consequences of his actions. Especially in theaters of urban combat, where hostile combatants are immersed with non-hostile civilians, that quite often are simply being victimized by them as well, and the lines between the two often become blurred without the time and control to properly distinguish between the two, this also being an environment in which the ability to reveal the dangers that constantly surround them and far too often befall them, being of paramount importance.

This new tactical display device mount provides these abilities with a profound level of efficiency, versatility, adaptability, and range of use in their modes of operation, engineering and mechanical composition, and has simply been a result of the inventor's obsession to provide the absolute highest level of safety and control providing abilities to best supply the tactical and sighting needs of our troops, and be adaptable and easily employable on the numerous types of firearms and to the highest level of service in their various roles of employment.

The tactical and sighting abilities they provide were devised to enable our troops with the ability to best ensure a much safer and positive outcome of military operations, especially in those conducted in urban theaters of combat where our troops patrol and battle the enemy in towns and cities. In these theaters of combat, our troops often come under fire from enemy combatants and must regularly take cover behind obstacles such as buildings, vehicles, trees, homes, etc. which is extremely dangerous and rarely ends well. The problem is that with the friendly combatant's entire body being behind protective cover, a clear lineal view to locate the point of fire, or to maintain a visual of the area and awareness of the true threat demographics both to properly access same as well as to locate or accurately engage advancing hostile enemy combatants, when it is the only option to the soldier's survival, and of which normally could not be accomplished without looking over or around these fortified structures, and thus exposing himself as a target while doing so. This as well as countless other scenarios that daily put our troops in harm's way, whether on watch, on patrol, surveilling enemy strongholds, clearing buildings of snipers or other hostiles, having to view down hallways or into various rooms, or even while traversing from one location to another, the soldier must peek around corners of buildings or other barriers to access the dangers in the path he must take. Known statistics tell us that a large percentage of American casualties occur on the battlefield while doing so, especially in theaters of urban combat which has presented all new dangers and challenges for today's soldiers. The ability to see and to be made aware of these dangers quite often being critical to their very survival.

The applicant invented and engineered these tactical display device mounts to provide our troops with the safety providing abilities of being able to surveil an area while maintaining the full accurate use of their firearm from a position of protective cover, the countless number of our troops' lives this ability would save, once availed to our troops, which is a task that this device has proven to possess the ability to perform extremely well. This invention experienced numerous stages of development, with this application simply documenting some of the most recent and most effective advancements made as a result of the applicant's continuous and ongoing efforts to expand and enhance this invention's level of safety providing abilities, and provide same to those that are in such desperate need of the defensive safety and control providing abilities this invention will provide them with, has been the driving force that has brought this invention to where it is now.

PRIOR ART

In the prior art of firearm accessories for both rifles and hand guns, there have been numerous attempts to develop more efficient, accurate accessories and user-friendly sight systems. In general, firearm accessories have long been established for mounting on rifles and pistols. Such accessories include red dot sights, high powered lights, night vision, scopes, laser sights, and the like. All the aforementioned firearm accessories aid in locating and pinpointing a target, however, the aforementioned prior art offers no solution to the soldier to very effectively surveil an entire area from a safe secured position while maintaining the full use of any of the various types of rifles, pistols or other types of firearms such as rocket propelled grenades, regular grenade launchers or any other types of firearms availed to our armed forces. This, with their entire body remaining totally behind protective cover such as from behind a building, wall, tree, vehicle, trench, embankment or other while taking on heavy incoming enemy fire, both to surveil the area to locate the source of fire as well as advancing hostile forces or other developing enemy scenarios, as well as maintaining a full visual of the area behind the user at the same time.

In other words, to accurately locate, or engage a target when under fire, the user of the firearm must then become exposed as a target in order to do so, which presents a severe problem. First responders, soldiers, and law enforcement personnel often encounter hostile combatants, violent actors, or offenders who carry pistols, rifles, or other weapons. In military scenarios, battles and other military operations often occur in urban theaters of combat requiring armed forces to patrol and engage in battle in towns and cities.

Personnel on patrol in dangerous areas must regularly take cover behind obstacles such as buildings vehicles, trees, homes, etc. The problem is that with friendly combatants' entire body being behind cover, a clear lineal view to be able to locate or accurately engage advancing hostile forces cannot be accomplished without looking over or around these fortified structures, exposing himself as a target while doing so. Known statistics establish that a large percentage of American casualties occur on the battlefield while doing so, especially in theaters of urban combat which has presented all new dangers and challenges for today's soldiers.

The applicant commissioned an extensive search of the prior art in his efforts to access novelty, and of which turned up very little, and actually nothing that possess any of the abilities that the applicants display mounts possess or that are employed, operate, or even employ any of the same components that any of the variations of the applicant's display devices employ or that were even devised to provide any of the same services that the applicant's display mounts provide and only a few that employed a display on a firearm of any kind and only one of those that was actually devised or employable for tactical purposes of any kind.

This being the Israeli corner shot which also shares nothing in common with the applicants tactical display device mounts in any way other than both of which employing a display and employing same to view targets from positions of protective cover, but that is where all similarities end. Current available solutions to this problem found in the prior art that have actually provided any measurable level of success in their solution or that have even accomplished the task of providing our troops with the ability to effectively both surveil an area while maintaining the accurate use of a firearm, totally from behind protective cover without exposing any part of the user's body to incoming fire while doing so comprise only one known, and with all others few as they are being devised and engineered to complete only one of these tasks with their primary function being just to accurately engage the enemy from a safer position and rarely with any even accomplishing that with any measurable overall level of effect and none of which sharing anything common with the applicant's tactical display device mounts. With the exception of one that performs both tasks of surveilling the area as well as engaging targets from protective cover with any degree of efficiency.

This being the aforementioned Israeli corner shot, which isn't actually a firearm accessory at all but rather an entire tactical firearm with its own firearm and display. The Israeli corner shot possesses a display consisting of a two and a half inch LED screen that is put into service by locking its display into its non-rotatable −90 degree viewing position in relation to the rifle stock, view-able at lower mid portion of the left side of the firearm stock The ratcheting bendable forward portion of this firearm that the pistol and camera are mounted on, are pivot-ably connected to the stock portion of a complete firearm that swings, and is lockable to either side of the firearm, to engage targets of potential danger and is actually devised for purpose of providing the user with a tactical advantage in various theaters of close quarter urban combat with the ability to relocate and engage targets, and employed exclusively for the many extremely dangerous tasks and scenarios, such as skirmishes between and around buildings and other structures as well as clearing buildings of hostiles and where large numbers of the most dangerous of skirmishes and battles occur in fairly close quartered theaters of combat where the very limited fire power of a pistol, and reduced level of accuracy in most cases, are far less important than their ability to provide the soldier any type or level of protective cover while doing so from a safe secure position if under fire and of which is used for surveillance purposes from protective cover as well but also with the bulk of the firearm exposed to incoming fire and the user restricted to only one side of operational service availed to the user to remain behind cover to do so. This tactical firearm suffers from a many problems essential to, but actually caused by their actual solution itself that prove evident in many ways, such as, in all applications of tactical engagement the stock of the firearm is locked over to one side of the firearm or the other with the end, pistol portion of this firearm, sticking off at an angle totally transverse to the user so that every time its pistol is fired the forces of recoil or kick back created, pushes the firearm off to one side and thus making the firearm pivot or partially rotate in relation to the user every time the firearm is fired. With these forces being fairly substantial in and of their self, but due to the actual pistol portion of this firearm being off approximately two feet in front, and off to one side of the user when fired, creates a leverage factor that literally multiplies these forces to a point that every time the firearm is fired, the aim is thrown off so badly, the target literally has to be relocated for the next shot. This also making any fully automatic firing of the firearm next to impossible to even keep the firearm firing in the same direction let alone staying on target.

This, as well as the Israeli corner shot being an entire firearm with all of its components being exclusive to itself, but with all components being dependent on each other to operate as a functioning unit, along with its firepower limited to the fire power, range, and accuracy to only what a pistol can provide, as well as its total inability to remain on target after firing. For these reasons and many others, this firearm is seen and used by the military only as a secondary or specialty firearm and not to take the place of a soldier's primary firearm, meaning that this entire firearm would have to be carried into battle along with all the rest of the soldiers equipment, not only adding the additional weight of eight and a half pounds to the soldiers existing heavy load, but also with it getting in the way and literally hindering the soldier's level of effectiveness when not in use. And because of these things, also limiting the soldiers range of mobility and abilities, and the soldiers level of effectiveness in the employment of other equipment availed to him and his level of performance of other duties required of him as a result thereof, it is for these reasons and others this firearm along with any safety or control providing abilities it could have possibly provided, is rarely employed by our troops. This firearm is also limited in the positions that a soldier must place himself to the effective use of the firearm due to the location and non-position-ability of the target screen, meaning that the user can only operate the firearm from the left side of the firearm which can present a problem in some of the more restrictive places a soldier would have to position himself to remain out of the line of fire, while maintaining full effective use of the firearm's tactical abilities.

This is a much more significant problem than one might realize in that when a squad or even a single soldier comes under fire they must duck behind cover quickly anywhere they can with no time to choose the most opportune place to do so, nor do they have any control over what angle the point of fire is in relation to where they had to take cover, whether behind a vehicle, tree, the corner of a building or other, more often than not these margins of actual protective cover being extremely restrictive, requiring the soldier's back to be against the wall or in a very cramped and restrictive position, leaving very few if any positional options to the soldier to remain behind protective cover and accurately employ the firearm in any way, simply due to the firearms numerous positional restrictions of employment in that these positions options more often than not, don't include their being on the left side of the firearm and far enough behind the screen of the monitor to acquire a visual of its monitor screen, this being the only position the firearm can be accurately employed.

The Israeli Corner Shot historically has always been the absolute best that all prior art could offer, with a track record many times that of any other prior art until now, even with the countless inabilities and inadequacies they posses being vast and all-encompassing in one way or another. This along with its total lack of versatility and adaptability that renders the actual tactical abilities they actually have, limited as they are of very little effect, in that any services actually providable by them rarely get into the hands of those that actually need them the most and to realize that its actually the best that the prior art has ever had to offer, simply goes to show how miserably all prior art has failed our troops until now, this along with the shortcomings and failures of the prior art to provide not just our armed forces, law enforcement, secret service, homeland security, and others with a viable solution to these problems as a whole, have been historically responsible for countless numbers of casualties with the largest problems and failures of the prior art being in their severe lack of versatility and adaptability, rendering any tactical abilities or level of actual safety providing abilities they do possess limited as they all are ever providing any more than a very few of our troops with the desperately needed level of protection and safety providing abilities they actually possess the result of which responsible for countless numbers U.S. casualties.

These problems only made worse, simply due to any actual tactical abilities they actually possess being exclusive unto themselves in one way or another, in that all are either a complete firearm, or only employable on one or two models of the exact same type of firearm when the greatest number of firearms employed by those in desperate need of any tactical abilities they could possibly provide, are all equipped with, not only many numerous models of firearms, but numerous and completely different types of firearms, with all simply researched and employed as most effective to their particular role of employment, which not only varies between one branch of the service to another, but widely varies in the different branches of homeland security, law enforcement such as SWAT, secret service, and the largest percentage of those defending this nation in general for that matter, with all in desperate need of the type of service they provide, that can never be availed to them, simply due to the fact that the actual type of tactical firearm they actually are, or the actual type or model of firearm they are even possibly employable on, would never fit the criteria for the role of the entire rest of their employment, rendering their employment both impractical as well as ineffective, in that even if employed the likelihood of their additional weight and obstructive nature would restrict the normal operations and employment of the rest of the standard equipment employed and constantly relied on by them to the point of their being classified as specialized equipment, and not to take the place of their standard equipment availed to them.

For example the Israeli Corner Shot receiving this classification by our armed forces, being a device that in spite of its many limitations has until now been the most effective device devised for these abilities and responsible for saving countless numbers of lives, in spite of the very small percentage of our troops ever getting availed to their services, when in desperate need of them, simply due to their solutions level of exclusivity unto theirs elves, this along with all prior arts lack of adaptability and versatility, as well as range, and of actual level of services they provide in relation to the actual need. These being things all prior art suffers from, with their shortcomings being vast and all inclusive. That restricts the overall level of effect their solutions actually accomplish to being very little. How many more lives could their solutions have saved, even flawed as all are, if they could have actually ever gotten into the hands of those in such desperate need of the type of services they provide if they could have been carried with them during normal operations. But due to these things, they are rarely accessible or availed to them when actually needed.

The failures of all prior art are countless and cover a broad spectrum of inabilities that contribute to the severe lack of actual safety and control providing abilities providable to our troops and others in need of them as a whole at any overall measurable range or level of effectiveness, that all prior art suffers from. These things not solely stemming from the lack or range of actual service providing abilities they possess due to the desperate need of any and all they could possibly provide. The biggest problems with the prior art stem from their total lack of versatility, adaptability and employment options, along with their restrictive range of effective use, and with all components thereof not only being very cost inhibitive but their dependence on the functionality of each other also rendering them far more susceptible to failure; this as well as their complexity and all components being exclusive to their manufacturer stateside could result in lengthy down times rendering any services they were acquired to provide as unavailable during the rest of the mission or possibly during the rest of the entire deployment. Of course their complexity and dependency probably being the very least of their problems.

But the main problem with this tactical firearm, as well as what all the prior art suffers from, is that prior and current solutions are extremely lacking in their range of versatility, adaptability, over all abilities, and range of use, resulting in a lack of safety, control and protection that they actually provide to the user. Most of these current solutions also consist of multiple, bulky, heavy, high tech, very expensive electronic devices, and components that not only take up space, but also add much additional weight to a soldier's existing heavy load. Most of these current solutions restrict their own range of versatility by doing things like, engineering them in a way that these devices are exclusive either to themselves and are manufactured as an integral part of a particular firearm, or exclusive to one type of firearm. These current solutions' exclusivity to themselves create other problems as well with their combinations of very expensive high-tech electronic components which not only limit versatility and range of application but also create additional problems of dependability, in that these components are dependent on each other to work as a functioning unit. These solutions, even with all of their very expensive high-tech complexity are still found lacking in their overall technical range of applicable service and abilities as well as their tactical abilities.

That forethought and innovative engineering in the incorporation of a common smart device may have been a better choice as an electronic and technology source if possibly applicable to their solution, which in cases not only possess the abilities to better provide the services that their specially manufactured, very expensive and exclusive components provide, in that there's over twice the technology in a common smart device, than there is in the space shuttle, which may sound a little far fetched, but that's an actual statistic.

This resulting in the provision of almost limitless technology availed to them. This to say nothing of the serious developmental and production cost savings which would have significantly brought down the cost of these prior solutions as well as any possible electronic repairs needed not only never requiring downtime in that even in the case that all failed the remedy would be to simply install another small incrypted and embedded mil-spec tablet or other, on the device and all while availing them with the highest level of electronic technology ever devised, while also enabling them with a vast number of other extremely useful abilities, as well as their range of use and most importantly, possibly the range of safety that they could have possibly offered the user.

Of course, no degree of electronic sophistication or technology can make up for the prior art's lack of vision, innovation, forethought and creative engineering, their efforts better directed towards the most effective solution to the problem as a whole. However, the added abilities of a very high-tech computer, which a smart device actually is, can radically expand other electronic devices' abilities, if applicable to their solution, and initially engineered to integrate into their solution. Furthermore, not only are these other current solutions very expensive because of their complexity, expensive and exclusive components, but this along with the possible additional expense of repair, service, and maintenance of these systems more often than not, make them un-affordable for most small entities such has militias, micro-states, police departments, or even our own military for that matter, when the number of these other current solutions needed to properly supply our troops are considered, and the price of doing so, with most of the current solutions actually offering very little overall safety and control to the user.

The prior arts failure to provide any real solution to these problems, and others, due to their numerous inabilities and inherent deficiencies all of their solutions possess, along with all being totally exclusive unto themselves with a total absence of versatility or range or concomitant applicability or adaptability to the effect of the few tactical abilities they did possess actually getting into the hands of our troops and others where abilities of this nature are so desperately needed and the prior art has so miserably fallen short of providing them, and whether due to a lack of conceptual vision, or in that of a lack of actual effort put forth on their part the miserable failings of the prior art to make any significant difference in their provision of any real measurable level of safety or control providing abilities to any more than a very small percentage of our troops, and even then, with serious limitations in their overall range of use, and levels of effectiveness, have been historically responsible for countless numbers of U.S. casualties, which is absolutely unacceptable.

Two additional devices were found in the prior art that employed a display with a camera and not only were both employable solely with smart phones neither had much of anything in common with the applicants display device mount, other than their both sharing the ability to mount a smart phone on a firearm.

In fact the only thing found that actually consists of mount that's even devised to mount a smart device on a firearm's mounting rail is a smart phone mount by Intelliscope™, and of which is simply a smart phone mount that solidly mounts a smart phone to the mounting rail on a firearm and in no way employs a sight of any kind but rather uses the camera on the smart phone, to acquire a digital image of the area and provide same to the display of the same smart phone where solely by means of the application providing the instructions to the computing abilities of the smart phone the image of a positionable target reticle is provided on the screen of the smart phone, and of which target acquisition is acquired by means of the digital image sensor and the computing abilities of the smart phone all by itself.

The main problem with using the smart phone camera, as the actual sight in this manner is that its impossible to achieve any real level accuracy, in that manner. The device is made mainly for paint ball guns or novice shooters.

Another device that also offers no tactical advantage but uses a smart phone to acquire a target image form a scope on a firearm of which simply consists of a smart phone bracket or clamp that attaches both to the smart phone as well as to the outer portion of the lens housing of a high powered scope and of which positions with the camera on the smart phone in the vantage point to view the target image provided by the scope through the back lens thereof, and thus the target image is viewed on the screen of the smart phone this device is very limited in its range of use and versatility in that this device is made to be mounted exclusively on high powered scopes and simply employed to provide a much larger and easier to view image provided by the scope, as well as to be employed for recording purposes and a few other services providable by the smart phone it self like the applicant's. However, this device was neither devised for, nor is capable of offering any tactical advantage of any sort, nor does it share anything else common with the applicant's display device mounts.

Applicant's present invention is a device that avails the user the full use of the firearm, from a safe, secure position, superior to the high tech, highly complex and extremely expensive currently available solutions, even though applicant's core device is a relatively simple and inexpensive to produce, mechanical device, that is engineered to take full advantage of all abilities availed to this device by the common smart device, or other display device with a camera this device possessing the ability to not only vertically and latterly adjust the display device and the camera thereof to the perfect lineal alignment with the target reticle or crosshairs of the sight or scope its acquiring its surveilled and targeting images from rotate and lock into positions to each side of the firearm, as well as from behind the firearm. This, along with the smart device's large viewing screen allows the image provided by this device to be viewed from basically any position user would place himself in relation to the firearm, with the target image always remaining positioned perfectly centered in the smart phone or smart device's screen behind the reticle. This allows for extremely fast and easy target acquisition. This, along with the added abilities that the secondary camera, that its mount is an integral part of the smart phone mount on these devices, that provide the user with the ability to maintain a continuous visual of the area behind the user at all times to see approaching hostile combatants or other developing enemy scenarios, will probably prove to save many lives as well.

Another added advantage of using a display device viewing screen adds tremendous sighting abilities as well, in that instead of having to find the target by looking through what is usually only approximately a I inch to a 1 and ⅜ inch viewing window in a reflex type sight or scope, and then having to find and line up the target with the reticle, as well as locating the target in the first place with a very small and restricted field of view, is both ineffective as well as time consuming. This, when time is very critical to the survival of the soldier when performing this task These tactical camera and display device mounts on the other hand, operate in a completely different mode, that not only provides the target reticle to the user in a manner that always remaining perfectly centered in the display device's screen, but due to the positioning of the camera's lens. this provides the user with a wide view of the area as well, providing the user with extremely fast target acquisition, in that all the user must do is center the target in the smart phone screen behind the reticle.

The smart device camera and display device's wide field of view, that is also instantly zoomable, also provides the user with the ability to locate and access other potential dangers as well, such as advancing hostile forces, developing enemy scenarios, sniper positions, etc. This, with the user's entire body remaining behind protective cover while doing so. This, along with the tactical camera and display device mount ability to employ any type or size of smart phone, as well as small to medium sized tablets, or dedicated mill-spec displays further enhances this device's overall range of versatility.

This, as well as the display device's ability to record photos and video for evidentiary use and maintain communications with other personnel, also using GPS to report enemy positions or call in air strikes, etc. Also, the target image can also be brought up on a regular computer screen such as a laptop, so that, when device is being sighted in or when the sights that this device is being used in conjunction with are being sighted in, the target image can also be magnified so that this device can be used to sight itself in. This, as well as other numerous non-tactical uses.

SUMMARY

Included in this application is a firearm mountable, display device mount, adapted for the mounting of a combination display with a camera with additional options of employment including, but not limited to a smart device such as a dedicated display with a camera for military applications or just a smart phone or small tablet in the non-tactical version or for law enforcement or other.

All variations of this invention previously devised by the applicant of this nature, as well as all content included in this application include, both a tactical and non tactical version of this invention.

The non-tactical version of this invention, is exactly the same as originally devised and has suffered no change or improvements from the original version of same, and other than more complete drawings of same, only described in earlier applications for the invention, the rest of the content included in this application, is documenting improvements made to the tactical version of this invention, of which has been in an ongoing state of advanced development, and has experienced numerous modifications and variations since originally devised by the applicant. This simply due to the applicants ongoing efforts directed towards this invention's provision of the highest level of defensive safety and control providing abilities possible, to those in this nation in such desperate need of same. The bulk of the content included in this application simply documenting the results of the applicant's ongoing efforts to that effect.

All components common to both the tactical, and the non-tactical versions of this combination camera and display device mount remain totally unchanged.

All tactical ability enabling apparatuses or portions thereof as well all components enabling same included in this new version of tactical combination camera and display device mount included in this application that enable tactical abilities of any kind, including all variations of angularly and vertically adjustable mirrored devices and their cars, the tracks they ride on and track stops, as well as all components enabling angular adjustability of the display mounting platform and the display device with a camera mounted therein to each side of the firearm, including all enabling components comprising the differences between the tactical and non-tactical versions of this invention are new in every way.

The apparatus differences between the tactical and non-tactical versions of this smart device or combination camera and display device mount include but are not limited to the tactical version of this camera and display device mount, invention, comprising a rail mount with a lower portion that releasably secures to a mounting rail on a firearm, an upper portion of the rail mount comprising an upper mounting base portion, of which is rotatably coupled to a lower base portion of a plate.

The non-tactical version of the combination camera and display device mount invention, also comprises a rail mount with a lower portion that is releasably securable to a mounting rail on a firearm and also comprises a plate, however the plate portion of the non-tactical version of this invention is not rotatably coupled to the rail mount but is an integral portion of the plate.

The plate portion of both the tactical and the non-tactical versions of this display device mount extends upward, and of which comprises at least one track or track channel portions or portions adapted for the mating with at least one track or track channel portions on the back side of the mounting platform of which is disposed upon the plate and vertically adjustable thereon, by means of a threaded member, extending through and rotatably coupled to a portion of said display device mounting platform, and additionally threaded into or through a portion of said plate, enabling precise vertical adjustments to be made to the said display device mounting platform.

Said display device mounting platform additionally comprising at least one lateral adjustment mechanism, including a threaded member enabling the precise lateral adjustments to be made to the said display device by means of the clockwise and counter clockwise rotation of said threaded member.

Said display device mounting platform additionally comprising at least one securement mechanism, enabling the securement of said display device to said mounting platform, thus enabling the perfect lineal alignment of the lens of camera portion the display device, with the target reticle or crosshairs in the sight or scope its acquiring its targeting images from.

This is where things common between the tactical and the non-tactical versions of this combination camera and display device mount invention ends. These differences include but are not limited to the tactical version of this device being angularly adjustable relative to the said rail mount and its upper mounting base portion thereof, that the mounting base portion of the plate which is rotatably coupled to and additionally angularly adjustable thereon relative to the rail mount by means of a latching mechanism, that unlocks the upper portion of the device comprising the camera and display device mount out of one of the display mounts angles of employment, relative to the rail mounting portion of the device, by means of the employment of a latch disengagement actuator which disengages an engagement portion of the latch from a receptacle portion of the base enabling the base portion of the plate to rotate freely on the base portion of the rail mount and solidly re-locks both together by means the of the releasing of the said latch disengagement actuator before but in a close rotational proximity to the user's next desired angle of employment, then simply by means of continuing the same turning motion of the display device the engagement portion of the latch will pop into and solidly re-lock the display device mount into its next desired angle of employment. This all new alternative type of angular adjustment mechanism will possibly enable even faster and more fluid angular adjustment of the display mount.

This improvement of the applicant's was simply in an effort to maximize the speed and fluidity when making angular adjustments to the display device mounted in this new type of tactical camera and display device mount. The mechanical composition of these new apparatus portions of both the angularly adjustable base, of the tactical display mount, as well as that of the reflective device, car, track and stop portions of this new type of tactical camera and display device mount, are completely different than all others devised by the applicant. These apparatus differences, as well as the modes in which they provide said services are very different also, that radically improve and advance the level of speed, ease of operational, efficiency which in this case results in a far greater level of safety providing abilities, than those previously devised by the applicant.

Another portion of this tactical camera and display device mount that has endured total change, is several versions of an all new, a non image reversing reflective device and car combination, deployed on, and positionally adjustable as well as taken in and out of positions of deployment and non-deployment on a track or tracks that are an intergral portion of the back side of the display mount. Said reflective device is adapted for the rotatable deployment and two angles of adjustment in said car and to the provision of a non-reversed visual of an area to each side of the display device mount, and adapted to acquire targeting images from other target viewing devices mounted on the firearm such as reflex or holographic sights or scopes and for the prevision of non-reversed images of same to the lens of the camera portion of the display device mounted in the combination camera and display device mount. Said reflective device is provided with two optional angles of adjustment 180 degrees in relation to each other and provide a non reversed visual of the area to each side of the combination camera and display device mount. Said two angles of adjustment are 180 degrees in relation to each other and are accomplished by the user simply by means of rotating the reflective device housing in said car where same pops in and out of positions of employment in its provision of a visual to either side of the combination camera and display device mount. This combination car and reflective device is also taken in and out of service quickly and easily with one hand as well, which is accomplished simply by means of grasping a latch actuator portion or portions of said car and vertically sliding same in and out of its positions of deployment and non deployment of which solidly latches said car to said track or tracks once released.

A car stop is also provided that solidly attaches to the track after the initial setup and alignment of the lens of the camera portion of the display device with the target reticle or crosshairs in the sight or scope the camera is acquiring its targeting images from and the reflective device portion of the car is centered over the lens of said camera. At this time the car stop is attached to said track up against a bottom portion car thus always maintaining the center portion of the reflective device's alignment with the lens of the camera, as well as with the target reticle or crosshairs of the sight or scope its acquiring its targeting images from when re-employed.

This mount is also devised in a manner in which the center of the target image acquiring window portion of the reflective device portion of the car always remains in the exact same linear alignment with the target reticle or crosshairs of the sight or scope its acquiring its targeting images from, as the lens of the camera portion of the display device's initial alignment with same when rotated and latched into its position of employment to surveil the area from either side of the firearm. The image of which, always remains perfectly centered in the screen of the display device employed, this of course in turn meaning, the target reticle or crosshairs in the sight or scope of which the lens of the camera in the smart device or dedicated mil-spec display is initially aligned with, in turn always remains perfectly centered in the display the device is employing, which in turn makes target acquisition as fast and easy as one could point at the target, any of the aforementioned actions being accomplisable with this new type of display mount devised by the applicant in a fraction of a second with one hand.

All new types of mirrored devices, the cars they ride in as well as the tracks they ride on and the stops that maintain their adjusted positional orientation relative to the camera lens of the smart device, or dedicated display that the tactical display device is employing, as well as the mode in which all are employed is completely different than those previously devised by the applicant.

However the tactical version of this invention included in this application, on the other hand, was devised for the same basic purposes, and to provide the same basic services, as those previously devised by the applicant, but it does so with a provision of a non-reversed image as well as various types of reflective device options providing image modification options. This as well as this device's provision of a far greater level of speed and efficiency than those previously devised by the applicant. This as well as the operational mode in which some of these services are employed, and the modes in which they are achieved by the mechanisms providing said services which are quite different in every way while all other components enabling functions of a non-tactical nature remain exactly the same, however all of which will be fully described and easily understood in the drawings and their descriptions that follow.

A height adjustable stop is also provided that rides on and compressably secures by means of a setscrew or latch to one of these tracks, that is used as a stop for the rotatable mirrored device. When taking this mirrored device in and out of service, so that this mirrored device, always returns to its exact position of initial alignment with the target reticle or crosshairs of the sight or scope its acquiring its targeting images from. This rotatable mirrored device houses two mirrors, and provides the camera of the display device or the smart device its employing with a non-reversed image.

It is the objective of the applicant of this invention to ever improve and enhance the overall range of, function, of the tactical display mounts, included in this application to their provision of the highest level of safety providing abilities possible, and in turn provide our troops, law enforcement, and others with the maximum level of safety and control providing abilities, to surveil areas of potential danger with the highest-level efficiency possible.

It is yet another objective of the present invention, to provide surveillance sight accessories that possess the maximum range efficiency, adaptability, versatility, operational efficiency and overall speed and ease of operation and use, to ever improve and maximize the level of safety and control providing abilities providable to our armed forces, and others and avail them with these abilities in the performance of duties requiring them to put themselves in harm's way to do so.

It is another objective of the present invention to provide improved surveillance, sighting, and zooming abilities for our armed forces, by providing them with not only the view of an area with the target reticle perfectly centered in the screen of the smart device, providing the user with lightning fast and easy target acquisition, with the time required for which quite often being critical to their survival. This along with the ability to more toughly surveil areas from much greater distances revealing and engaging sniper positions or other distant and previously hidden dangers as well to ever more effectively surveil arias revealing hidden dangers therein, with the ability to more accurately and effectually engage targets absolutely critical to their survival, and more efficiently and efficiently reveal origins of incoming fire, advancing hostile combatants, developing enemy scenarios, sniper positions, etc. while maintaining a position behind full protective cover, without exposing the slightest portion of his body a target while doing so, with the maximum degree and range of safety, and control providing abilities possible.

It is yet another objective of the present invention described in this provisional application to provide advanced tactical firearm surveillance devices for firearms that are small, lightweight, operate in their maxims level of versatility efficiency, rang of use and greatest range and level of safety providing abilities possible. This as well as their being applicable to any type of firearm employed by our military, both that of ground troops and special forces as well as all types of firearms employed by law enforcement, such as S.W.A.T. and secret service personnel, and others in such desperate need of the safety providing abilities they possess.

Another objective of this present invention is to provide smart device combination camera and display device mount accessory and superior sight systems for firearms that are secured to the mounting rails of any type of firearm, that are adjustable and rotatable for multiple configurations, to accurately use the firearm from various positions the user may have to position himself in relation to the firearm.

Another objective of the present invention is to provide improved firearm accessory mounts and sight systems for firearms that maintains the display device's camera lens in perfect coaxial alignment with the reticles of the firearm sights its employing after rotation of the mount to either side of the firearm.

It is yet another objective of the present invention to provide an improved firearm accessory that is a display device mount and sight systems for firearms that improve viewing of targets through the primary firearm sights on the firearm that provides the target image to the display device that is mounted on this accessory, that is cost effective and operationally efficient.

It is yet another objective of the present invention to provide a more efficient, and improved display device mount and sight systems for firearms that provide the user with a wide view of the surrounding area with the sight's target reticle always remaining perfectly centered in the smart device's screen, making target acquisition extremely fast and easy. This, in that all the user must do to sight in a target, is to center the target in the smart device's screen, behind the reticle, which radically enhances speed and accuracy in firearm alignment, when time is critical.

Finally, it is an objective of the present invention to provide firearm mountable display device mounts and sight systems for firearms that incorporate all the above-mentioned functions, objects, and features.

In accordance with these and other objects which will become apparent hereafter, the instant invention will now be described with particular attention given to new material.

BRIEF DESCRIPTION OF THE DRAWINGS

The accompanying drawings, which are incorporated in and constitute part of this specification, illustrate embodiment's of the invention and together with the description, serve to explain the principles of the disclosed embodiment's. The embodiment's illustrated herein are presently preferred, it being understood, however, that the invention is not limited to the precise arrangements and instrumentalities shown, wherein:

FIGS. 9-A, 9-B, and 9-C are drawings of the bottom of an angularly adjustable rail mount.

FIG. 10-A, 10-B, 10-C is a drawing of the bottom of an angularly adjustable rail mount, and components thereof.

FIGS. 11-A, 11-B, 11-C and 11D are drawings of a profile views of a non-reversing reflective devices and track cars.

FIGS. 12-A and 12-B are profile views of single mirrored reflective devices and track cars.

FIGS. 16-A,-B,-C,-D- and E are drawings of rail stops.

FIGS. 17-A-B-C,-and D are drawings of rear viewing cameras with displays, and armature.

FIG. 18-A and FIG. 18-B are drawings of a rear viewing cameras and armatures. These rear viewing cameras both receive, power from as well as provide image to a display device, such as a smart device, and do so by means of a free application enabling same.

DETAILED DESCRIPTION

Figure 1:
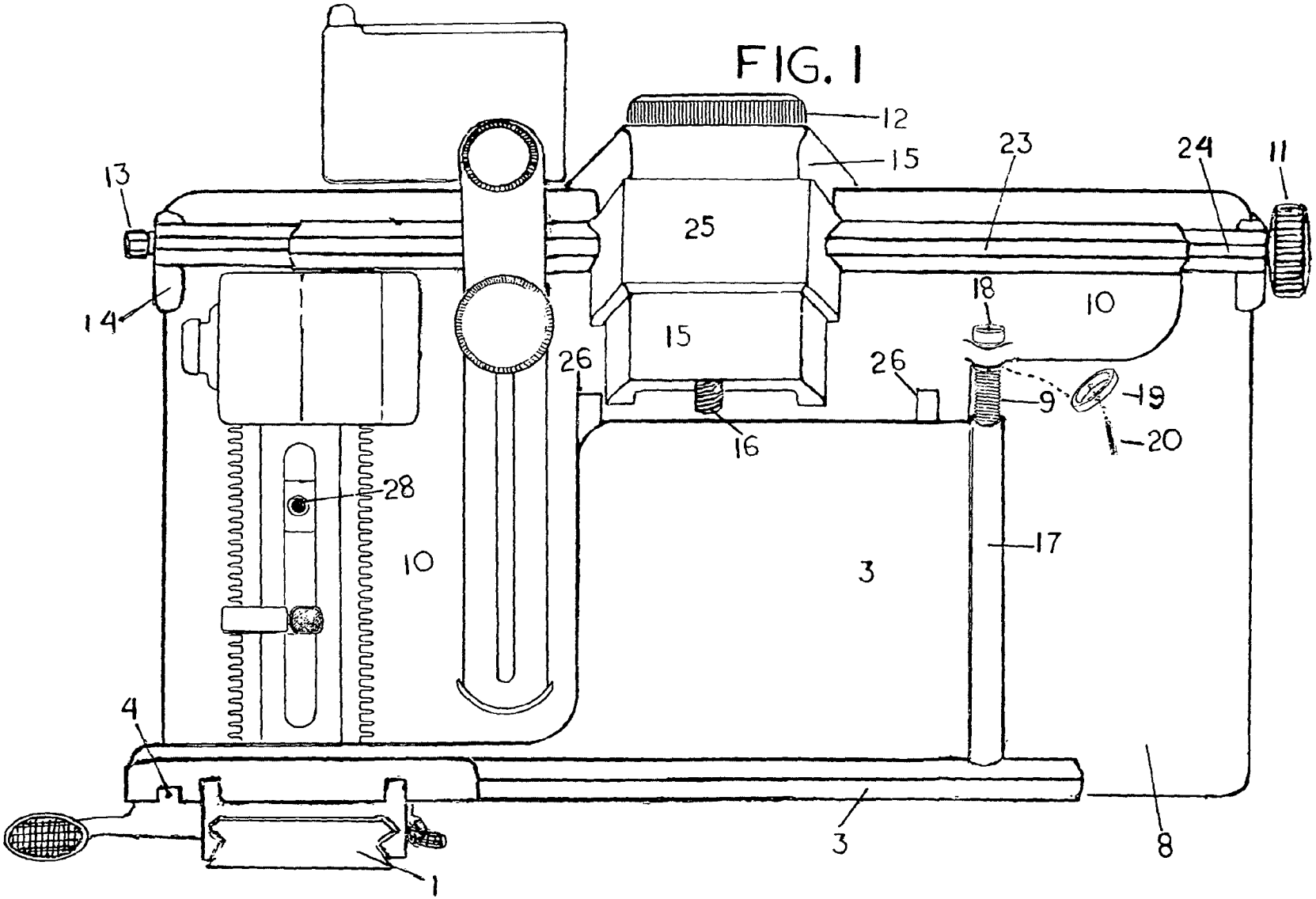
FIG. 1 is a drawing of a frontal view of components old and new, with original components referenced in their original numbered references.

Accordingly, the components have been represented where appropriate by conventional symbols in the drawings, showing only those specific details that are pertinent to understanding the embodiment's of the present invention so as not to obscure the disclosure with details that will be readily apparent to those of ordinary skill in the art.

The present invention advantageously provides additional accessories and modifications applicable to the tactical, multi-positional display device mount, that attaches to the mounting rails of firearms, behind any existing target viewing device mounted on the firearm and provides solid mounting, rotational, or angular, position ability, as well as vertical and lateral adjustability for the positioning of the camera lens of a display device with a camera, in perfect lineal alignment with the target reticle, in the target viewing device employed. This position not only being the position in which the highest level of accuracy is acquirable, but this mount possesses the ability to maintain the lens of the camera in perfect lineal alignment with the target reticle when the display device mount is rotated and latched in place on either side of the firearm, and does so with the provision of the surveilled and targeting images to the lens of said camera in a true, or non reversed image. The display in turn displays same in the full screen of the display device with the image of the target reticle always remaining perfectly centered in the screen of the display enabling the user with the full screen of the display devise to surveil the area, when needful to do so from positions of protective cover and out of the line of fire.

This device provides the user with the ability to surveil his surroundings from positions of protective cover and out of the line of fire while doing so, these being abilities extremely needful of our ground troops, especially in theaters of urban combat which has proven to be extremely costly in American causalities, simply in-that much of which has resulted in sniper warfare by the enemy, and knowledge of the true threat demographics and the dangers surrounding them at all times, without having to become a target to discover same, proving to be desperately needed and of paramount importance.

These things proving evident not only after taking cover after coming under fire, and having to locate the point of fire and surveil the area for other developing enemy scenarios or additional incoming hostile combatants, when the enemy has even seen where cover was taken, and are just waiting for you to peak around the corner, but also in the performance of a broad range of duties requiring of our troops to put themselves in harms way on a daily basis, whether simply having to traverse between one point to another and having to view down allies and around corners to access the dangers in the path they have to take, or worse yet having to clear buildings of snipers and other hostile combatants that were just firing on you and having to look down halls and into rooms without having to become a target to do so, or simply on watch, patrol, surveilling enemy strongholds as well as countless other duties and battlefield scenarios, where the ability to accomplish same without having to become a target to do so, becomes of paramount importance to their very survival.

FIG. 1 is a drawing of the frontal view of the invention in its new embodiment described herein, with its non image reversing mirrored device raised and locked into its position of non-use and the rotatable rail mount locked into its position of rotation, to use the firearm in the conventional manner. All non tactical components included in this drawing of which have remained unchanged from the applicants original inventions of this nature are numbered in their original numbered references and simply referenced in this manner to easily distinguish between original and new material.

Figure 2:
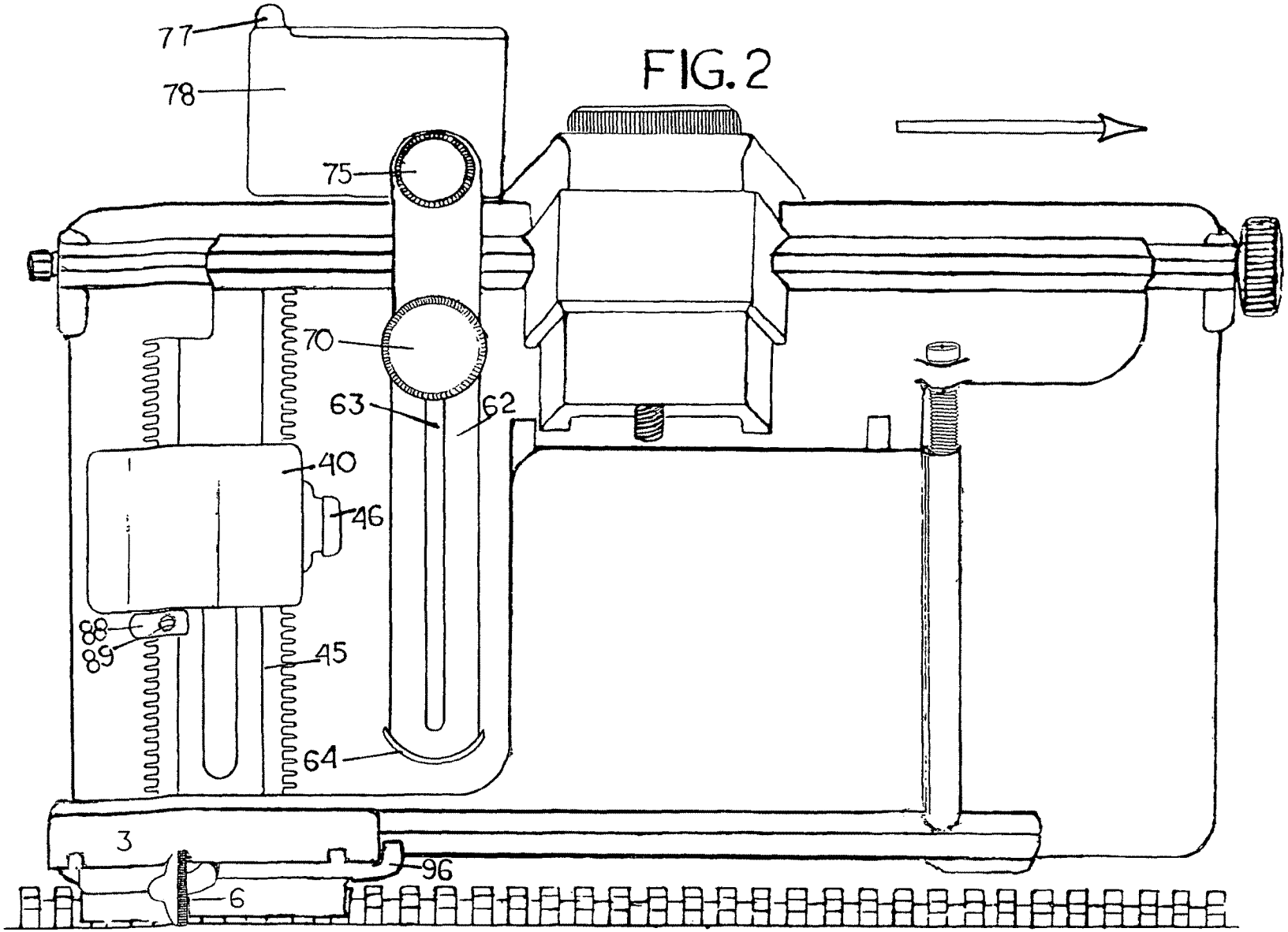
FIG. 2 is a drawing is a frontal view of the display mount showing many new components as if rotated to the left side of the firearm.

FIG. 2 This drawing lists some of the mechanisms and components comprising new material included in this new version of this invention, and briefly explain their function and mode of operation, with a much more detailed description of this new material, where these new components are individually illustrated and referenced, and where a very clear understanding of this new material as well as the task they perform and the mode in which this new material performs these tasks will be fully and easily understood. This illustration shows a view of the forward side of this new embodiment of the invention as it would appear rotated around to the left side of the firearm and locked into position, as if acquiring targeting images from a sight or scope and viewing the images of same from the left side of the firearm.

If the camera lens of the display device was originally aligned into perfect linear alignment with the target reticle of a sight or the cross hairs of a scope its acquiring targeting images from during initial setup, once rotated, the center of the viewing window of the reflective device also remains in perfect linear alignment with same, meaning that not only does the lens of the camera always receive the targeting images from a position where the absolute highest level of accuracy is acquired, but the target reticle or crosshairs in the sight or scope the targeting images are being acquired from always remains perfectly centered in the screen of the display device, employed in the display mount additionally enabling the user with extremely fast and easy target acquisition as well as the display device's ability to instantly zoom in on the target and positively identify the true hostile combatants, from innocent civilians, so often intermingled with same in theaters of urban combat, sure to reduce numbers of collateral damage as well.

Number 40 is the reflective device that receives its target image from various target viewing devices mounted on the firearm such as reflex, or red dot sights, holographic sights, scopes, iron sights or any other target viewing device on the firearm, when viewing targets from either side of the firearm or when employing same in the conventional manner and employing the display device screen as a targeting monitor.

This application comprises three reflective device options, illustrated and described in detail in FIGS. 11-A and 11-B as well as FIGS. 12-A,12-B and 12-C. This reflective device is an integral part of a car (not seen) that will be seen and described in detail in the definitions for illustrations, FIGS. 13,14, and 15, that this reflective device rotates in this car, of which is vertically adjustable on tracks #45 of which it locks onto pre-adjusted positions that remain constant and in perfect linear alignment with the sight or scopes target reticle or cross hairs when changing viewing angles of targets to either side of the firearm, or is raised and locked into its position of non-deployment up and out of the way of the camera lens of the smart device, to create a clear lineal view of the target viewing device that the smart device is receiving its target image from, when using the firearm in the conventional manner, as seen in FIG. 1.

This car rides always returns back to its pre-adjusted position by means of a stop #88 this car is raised and lowered as well as originally adjusted on tracks #45. These tracks have a series of teeth or notches located on the outer portions thereof, that pin portions of two spring loaded push button latches #46, located on the lower outer portions of this car and lock into. The final design of this device may have only one latch, as well as only one of these tracks #45, having teeth or notches located on the outer portions thereof, with the other having a straight or smooth outer edge. These tracks teeth can also be located on the inside portion of the tracks and employ a completely different type of car and latches as seen in figs # The latches included in this drawing will be seen and understood in the description for FIG. 14.-A stop is also provided, #88 with a set screw #89, that locks onto the track #45.

Design options of this stop are seen in FIGS. 16-A, B, C, D, and E. This stop is locked onto track #45, at the time of initial set up of this device, after the smart device's camera lens is centered in the slot between the two tracks which is perfectly centered over the mounting rail of the firearm and proper height adjustment is made to the smart device to bring the camera lens of the smart device to the same height off the mounting rail, at the very center of the target viewing device that the smart device is receiving its target image from. This stop ensures that this reflective device and its mounting car returns to its perfectly adjusted height when taking this mirrored device in and out of service. This drawing also shows a backside view of one of the embodiment options of the rear viewing camera, employable on a base portion of a back side portion of the display mount #77, that is an integral part of its viewing screen and battery housing, #78.

This rear viewing camera is mechanically connected and angularly adjusted on the armature #62, by means of threaded stud and knob #75, with this rear viewing camera height adjustable and pivotally, or angularly adjustable armature #62, is locked into its desired angle and height by means of an angle adjustable clamping device, This armature clamp is compress-ably loosened and tightened by means of the rotation of knob #70. Optional modifications have also been done to the rail mount and latch that locks the rest of the invention, being the entire rotatable portion of this invention into its different positions of use, to view targets and their surrounding area from either side, or from behind the firearm. The portion of #3, that makes up the top portion of the rotatable platform, directly above the inner bearings (not seen) and that the center thereof of which is the connection point between the rest of the invention and rail mount #2, the outer perimeter of which in this new embodiment of this invention extends downward, creating a skirting around the upper portion of the rail mount #2, which becomes both a dust and debris cover for the bearings and other components housed therein. The lower portion of this skirting also works in conjunction with the optional latch for this device which is located on a bottom portion of rail mount #2, and becomes an integral part thereof. The engagement portion of this latch, locks into notched out receptacle portion of the lower perimeter of the skirting, and in turn locks this device into its proper angle of use. This latch is illustrated and described in detail in the illustrations and descriptions seen in FIGS. 9-A, 9-B, and 9-C, as well as FIGS. 10-A,10-B and 10-C.

Figure 3:
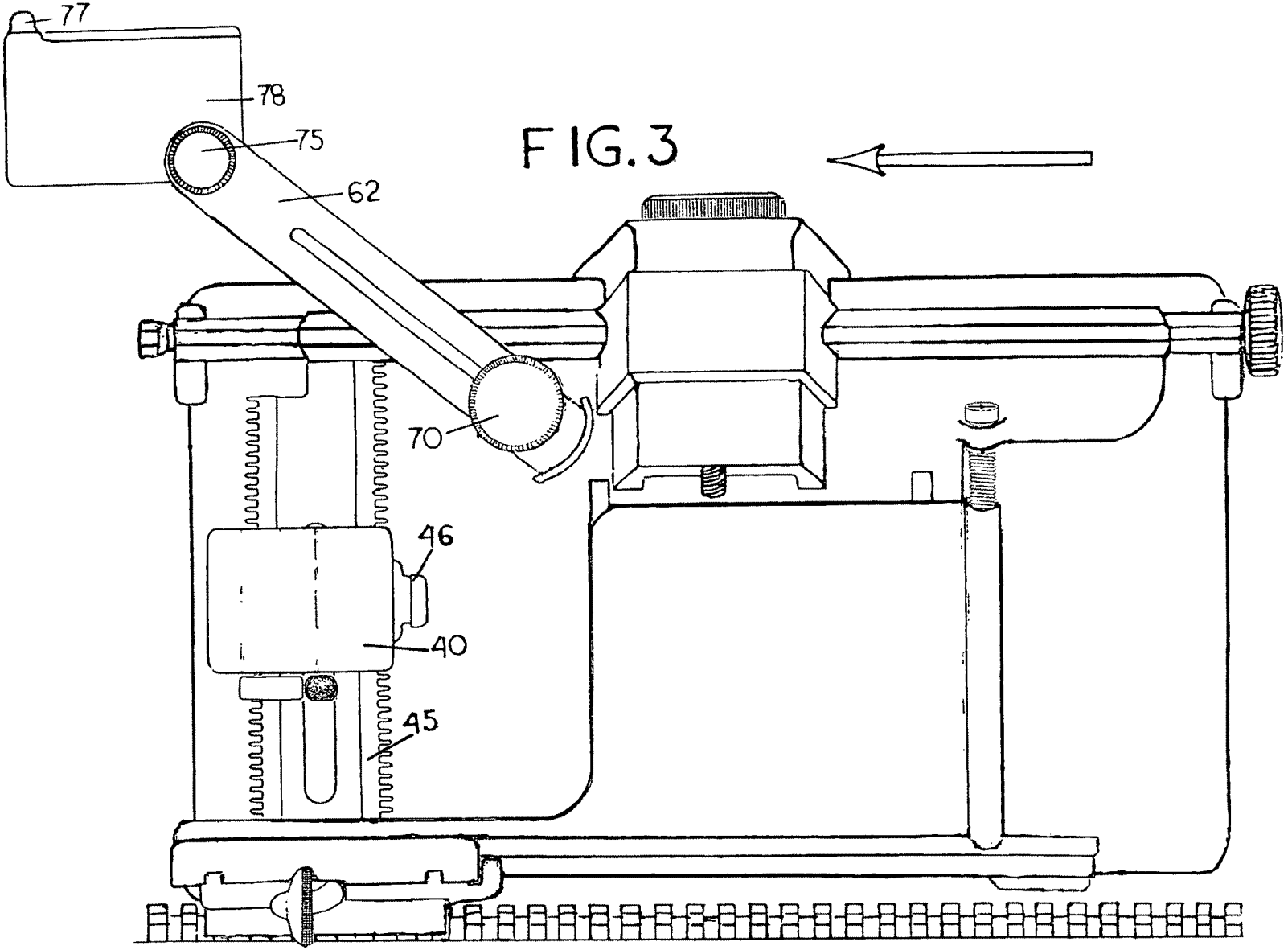
FIG. 3 is a drawing is a frontal view of the display mount showing many new components as if rotated to the right side of the firearm.

FIG. 3 This illustration shows a view of the forward side of this new embodiment of the invention as it would appear rotated around to the right side of the firearm and locked into position, remaining in perfect coaxial alignment, to view targets and the surrounding area, supplied by the sight or scope working in conjunction with this device, from the right side of the firearm in the screen of the smart phone mounted in this device. This drawing also shows armature #62, as well as the self-contained rear viewing camera housing that houses the HD infrared viewing camera, as well as its own viewing screen, batteries, etc. extended outward and locked into a desired angle with the armature secured into the height and angle adjustable armature clamp, and tightly secured by means of tightening knob #70.

Figure 4:
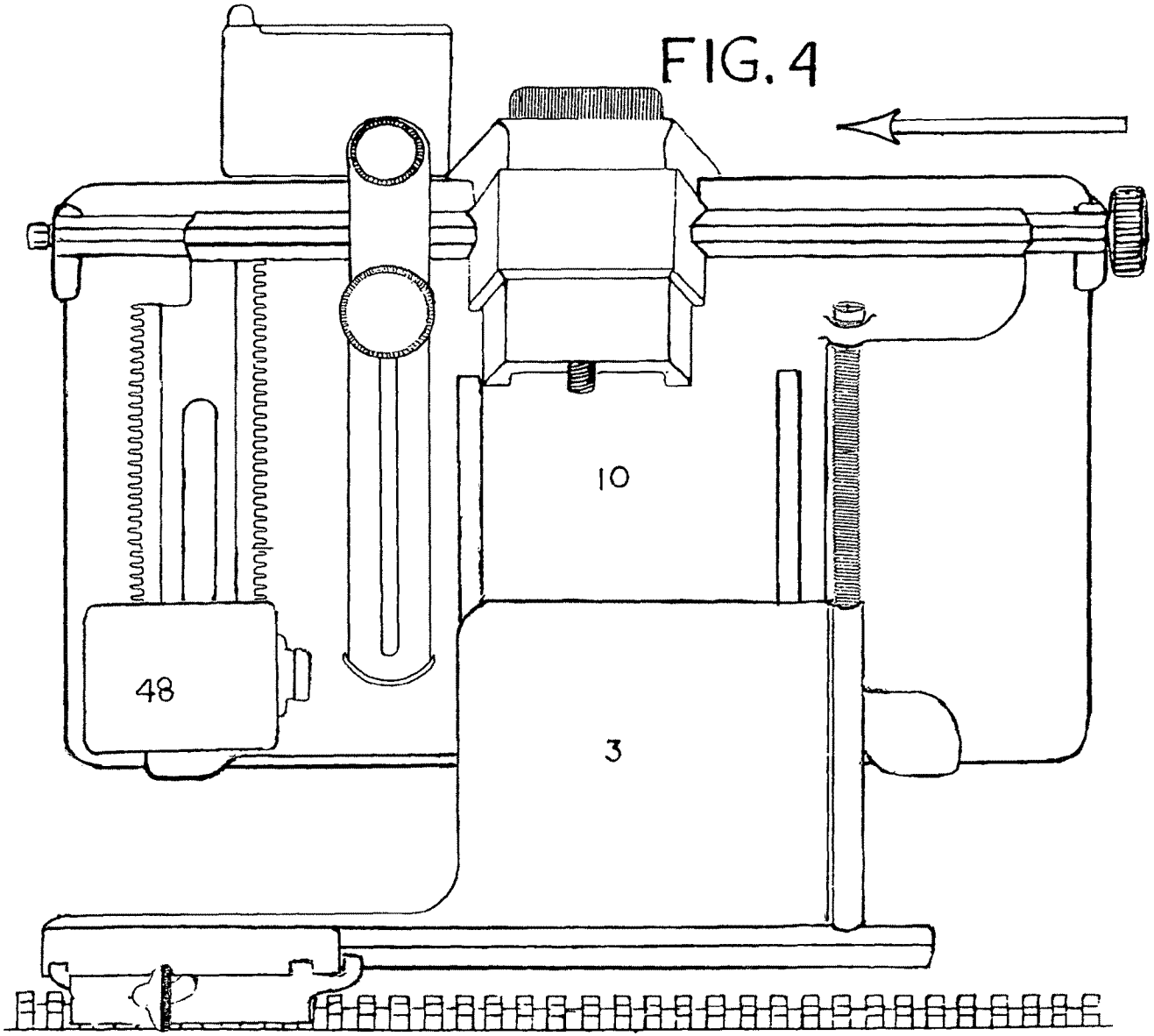
FIG. 4 is a drawing is a frontal view of the display mount showing many new components as if adjusted to view a high profile scope.

FIG. 4 This illustration shows a view of the forward side of this new type of the invention as it would appear rotated around to the right side of the firearm and locked into position, with the center of viewing window of the viewing device remaining in perfect linear alignment, with the target reticle of a sighting device (not shown) to view targets and the surrounding area, supplied by the sight or scope working in conjunction with this device, from the right side of the firearm in the screen of the smart device or display device with a camera, mounted in the display device mount. This drawing shows the device working in conjunction with a smart phone that has its camera lens in the upper left corner such as an I Phone, or a dedicated display device with a camera.

Figure 5:
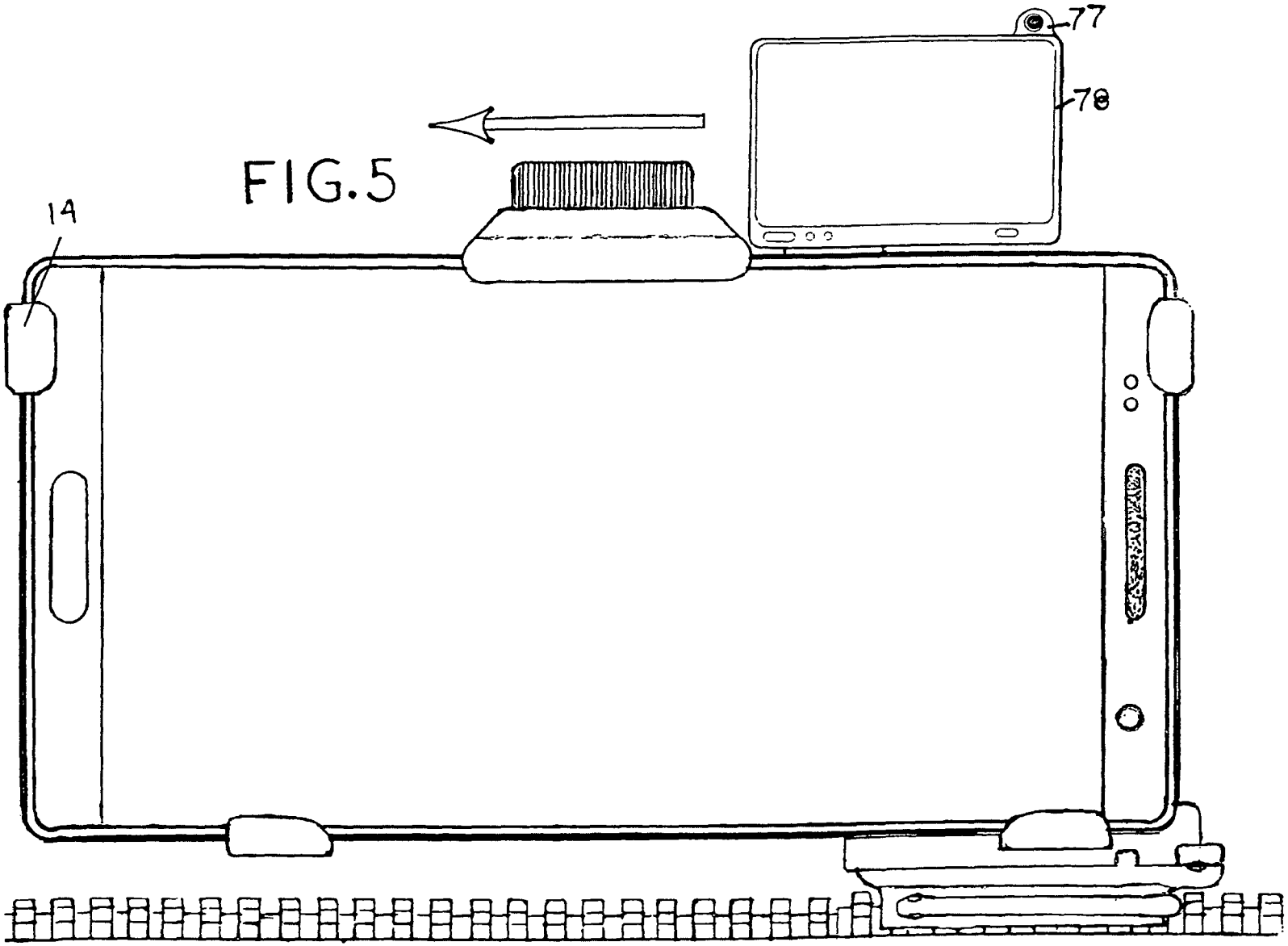
FIG. 5 is a drawing is a rear view of the display mount and display screen and rear viewing camera.

FIG. 5 This illustration shows a view of the back side, or display device viewing screen side of this new type of the invention as it would appear rotated around to the left side of the firearm and locked into position, remaining in perfect coaxial alignment, to view targets and the surrounding area, supplied by the sight or scope working in conjunction with this device, from the left side of the firearm in the screen of the display device with a camera mounted in this device. This drawing also shows the viewing screen side of the rear viewing camera.

Figure 6:
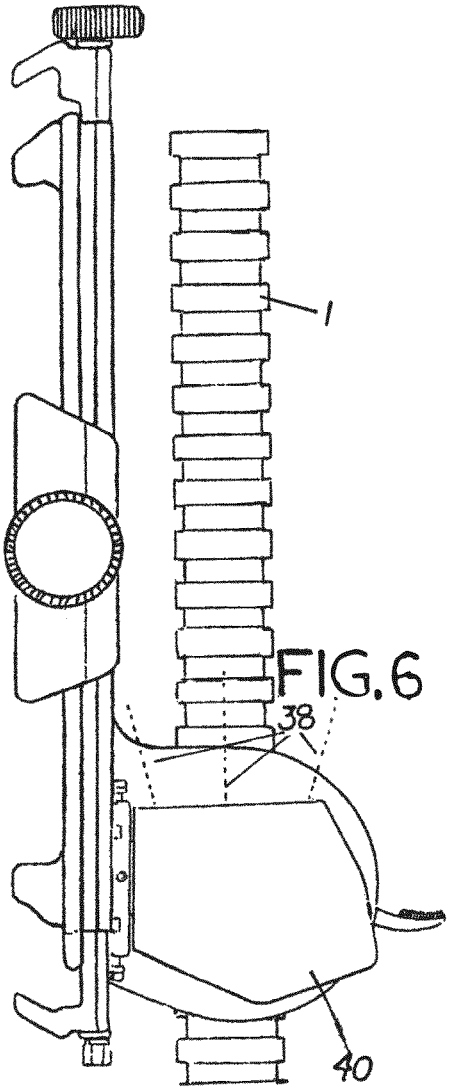
FIGS. 6,7, and 8 are drawings of an overhead view of three display mounts showing different mounting positions.
Figure 7:
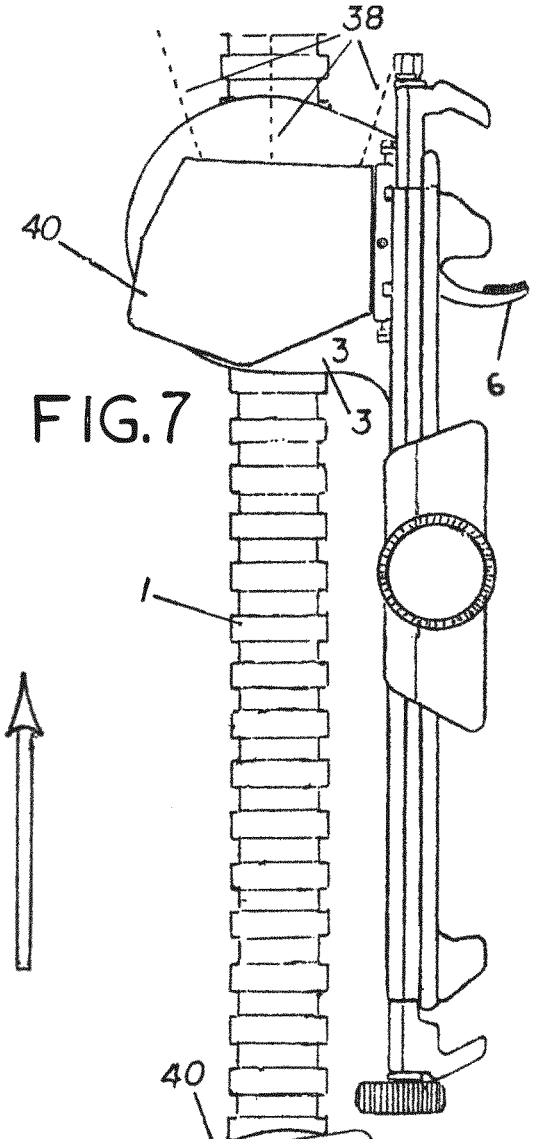
Figure 8:
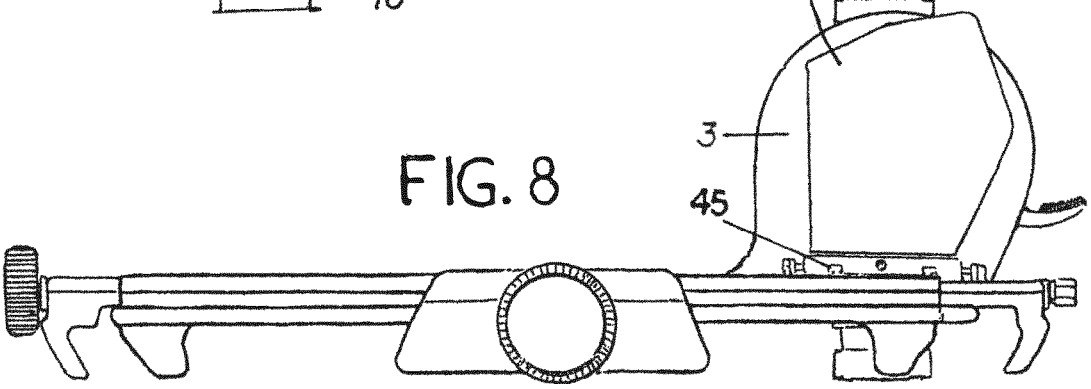

FIGS. 6, 7 and 8 These are overhead views of the new embodiment of this invention. All illustrations show this invention with the rear viewing cameras and the display devices removed from the invention so an unobstructed view of the rest of this invention can be viewed.

FIG. 6 shows this invention rotated around to the left side of the firearm to view targets from the left side of the firearm with the reflective device remaining in perfect coaxial alignment with the weapons rail, and thus to the perfect center of the target viewing device that would be mounted thereon.

FIG. 7 shows this invention rotated around to the right side of the firearm to view targets from the right side of the firearm, with the reflective device remaining in perfect coaxial alignment with the weapons rail and thus to the perfect center of the target viewing device that would be mounted thereon.

FIG. 8 shows this invention rotated around to view targets and the surrounding area in the screen of the display device with a camera from a position behind the firearm, or in the conventional manner, with the reflective device raised and locked into a position that does not obstruct the view of the cameras lens, and with the camera lens if mounted in the device would remain in perfect center above the firearm's mounting rail, which would maintain the display devices camera lens in perfect lineal alignment with the target viewing device it would be working in conjunction with.

FIGS. 9A, 9B, 9C, and FIGS. 10A, 10B, and 10C are all drawings of the bottom of rail mount #2, as if the device was turned upside down and shows the engagement portion of the latch #5, as well as the bottom edge of the skirting portion of #3. The bottom portion thereof contains several notched-out receptacle portions of said skirting, where the engagement portion of the latch #5, locks into, to maintain the rest of this device into its desired rotational angle of employment. A raised stop #96, being a part of said skirting #3, also comes into contact with #97, being one of two end portions of rail mount #2, which a cut out or notched out portion thereof that allows the lower perimeter of the skirting edge of #3, pass through, allowing this extended portion of rail mount #2, to extend out beyond the skirting edge portion of #3, where a small end portion of rail mount #2, extends up along the outer perimeter of the skirting edge of #3, where it comes into contact with #96, a raised portion of outside skirting edge of #3, where it becomes #97, and creating an abutment or a stop which works in conjunction with the engagement portion of the latch #5, to hold the rest of this device solidly in place, when rotated and locked into position to each side of the firearm, with FIG. 9 A being a drawing of this rail mount rotated around and as if locked into position to the right side to view targets and the surrounding area from the right side of the firearm.

FIG. 9B being a drawing of this rail mount rotated around and locked into position to the left side to view targets and the surrounding area from the left side of the firearm. FIG. 9 C shows the rail mount #2, locked into its position 90 degrees to the firearms rail mount, where it would remain in perfect lineal alignment with the target viewing device its working in conjunction with. When viewing targets and the surrounding aria from behind the firearm. #1 is the bottom of a weaver or picatinny mounting rail as if removed from the firearm.

FIG. 10 A is a drawing of a bottom view of rail mount #2, as well as the mounting base and housing portions of latch #5, as well as the finger pull which is the actuator portion of latch #5 as well as the spring housing portion of latch #5, and its inner works removed from the bottom of rail mount #2. Number 92 is a cut out groove that the lower skirting portion of the spring housing of #5, rides in, which is to keep moisture and debris out of this spring housing of #5. Number 93 is a threaded hole that screw #99, with a widened smooth shank portion and reduced diameter threaded end portion, screws into, that would be tightly screwed into this hole and set in tread locker at this latch's point of installment or assemblage.

This screw would become both this pivoting latch's attachment and pivot point. Number 95 is a raised pin that the outer eye of spring #91, slips over and thus is connected to. Number 98 is the handle of the locking mechanism of the quick release rail mount of which there are many of on the market to choose from. FIG. 10C is a drawing of latch #5, removed from the bottom of rail mount #2, and turned upside down to reveal the spring and spring housing therein. FIG. 10C is a drawing of latch #5, removed from the bottom of rail mount #2, and turned upside down to reveal the spring housing of #5, with the spring removed from its housing. Number 94, is a raised pin integral to the inner portion of the spring housing of #5, that the inner eye portion of spring #91, slips on and thus becomes attached to.

FIG. 11 A is a side view of the first reflective device type included in this application applicable in this new type of tactical display device mounts. This basic type of mirror is commonly referred to as a pentamirror or pentaprism. Although this reflective device only actually houses two mirrors, this basic type of mirror has been employed in many applications such as view finders in cameras as well as overhead projectors and others for over 50 years. This reflective device initially receives its image through forward window #43, where the light from this image reflects off mirror #42 A, where this image is reversed. This image is then again reflected off of the second mirror #41 B, where this image is reversed once again back to a true, or non-reversed image where this image is received as such by the camera of a smart device or other display device with a camera mounted on the display device mounting platform that this reflective device would be supplying this non-reversed image to, to view the target and the surrounding area from either side of the firearm.

This image's reflective path is indicated by the dotted lines #38. The advantage to the employment of this type of reflective device opposed to the types referenced in the initial patent application for this invention, is its speed and ease of operation as well as its ability to supply the camera portion of the device with a true or non-reversed image in a full wide field of view. So, this reflective device would not need a smart phone app to re-reverse the image supplied to the camera portion of the display device.

This reflective device as well as all others referenced in this application, is rotatably coupled to their own platform or car #113. This car rides on and is height adjustable on tracks #112, by means of at least one latching mechanism which is both released and activated with button #114.

FIG. 11-B, through 11-D are drawings show several of the ways that the applicant has been experimenting with in his efforts to further enhance and expand these non-reversing reflective devices range of abilities and service's providable. These additional drawings of these non-reversing mirrored devices are totally of the applicants design and for all that the applicant knows they may have been devised by the applicant and they came about as a result of the applicants desire to provide these tactical display devices of his with the these additional abilities providable by them in the best way to provide by these as well as several other types not included in this application which the applicant came up with simply due to the applicants inability to find any type pentamirrors or pentaprisms that with the additional abilities desired, thus requiring the applicant to engineer same of which these mirrored devices with the advantageous image enhancing abilities would be made as providable as an easily exchangeable option in the track cars their employed in these mirrored devices included in the following drawings of modified mirrored devices that works much in the same manner as the first reflective device included in FIG. 11-A in that the reflective devices house two mirrors that provide a non-reversed image to the cameras lens portion of its display device with a camera, or smart device.

The various types of mirrors as well as their positional orientation are positionally oriented in the manner simply as examples of a few of many options and effects produce-able without the employment of an adaptable little but still bulky telescopic lens attachments of any sort, although the applicant is presently experimenting with a combination of a lens in place of a the forward viewing window if the device, along with convex and concave mirrors that shows promise.

Mirrored devices that initially receive their surveilled and targeting images, from and around the target viewing devices, their employed behind The second mirror re magnifies employed in this type of reflective device's consists of one optically, correct flat mirror and one optically correct concave mirror. This mirrored device has been engineered to provide the lens of the camera with a pre-magnified image by means of the concave mirror, in which magnifies the images received by the lens of the camera in the smart device or display device with a camera with the degree of magnification governed by the inside radius of the concave mirror.

These modifications of the reflective devices maintain their provision of their magnified images to the lens of the camera portion of the display device in a manner that remains true in that it does so in a manner that neither re-reverses or inverts the magnified image provided, simply in that the image is caught by the lens of the camera in a close enough proximity to the second magnifying concave mirror, in which that the light comprising the images captured by lens of the camera remains true and neither re-reversed or inverted before same is captured by the lens of the camera.

This being just one of several modes in which a pre-magnified non-reversed or inverted image can be provided for this non reversing right angle viewing mirrored device, with other more common modes that include lens adaptions, with all having certain advantages and disadvantages to each other.

The addition of a pre-magnified optical image, to a display device with limitless digital zooming or image enlargement abilities, of which all smart devices or other display devices with a camera that would be employed all possess, actually provides a much higher level of image quality when magnified multiple times resulting in much greater levels of distance targeting abilities than one might think This due to the pixelation of a digital image provided by the digital image sensor and digital display employed, in that digital image's resolution being reduced every time that the image is magnified and a slight bit of image clarity is lost in the process, every time the image is enlarged, however this is not the case when an image is optically enlarged, and a real advantage of employing both optical image enlargement in conjunction with digital image enlargement, being that every time the received optical image is enlarged digitally by means of the digital zooming abilities of the display device, in turn multiplies the magnification of the received optically magnified images. For example if the optical image received is magnified four times and then, digitally magnified an additional four times, the image displayed in the screen of the display device would litterly be enlarged or magnified sixteen times, which in turn provides a simple reflex or holographic sight with no magnification at all, with variable magnifying abilities far greater than most very high powered scopes while maintaining the image clarity as if the image provided was only magnified four times, which would be a loss of clarity that would hardly even be noticeable, and all while maintaining the ability to magnify the image even much more. This as well as providing a high powered scope with profound magnifying abilities while maintaining a very high level of resiliency when zoomed in and surveilling areas at great distances, providing the user with the ability to easily zoom in on and locate sniper positions and positively identify the true enemy aggressors at much greater distances, and provide an extra level of need-full service and range of versatility to the user in the broad range of battlefield demographics and scenarios beneficial of this device's employment.

All aforementioned reflective device portions of this invention supply a non-reversed image, to view the target and the surrounding area from either side of the firearm. The advantage to the employment of this type of reflective device its ability to supply the camera portion of the display device employed, with a true or non-reversed image. In turn, this reflective device would not need an application or embedded software enabling the re-reversing of the images supplied to the lens of the camera.

However, FIGS. 12-A and 12-B are much more simplistic embodiment's of this invention in that the mirror housing houses only one mirror, and in turn would provide a reversed image like the applicant's other inventions of this nature that require one of many very common free applications developed for taking selfies in a non-reversed image, which when employed also re-reverses the image provided by this single mirrored device back to a non reversed image however, this does restrict display device employment to that of smart devices or a smart mil-spec display equipped with the ability to re-reverse its supplied image, in that, target acquisition with a reversed image requires practice and range time to get efficient at it if the display doesn't possess a mobile operating platform or embedded software providing the ability to re-reverse the image.

FIG. 12-A is a drawing of another type of reflective device applicable to this invention. This reflective device's housing #40 C, of FIG. 12-A which possesses only one mirror, therefore, the image receivable by the smart device or embedded display device with a camera working in conjunction with this reflective device would re-reverse the reversed images relieved, changing back same to their true, or non-reversed state in the same manner as would be done accomplished for other single mirrored inventions of the applicant of this manner. This being by means of already available and freely downloadable applications. #43-C is the forward viewing window #40-C is the embodiment's housing #42-C is the single mirror that provides its reversed image to the lens of the camera portion of the display device. This reflective device, as well as all others referenced in this application, are rotatably coupled to their own platform or car #39. This car rides on and is height adjustable on tracks #45, and is latched to same by means of at least one latching mechanism which is latched in place on said tracks #45 by means of releasing button #46 and released and allowed to freely slide on said tracks #45 allowing the reflective device and car to be taken in and out of service by means of compressive pressure applied to button #46.

FIG. 12-B shows this car and mirrored device with a single mirror set at 45 degrees to view images at 90 degrees in relation to the firearm in the same manner as the single mirrored device of FIG. 12-A, but in a version of this reflective device that possesses a concave mirror #43-D that provides its surveilled and targeting images in a magnified form, to the lens of the smart device or display device with a camera employed.

Figure 13:
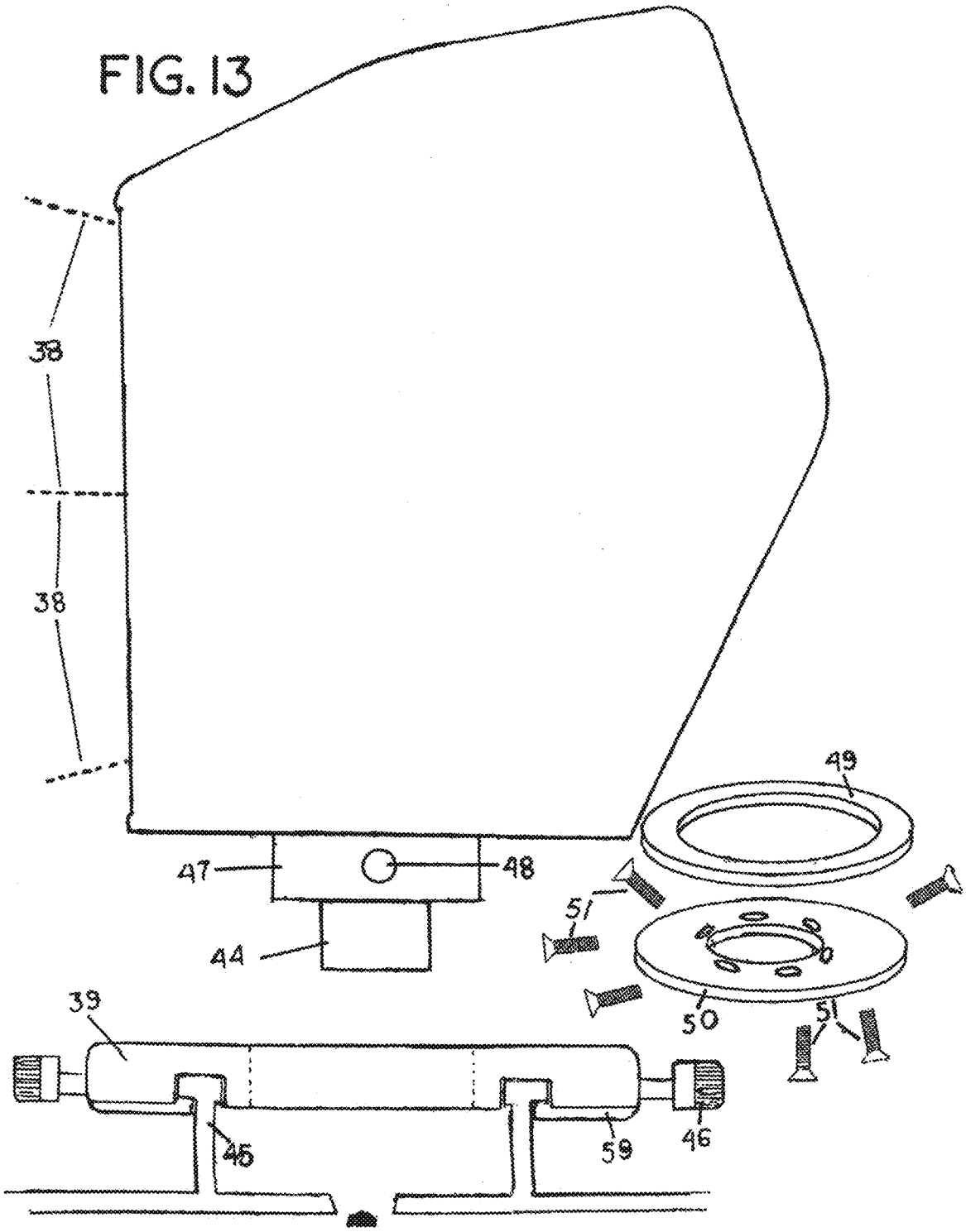
FIG. 13 is a drawing of a profile view of a non-reversing reflective devices and track car dissembled.

FIG. 13 is a drawing of this reflective device removed from its platform to view some of its components that enable these reflective devices to rotate and lock into their positions of use, to view the target image and the surroundings area from either side or from behind the firearm. Number 47 is a portion of the reflective devices housing that acts much like an inner bearing race. Number 49 is a friction washer that is compressed between the lower surface of the reflective device housing and the top surface of the reflective device's mounting platform or car #39, that rides on tracks #45. Number 48 is one of the dished out or indented areas in this inner bearing type surface, of #47 The shallower dished out cove portion of 47 extends around the periphery and centered between #48 being both of the deeper indented portions of 47 a that the edge portion of a spring-loaded ball, that is housed in a cylindrical chamber inside the platform or car portion of this device (not seen) but is viewable in FIG. 14. Said ball pops in and out of #48 when angular adjustments are being made to the reflective device from one side of the display device mount to the other. Said shallower dished out cove portion of 47 be included in a very easily modified version of all types of track cars included in this application that would both maintain the reflective device inside the rail car during all normal operations thereof, as well as to make same easily removable and interchangeable simply by means of not including #50 in the manufacturing thereof. Number 50, is a flange that mechanically fastens to the lower surface portion of #47, or designed as fastenable to #44 by means of mechanical fasteners, or as a threaded portion of 44 or other at the time of assemblage would be an alternative mode of making the reflective device as non removable from said track cars.

Figure 14:
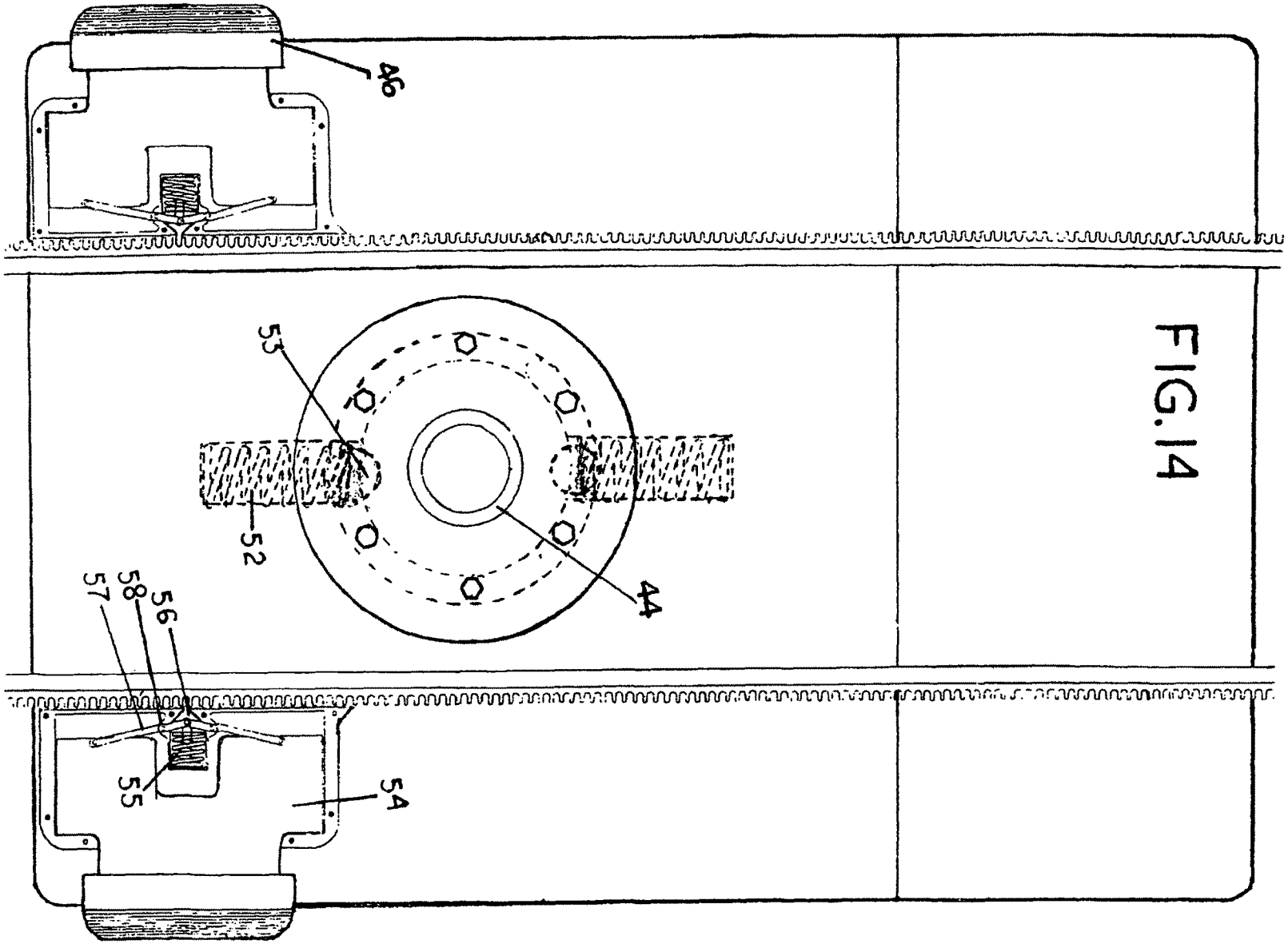
FIG. 14 is a drawing the bottom side of the first embodiment of a track car FIG. 15-A and FIG. 15-B Are drawings of a track car latch.

FIG. 14 is a drawing of the bottom side of platform or car #39, as well as the spring-loaded balls #53, housed in their cylindrical chambers and springs #52, that pop in and out of the dished-out areas[R1] in the facia portion of bearing surface #47 as seen in FIG. 13. Number 44 is a cylindrical extended portion of #47, that extends downward from #47, that the lens of the smart device is centered in, after proper height and lateral adjustments are made to the smart device, to bring the camera lens of the display device to the same height off the mounting rail, as the center of the target viewing device it is working in conjunction with, as well as the camera lens perfectly centered in the slot cut-out located between the two tracks #45, which in turn perfectly aligns the camera lens with the target reticle, of the sight it is to receive its target image from. From this point, height adjustment of the reflective device and the platform or car its mounted on, is accomplished by simply turning the smart device or digital display device with a camera on, with the invention rotated to the side of the firearm and popped into one of its positions to view targets from the side of the firearm. Then by simply raising the reflective device and its platform, on its tracks #45, to a position where the target reticle of the smart device appears perfectly centered in the smart device's screen, when at that position the buttons #46, of the reflective device's mounting platform or car are released, and thus locking the reflective device into its perfect adjustment.

Then, by raising the stop, seen in FIGS. 1, 2, and 3, as well as in FIG. 16-A through FIG. 16-E on track #45, to a point where it comes into contact with the reflective device's platform or car, and locking it onto the track, into its perfectly adjusted position, as well as returning to same every time the reflective device is taken out of and returned to service. The smart device also returns back into its original perfectly adjusted position after removal and re-installation every time, in that the removal and re-installation of the smart device is accomplished by means of the loosening and the re-securing of the smart device into its cradle and tightly securing same onto its mounting platform, by means of the loosening and tightening of knobs #12 and #11, as seen in FIG. 1 which does not change the vertical or horizontal adjustment of the display device in any way while doing so, which is explained in the applicant's first patent application for devices of this nature. The latching mechanisms, #54-#55-#56-#57 and #58 which are activated by compression of buttons #46, will be described in detail in FIGS. 15 A and 15 B.

FIG. 15 A is a drawing of the latching mechanism located on the lower side of the outer perimeter of the reflective device's mounting platform or car, where this latch is an integral part thereof. All illustrations show this platform or car #39, as having two of these latches, but this invention may only possess one of these latches, when this device actually goes into production. Number 46 is a button that is an integral part of #54, being a plate that slides freely inside the latch housing and abuts the upper portion of this latch housing, when this latch is engaged.

This inner plate #54, working in conjunction with spring #55, maintains pressure to the pin portion of a small piston shaped slide, housed in its own housing. Small armatures #57, connect each side of the lower portion of this sliding plate to this small piston shaped latch pin #56. These armatures also pivot at a point #58 between their point of connection to the sliding plates and their point of connection to the small piston shaped latch pin #56, so that when this button #46, is pressed, this spring is compressed by means of leverage, which releases the latch pin out of its notch, located in the outer edges of the rails #45, allowing the mirror mounting platform or car to slide up and down these tracks freely. This car or platform #39, locking back solidly on to these tracks once these buttons or button is released.

FIG. 15 B is a drawing of the dust cover for these latch housings that is mechanically fastened and sealed to the outer perimeter of the latch housing and is used both to access the inner components of these latches for the purpose of assemblage and maintenance.

FIG. 16 A is a drawing of an embodiment of a track stop, that maintains the reflective device platform or car at its perfect adjusted position of height on its tracks, when returning this reflective device back from its position of non-use, to its position of use. This track stop consists of a latch housing #85, that houses a combination latch leaver, latch pin and spring housing #84, which houses a spring in a cylindrical shaped housing or compartment therein. This spring is connected at both ends thereof, with one end of this spring connected to a pin portion of the inner spring housing, and with the other end of this spring connected to a lower inner portion of the latch housing, so that when the latch lever #87, is pushed, the portion of this latch that locks into the notches in the outer edge of the track is removed, allowing this rail stop to slide freely on the track as seen in FIG. 16 B. Then, when this latch lever is once again released, the latch portion solidly locks back into the outer edge of the track, where it is maintained by means of the spring tension of spring #86.

FIG. 16 C is an overhead view of the latch of FIGS. 16 A and B. This type of latch could also very easily be incorporated into the bottom outer portion of the reflective device platform or car, as a simpler alternative type of latch to the latch of FIGS. 15 A and B.

FIGS. 16 D and E are drawings of a much simpler track stop simply consisting of a track slide that is mechanically fastened to the track by means of a set screw, that compressably secures this track stop to the rail, by means of friction which would serve its purpose and simply be much less expensive and easy to produce.

Figure 23:
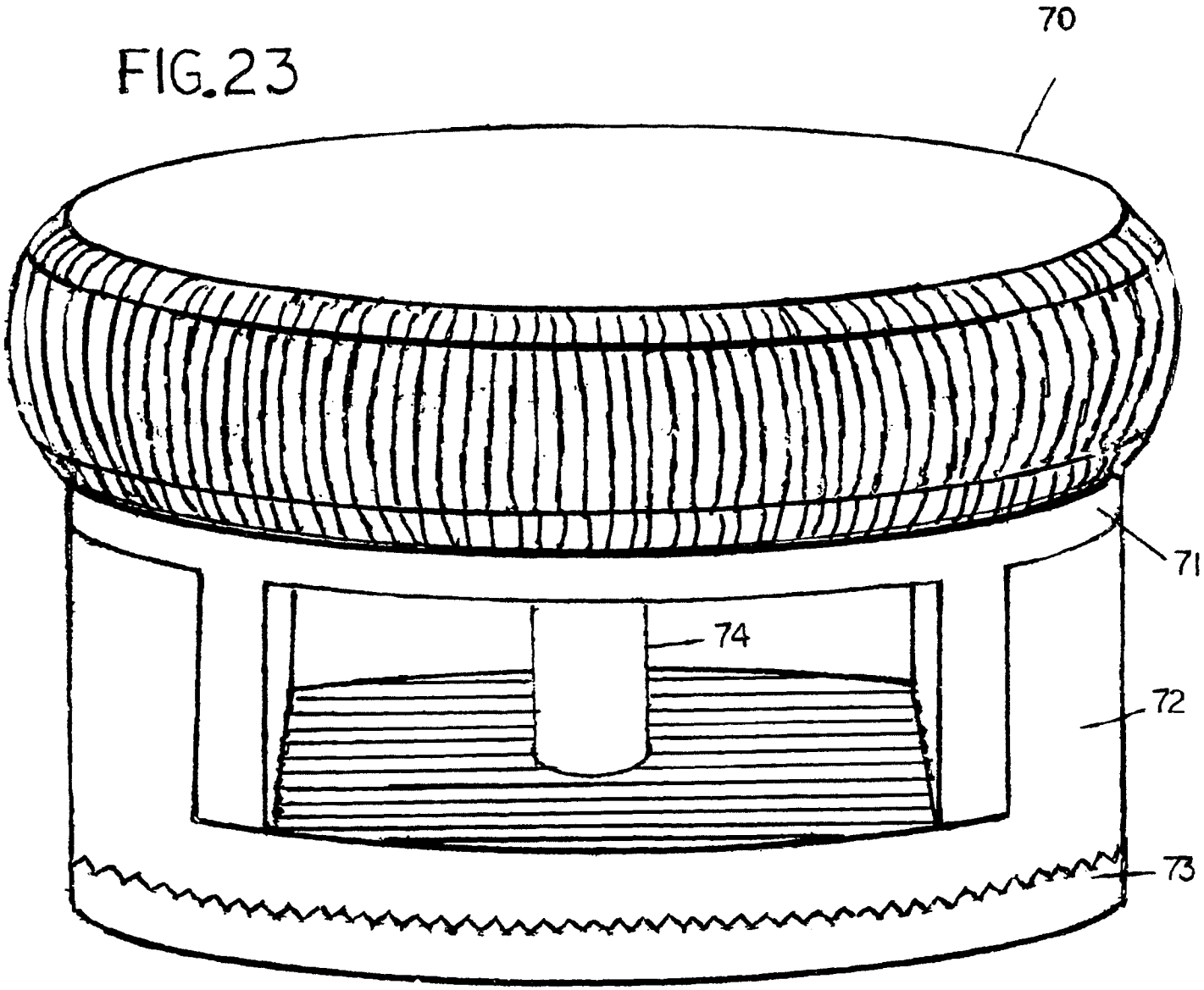

FIG. 17 A through FIG. 23 include drawings for a rear viewing camera, and height and angularly adjustable armature and mount, devised to optionally provide the user of this display mount as well as other tactical display mounts of the applicant's with a visual of the area behind the user at all times as well when employing the display mount.

FIG. 17 A is a drawing of the back side of a combination rear viewing camera, #78, and housing, #77, that houses the viewing screen, and camera, and battery that powers this tiny self-contained unit.

FIG. 17 B is a drawing of the front side of the combination rear viewing camera #78, and housing #77, that houses the viewing screen, #79, and camera, #78, and battery that powers this tiny self-contained unit. Controls #80, are for functions such as on-off switch, zoom, or brightness control, etc. This rear viewing camera is mounted to and angularly and height adjusted on armature #62.

FIG. 17 C is a side view of the rear combination rear viewing camera, and its housing that houses the viewing screen, and camera #78, and battery that powers this tiny self-contained unit. The armature #62, is what this tiny self-contained unit mounts to and angle adjusts on.

FIG. 17 D is a slightly angled inward side view drawing of the rear viewing camera armature, with the tiny self-contained rear viewing camera unit removed from the armature #62. The threaded end of rod, which is an integral part of knob #75, is inserted through a hole centered in the end portion of the armature #62, and is then threaded into base #82.

An integral part of the camera and battery housing #77, as with this threaded rod loosened, the self-contained camera viewing screen can be rotated into its desired angle of use and then re-secured by means of rotation of the knob #75, so that the threaded portion of the rod that is an integral end portion of knob, #75, is threaded into its base #82. The raised ridges or teeth located on the upper platform of the base #82, are locked into their corresponding lower grooves or notches between the raised teeth or ridges located on the lower platform surface, #81, of the end portion of the armature #62. Knob #75, is rotatably tightened, securing this self-contained unit into its desired angle of use.

FIGS. 18 A and 18 B are drawings of another type of rear camera applicable to these rear viewing cameras. These cameras transmit their video signals by means of a direct wire connection, in the same basic mode as cameras employed in devices such as bore scopes or endoscopes as well as a couple types of spy cameras as well as other cameras that transfer the image either by being hard wired or by connecting the camera to the smart phone smart device or monitor or display device that it is working in conjunction with by cable and connections being made usually via a micro USB connector or an iPhone type connector. These cameras are presently available in very high-resolution models of 1080 pixels and greater and are available with infrared viewing capabilities as well.

FIG. 18 A is a backside view of the armature #62, that this camera is height and angle adjusted on. Number 101 is the camera housing being integral and part of armature #62.

Number 102 is the camera lens. Number 103 is the cable that plugs into the same port, as is used by the charging port of the smart device or digital display device its working in conjunction with. Number 104 is the plug that plugs into the charging port.

FIG. 18 B is a slightly angled view of this cable connected rear viewing camera and armature.

The differences between these cameras and the cameras used in the other rear viewing cameras with Wi-Fi transmitting modules is basically in their mode of image transfer and the components employed by these cameras allowing them to transmit or transfer the image, both of which have certain advantages and disadvantages to each other, such as the ability to enhance or enlarge images that are transmitted or transferred to the device that the image is being viewed on and whether this function is achieved by the type of camera that is being employed, or by the device it is being viewed on, as well as other considering factors such as these being used in military application. The better choice could be the type of camera that transmits its image by wire or by means of fiber-optics and a tiny fiber-optics cable that resolves all security and venerability issues.

Figure 19:
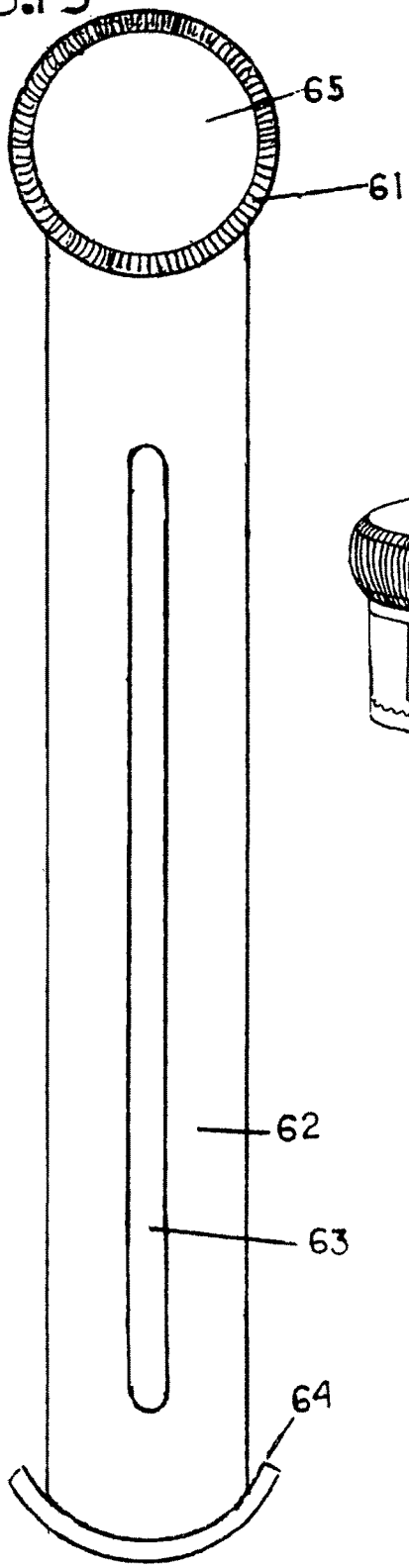
FIG. 19 and FIG. 20 are drawings of a rear viewing cameras and armatures with their own power supply, and provide images to the display device by means of direct wire, wireless, or fiber-optics cable, depending on the type of transmitter the device is equipped with FIGS. 21-22 and 23 are drawings of a armature mount.

FIG. 19 is an illustration of the rear view of the rear viewing camera and camera housing #61, as well as armature #62, which would be an integral part of this rear viewing camera housing with the power supply and the camera housed therein. This camera could be one of several types of cameras widely available on the market, such as those manufactured as very high-resolution spy cameras, with both infrared viewing abilities and their own wireless transmitting module, that transmit its image to the with wireless image receiving and displaying abilities or by means of the employment of a smart device, where the image of which would become viewable in its own window in the display devices viewing screen.

Figure 20:
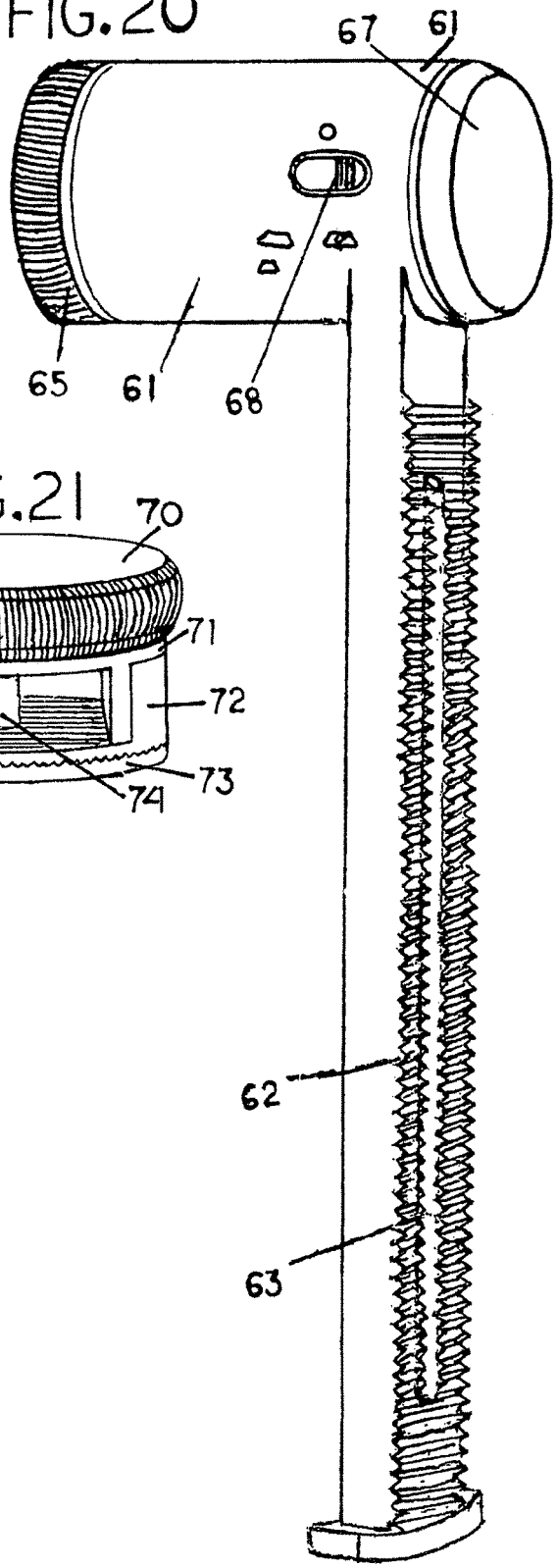

FIG. 20 is an illustration of the slightly off-skew profile view of the rear viewing camera and camera housing #61, as well as armature #62, that would be an integral part of each other of the camera housed therein or optionally made as a removable and angularly adjustable as those included in FIGS. 17-A,B,C, and D the camera would also be of a type of camera with infrared viewing capabilities and its own wireless transmitting module that transmits its image to the display device that it is working in conjunction with by wireless transmission. This camera housed inside this camera housing #61, receives its surveilled image through window #67, located in the very forward portion of camera housing #61 of which wound additionally comprise at least one infrared illuminator. The camera housing #61, additionally comprising a battery compartment that houses batteries supplying power both to camera and wireless transmitter is housed in the camera housing #61. A watertight lid #65, to battery compartment, creates access to power supply housed therein. At least one charging port #69, and indicator light is supplied to recharge batteries. A switch and indicator light #68, is supplied to turn on camera and wireless transmitting module therein. This device as well as the other embodiment's of employable rear viewing cameras are also widely available with infrared viewing capabilities and are additionally equipped with an infrared illuminators, which in turn provides them with night viewing capabilities.

Figure 21:
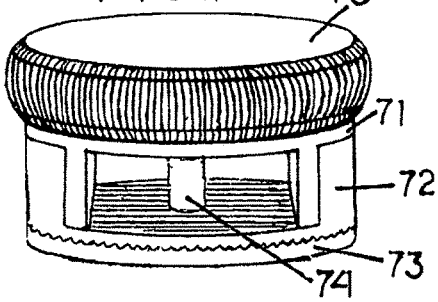

FIG. 21 is an illustration of the mounting clamp for the rear viewing camera armature #62, which is height and angle adjustable therein. Threaded rod #74, inserts through slot #63, in armature #62, and is threaded into and tightly secured into its base portion of the back side of the display device mounting platform itself #10, seen in FIGS. 1, 14, and 15. A larger view of this armature clamp and a more detailed description is provided in FIGS. 22 and 23.

Figure 22:
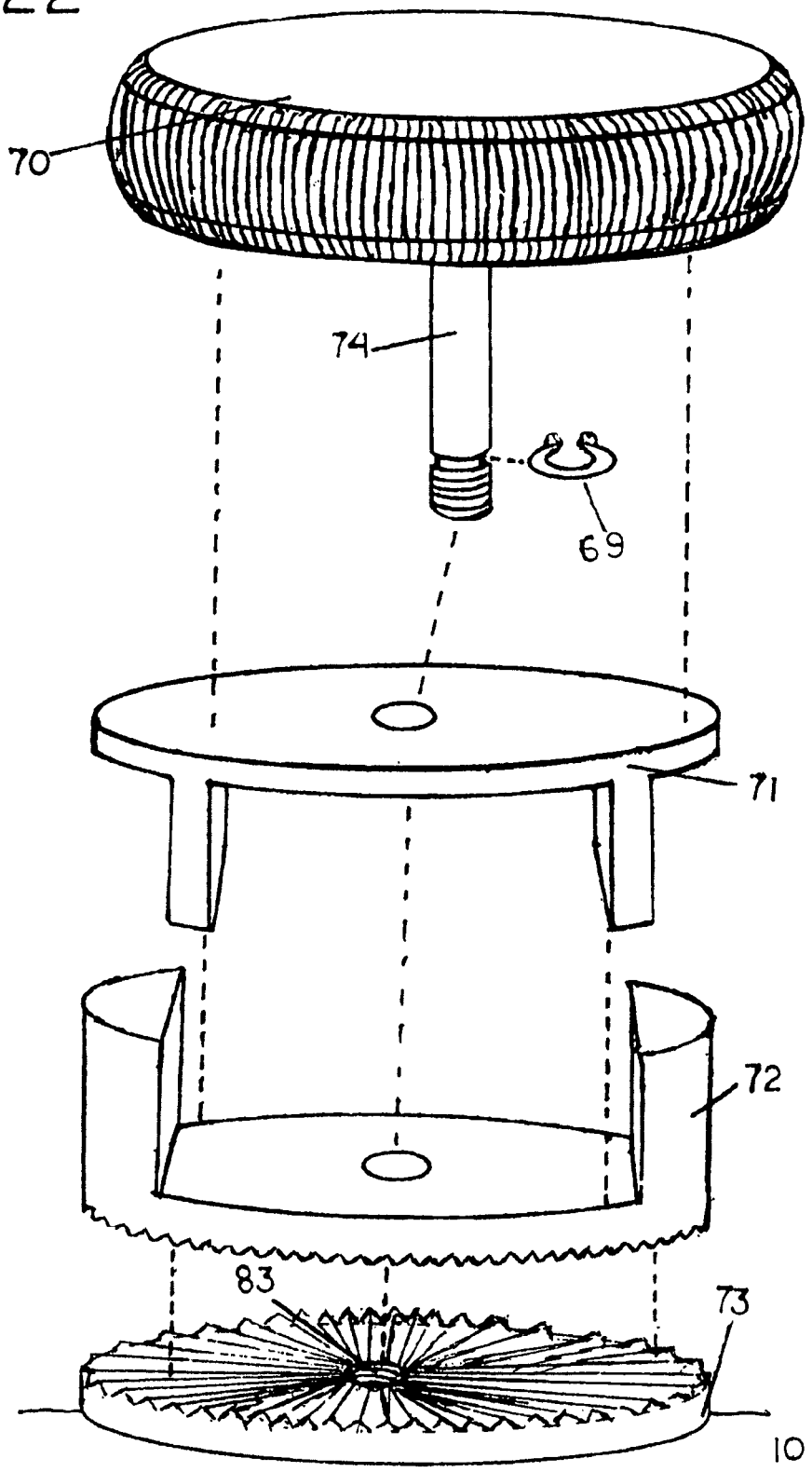

FIG. 22 is showing a blown-up view of rear viewing position adjustable camera mount previously seen in assembled form in FIG. 21 and FIG. 23. Threaded rod #74, includes a smooth upper section that turns freely. Rod #74, is then inserted through hole in the center of the upper section of the platform of jaw or clamp #71, then through center cut out or slot of the camera armature #63, as seen in FIG. 21 and then passed through the hole centrally positioned in the rotatably positionable lower section or part of jaw or clamp #72. Then C clip #90 is inserted into the groove located between the smooth part of the upper section of threaded rod #74, and the bottom threaded section of rod #74, locking these parts together.

This C clip is housed in an inset section that extends around the outer perimeter of the bottom of hole located in the center of lower portion of the rotationally positionable jaw #72, not shown. This inset C clip #90, allows the loosening of the mount as the C clip can travel inside inset area while loosening or tightening while maintaining the assemblage of the rotationally adjustable mount to the camera and armature #62, so that this device can be removed from rotationally adjustable tactical surveillance display mount and stored when not in use, then simply attached as a complete unit for deployment.

Then the threaded end of rod #74, an integral part of knob #70, is threaded into base #73, an integral part of rotatably adjustable tactical surveillance display mount so that as knob #70, is rotatably threaded into base #74, allowing the camera armature #62, to be extended and rotated to its desired position of use and as knob #70, is continuously rotated, the raised ridges or teeth located on the upper platform of the base #73, are locked into their corresponding lower grooves or notches between the raised teeth or ridges located on the lower platform surface of the rotatably adjustable lower jaw #72, and tension adjustable knob #70, is rotatably tightened, rear viewing positionable camera armature is compressably secured between upper platform section of lower jaw #72, and lower housed platform section of upper jaw or clamp #71, seen in FIG. #22 for the invention, that armature #62, seen in FIGS. 17 A and B, FIGS. 18 A and B, as well as FIGS. 19 and 20 is housed therein. The camera housing being an integral part of armature #62, can be re-positioned or returned to its position of non-use in the same manner by simply loosening knob, and re-secured in place by tightening knob #70.

FIG. 23 is an illustration of the rear viewing position adjustable camera mount in an embodiment taught herein as if the position adjustable camera and camera armature #62, were removed from position adjustable rear viewing camera mount leaving only the mount for same. This mount for the position adjustable rear viewing camera consists of a base or platform, #73, which is an integral portion of the back side of the mounting base #10. This mounting base is cylindrical in shape with a plurality of teeth or ridges progressively reducing in size towards the center of base which also contains a threaded hole located in the center of the base #73, that match up and thread to threaded end of the shaft #74, which is an integral part of tension adjusting knob #70. This threaded rod would be inserted through a hole located in the center of the upper platform portion of the tensioning jaw or clamp #71, where rod #74, could turn freely therein and would continue through parallel slot or cut out portion of the armature, as seen in FIGS. 17-A,B,C and D as well as FIGS. 18-A and B and FIG. 19 and FIG. 20 this rod is then shown as extend through the hole in the center of the lower clamp or jaw portion #72, where the smooth portion of the threaded rod #74, would also turn freely therein and be tightly threaded into the threaded portion of the mounting base #73, an integral portion of the display device mounting base #10, not shown.

FIGS. 24 through 28 is the non-tactical version of this invention, which is exactly the same as originally devised and has suffered no change or improvements from the original version of same. FIGS. 24 through 28 simply include more complete drawings of same, described in the original applications for the invention, that also included the four earlier tactical versions of this invention, and of which possess all of the exact same components, and acquire their targeting images from the sights and scopes its working in conjunction with in the exact same manner as it always has.

Figure 29:
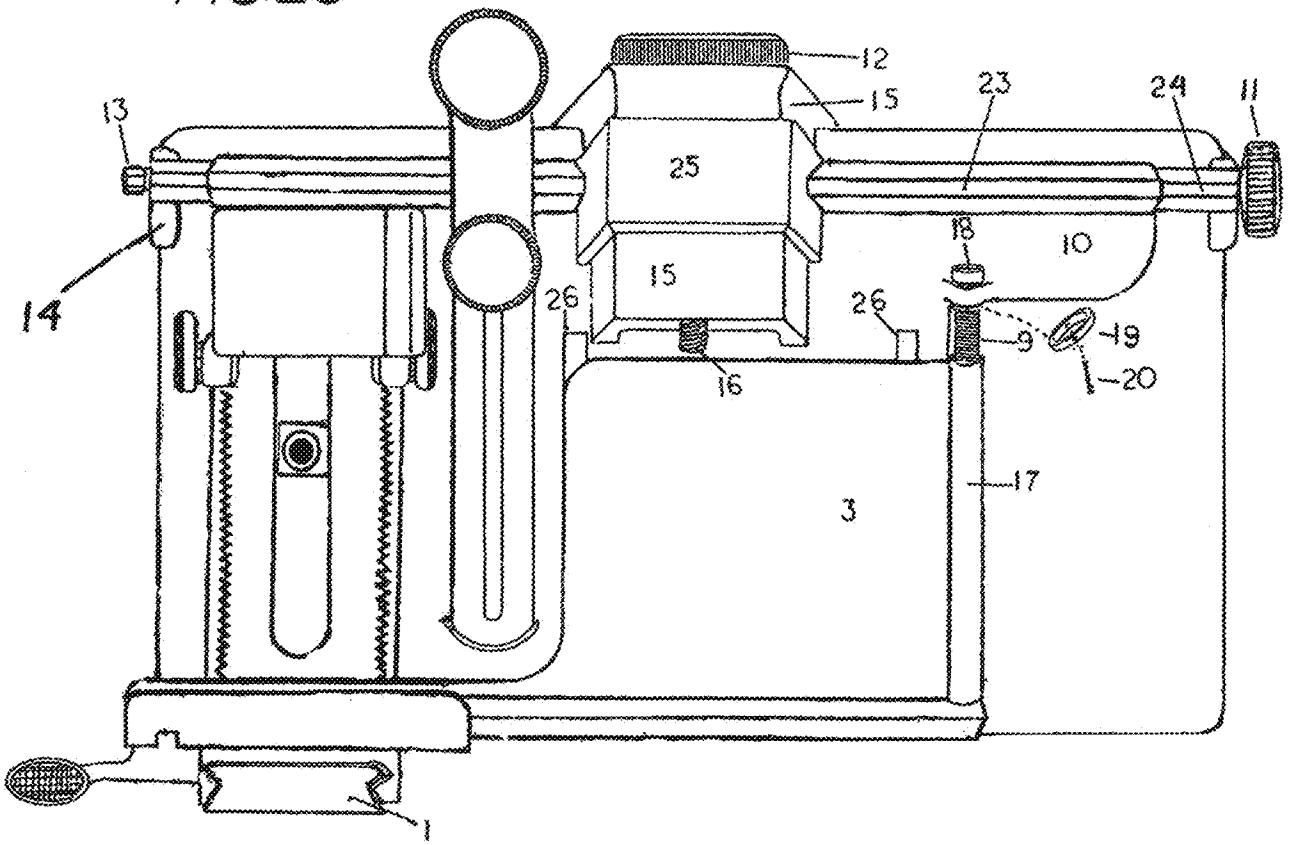
FIG. 29 is a drawing of the forward view of the display device mount equipped with a second design of a rail car and tracks with reflective device in position of non deployment.

All numbering of the individual components included in these drawings are numbered in their original numbered references and in the same in the same manner as the referencing of all unchanged components included in the tactical version of this invention included in FIG. 1. and in FIG. 29.

Figure 24:
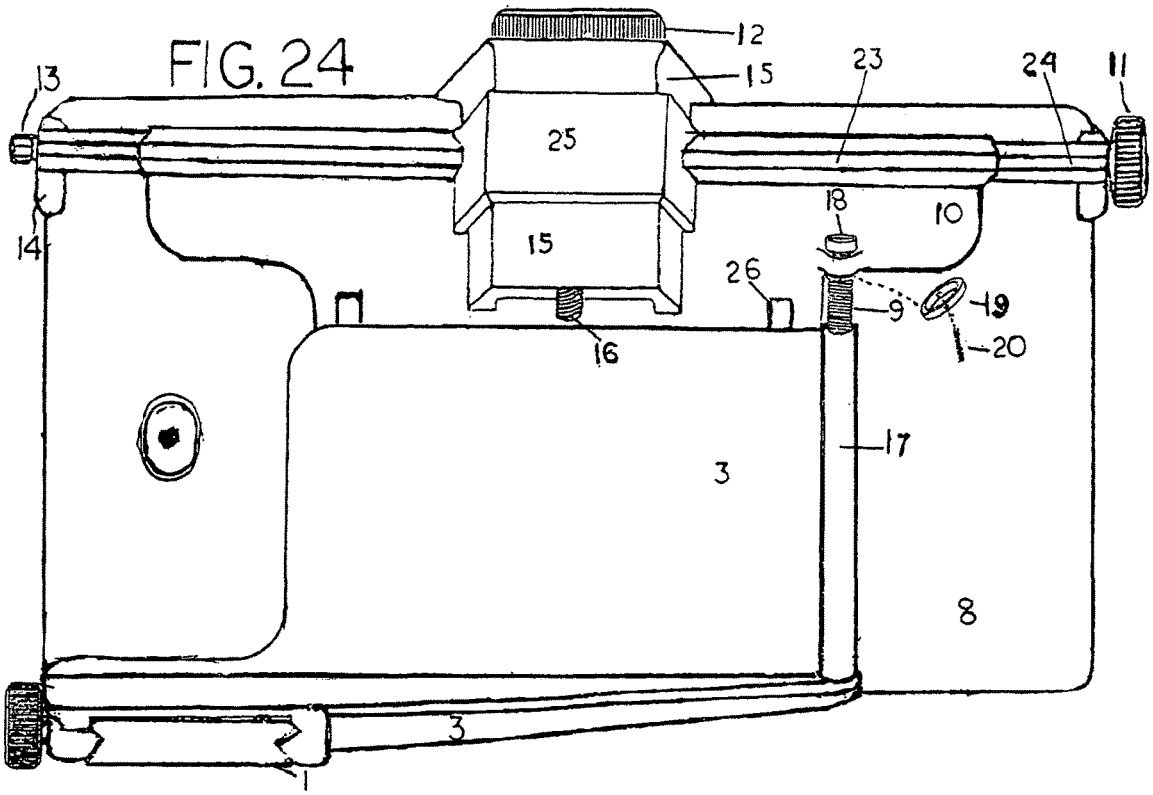
FIG. 24 is a drawing the frontal view of the non-tactical version of the display device mount with all numbered references from original applications for same.

FIG. 24 is a drawing of frontal view of the invention, and much like FIG. 1 including original numbered references of components unchanged from earlier versions of the applicant's tactical display mounts, all numbered references included in FIG. 24 through FIG. 28 are referenced in their original numbed references as well. Differences between this the non-tactical version of this display device mount and all tactical versions thereof comprising the rail mount #2 simply being an integral portion of the plate #3 instead of a bottom base portion of the plate being rotatably coupled to an upper base portion of the rail mount #2 and angularly adjustable thereon. This non-tactical version of this display mount also employees no mirrored device of any kind, however all vertical and horizontal display device mount adjustment and mounting components comprising this the non-tactical version of this invention simply being the same as all other embodiments of the invention, as included in FIG. 1 showing all components that remain unchanged in the tactical versions of this invention.

Figure 25:
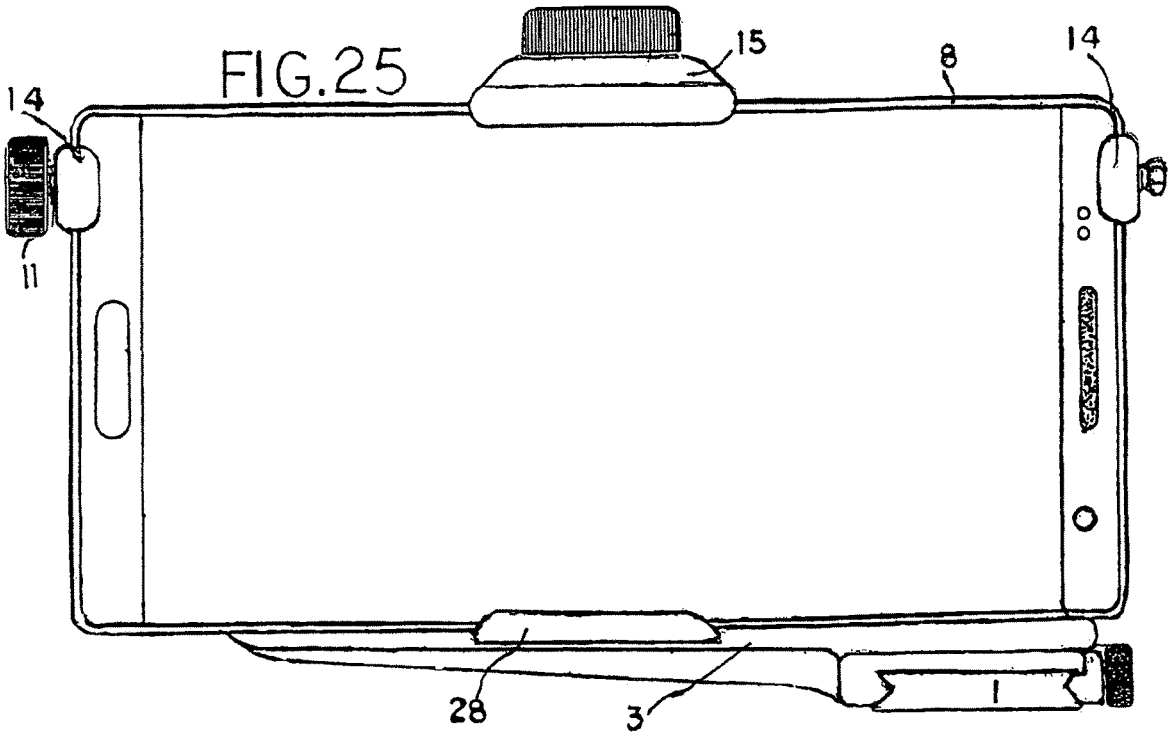
FIG. 25 is a drawing the rear view of the non-tactical version of the display device mount and display with all numbered references from original applications for same.

FIG. 25 is an illustration of a rear view of the invention as if viewing the screen device from a position of use or from behind the firearm.

Figure 26:
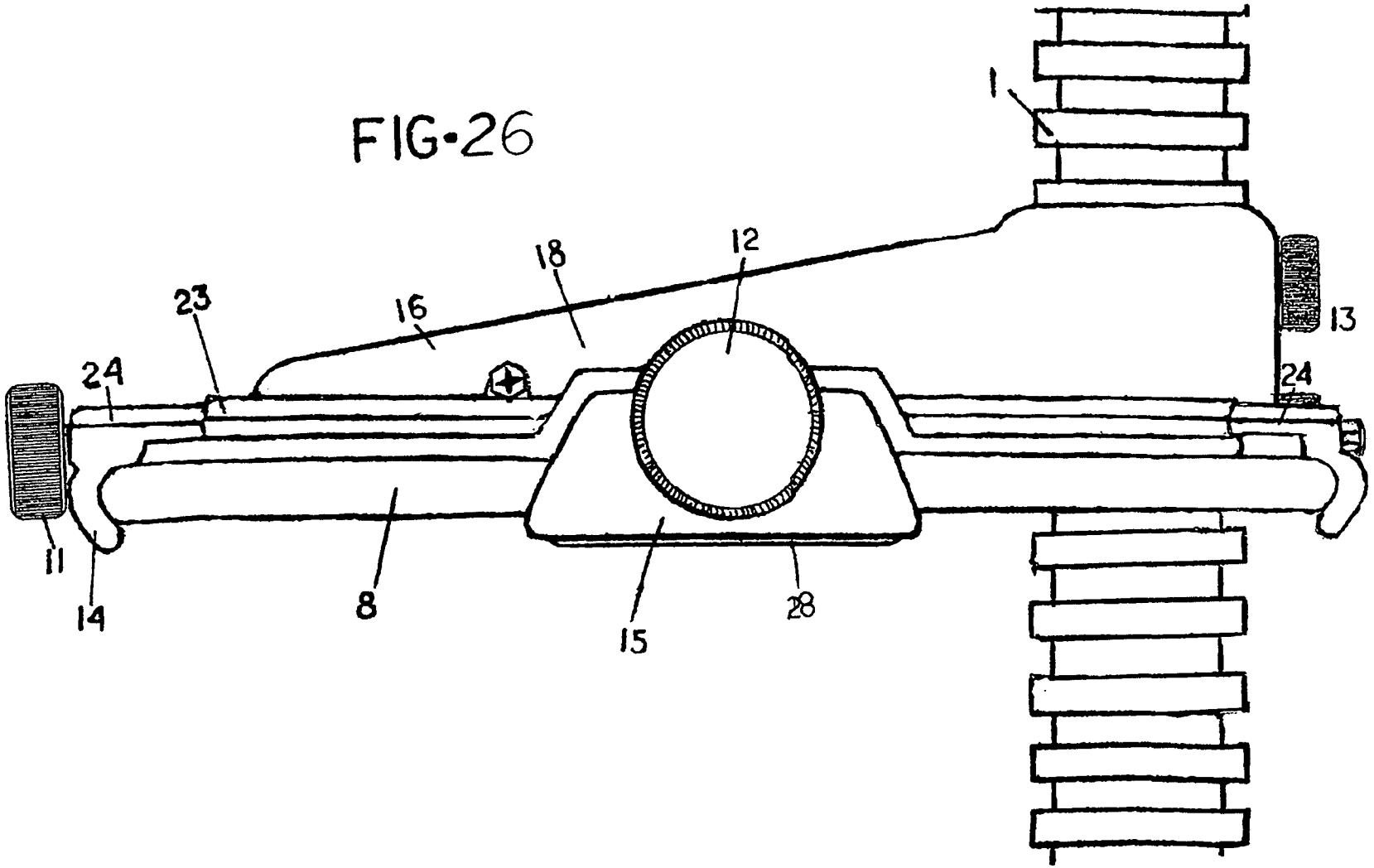
FIG. 26 is a drawing of an over head view of the non-tactical version of the display device mount and display with all numbered references from original applications for same.

FIG. 26 is an illustration of a top of the invention as if viewing the device from a position above the firearm.

Figure 27:
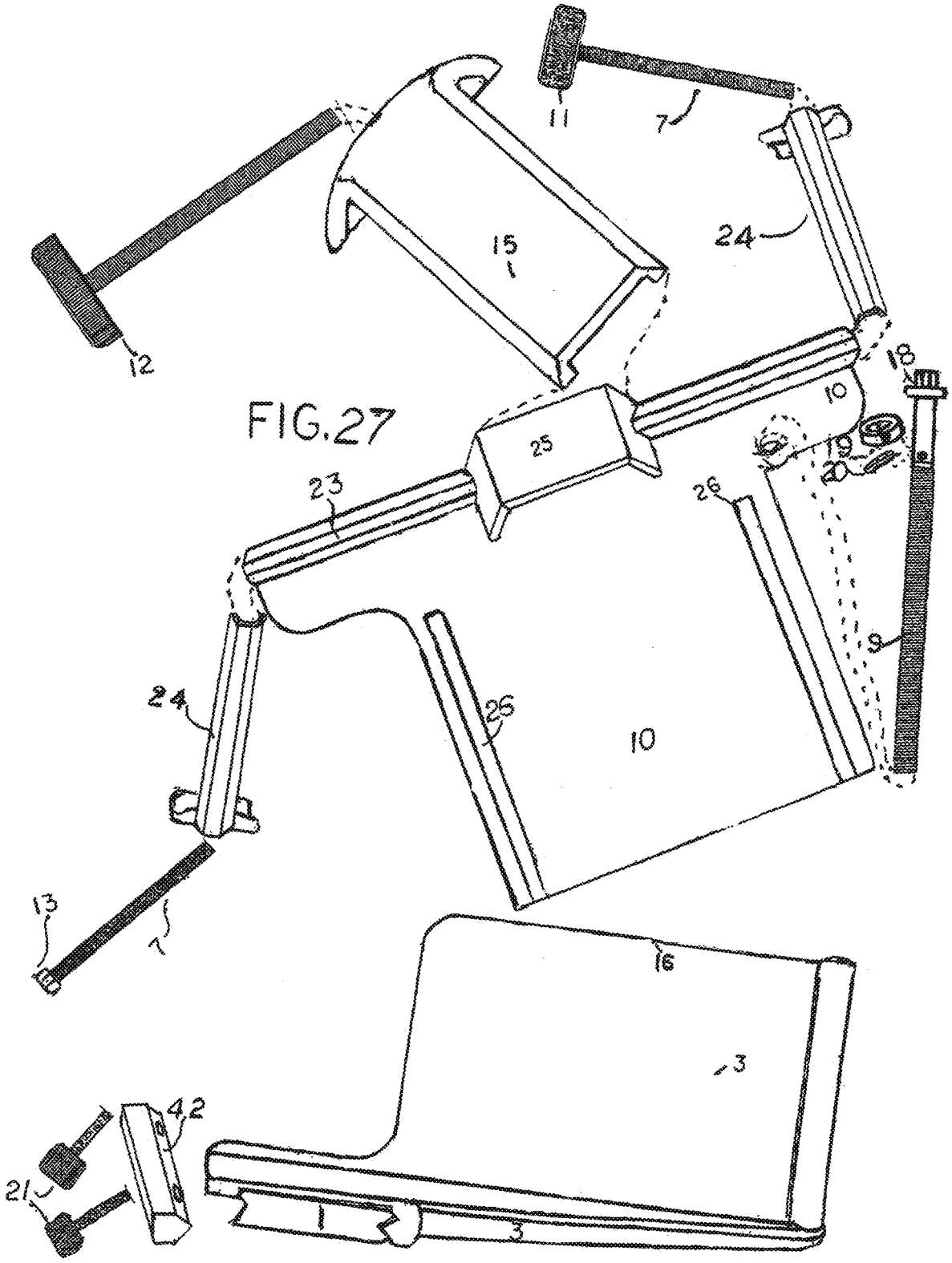
FIG. 27 is a drawing of forward view of the non-tactical version of the display device mount as if dissembled with all numbered references from original applications for same.

FIG. 27 is an illustration of frontal view of the invention as if completely disassembled with all rail mounting, as well as all smart device vertical and horizontal adjustment and display device camera mounting components disabled, simply being the same and operate in the same manner as all other tactical embodiment's of the invention.

Figure 28:
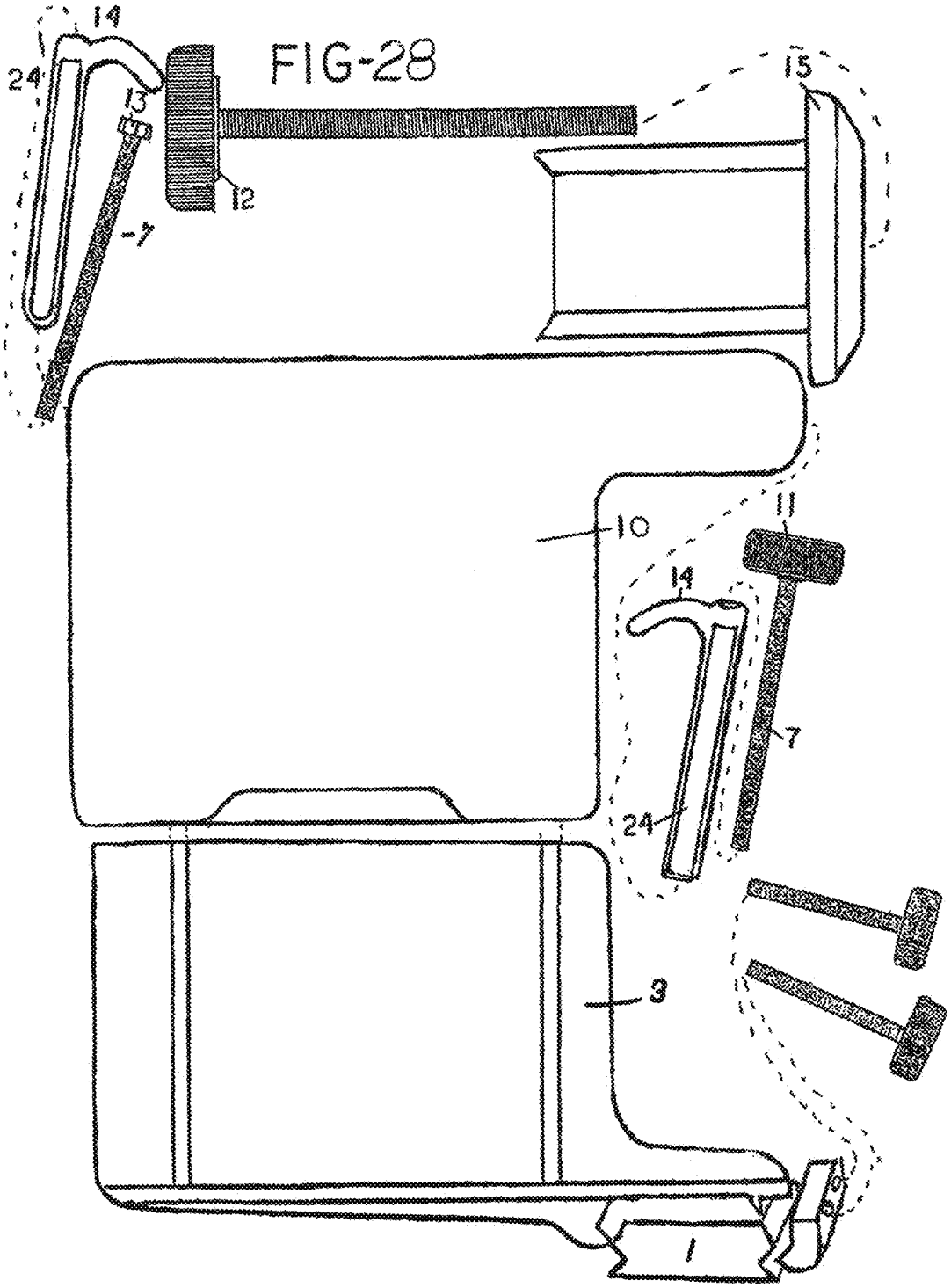
FIG. 28 is a drawing of a rear view of the non-tactical version of the display device mount as if dissembled with all numbered references from original applications for same.

FIG. 28 is an illustration of a rear view of the invention as if completely disassembled, with all rail mounting, as well as all smart device, vertical and horizontal adjustment and display device mounting components disabled, simply being the same and operate in the exact same manner as all other embodiments of the invention.

The accessory included in FIG. 29 through FIG. 36 simply comprises another accessory variation of both the tracks and the combination car and reflective device that ride on said tracks and is vertically adjustable thereon in the same manner as all other tactical variations of this display device mount included in this application. These cars and tracks are simply the latest version of the tracks and car that the rotate ably position-able non-reversing reflective devices ride and are angularly adjustable to each side of the display device mount in. These cars are vertically and angularly adjustable to each side of the display and employ the exact same reflective devices as well as the exact same internal components enabling same, but would be slightly easier to manufacture and possibly more operationally efficient than those included in FIG. 1 through FIG. 22.

Figure 30:
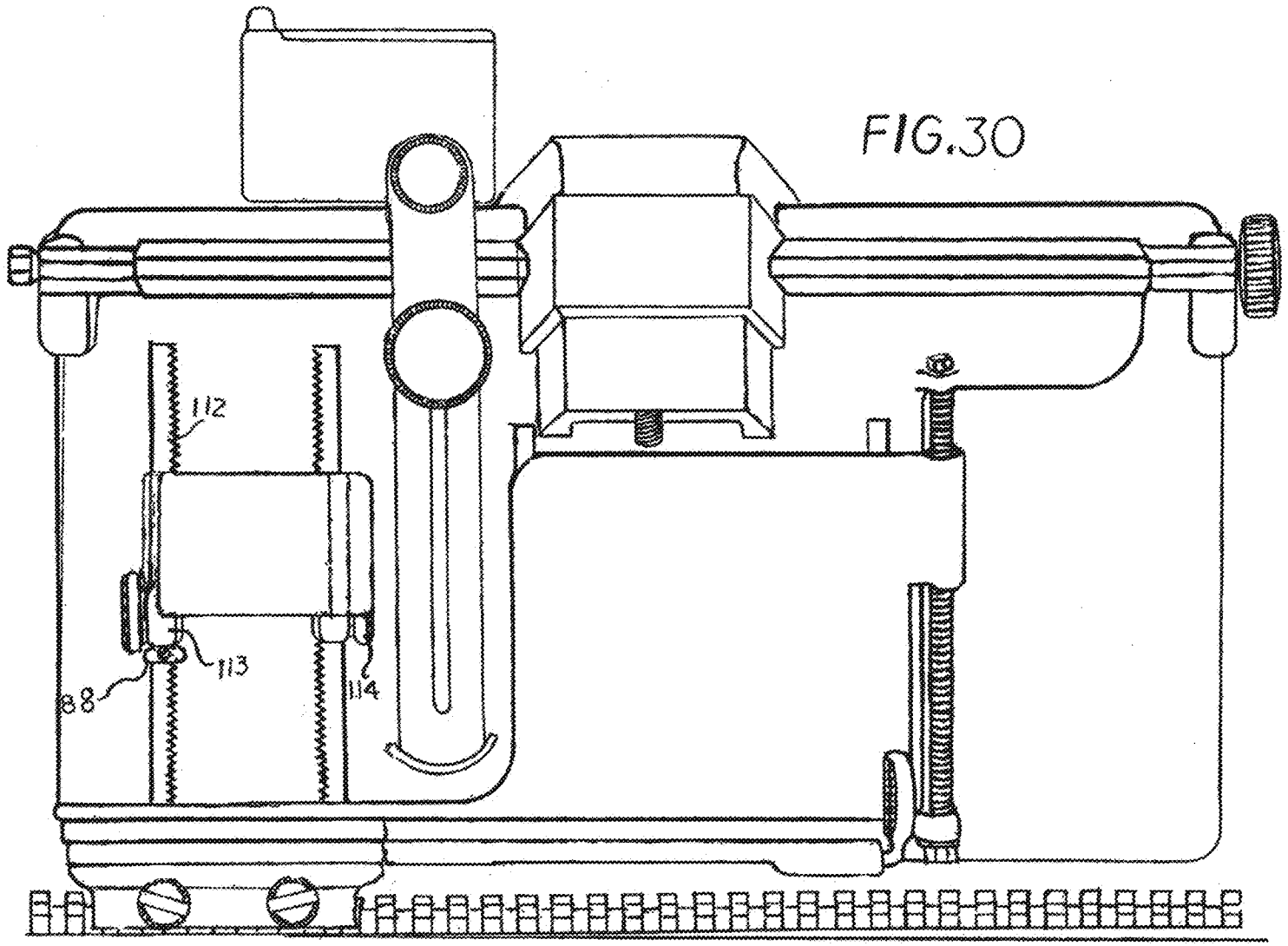
FIG. 30 is a drawing of the forward view of the display device mount rotated to the right side of the firearm equipped with a second design of a rail car and tracks.

FIG. 30 comprises a frontal view of the tactical display mount included in FIG. 1 through FIG. 22 with said latest version of the tracks and car that the rotate ably position-able non-reversing reflective devices ride and are angularly adjustable to each side of the tactical display device, with said track car and reflective device adjusted and latched into a position of unemployment at the top of said tracks, as if the display device mount and display device mounted therein, is being employed to view surveilled and targeting images from behind the firearm, and by means of acquiring said targeting and surveilled images with the camera portion of the display device, also acquired from a position directly behind and in direct linear alignment with the targeting reticle of the sight or scope its acquiring its targeting and surveilled images from.

All numbering of the individual components included in this drawings are referencing components of which have remained unchanged from the applicants original inventions of this nature of which are numbered in their original numbered references in the same manner as the referencing of all unchanged components included in the tactical version of this invention included in FIG. 1, as well FIG. 23 referencing these same components comprising the non tactical version of this display device mount.

FIG. 30 is a drawing of the tactical version of the display mount with track car #113 that rides on tracks #112 that are an integral portion of the back side of the tactical display device mount that the display device is both solidly mounted to, as well as vertically and latterly adjusted on for the positional adjustment of the display devices camera lens both to the perfect centering of the firearms mounting rail like all sights, as well as to the perfect height of the reticle or cross hairs of the target viewing device its receiving its target image from. Tracks #112 being a portion of the back side of the display device mount, which are positionally oriented thereon perfectly and equally spanning over the center of the rail mount portion of the tactical display device mount, so that when properly height adjusted, and solidly locked thereon by means of the latch #119 portion of the track car accessory in perfect lineal alignment with both the smart devices camera lens and the reticle or cross hairs of the target viewing device its receiving its target image from in the same manner as all other tactical display device mounts included in this application employed with a track car accessory, and the display device height adjusted to a particular height to acquire the target image from the sight or scope its mounted behind. Notice #88 being the track stop. This is one of the optional types of track car accessory stops as seen in FIGS. 16-D and E.

This track stop is provided so that once proper height adjustment of any of the track car accessories is made and this track car stop, is locked in place abutting the lower portion of #113-B being the lower track latch portion of #113. Any track car accessory can be removed and replaced with another and simply slid down the track car tracks #112 until it abuts this stop where #114, the compression button portion of the track car accessory track latch is once again released solidly locking the desired accessory into its position of perfect lineal alignment with both the smart devices camera lens and the reticle or cross hairs of the target viewing device its receiving its target image from, in the same manner as all other tactical display mount tracks and track car accessories included in this application, in accordance with the principles of the present embodiment.

Figure 31:
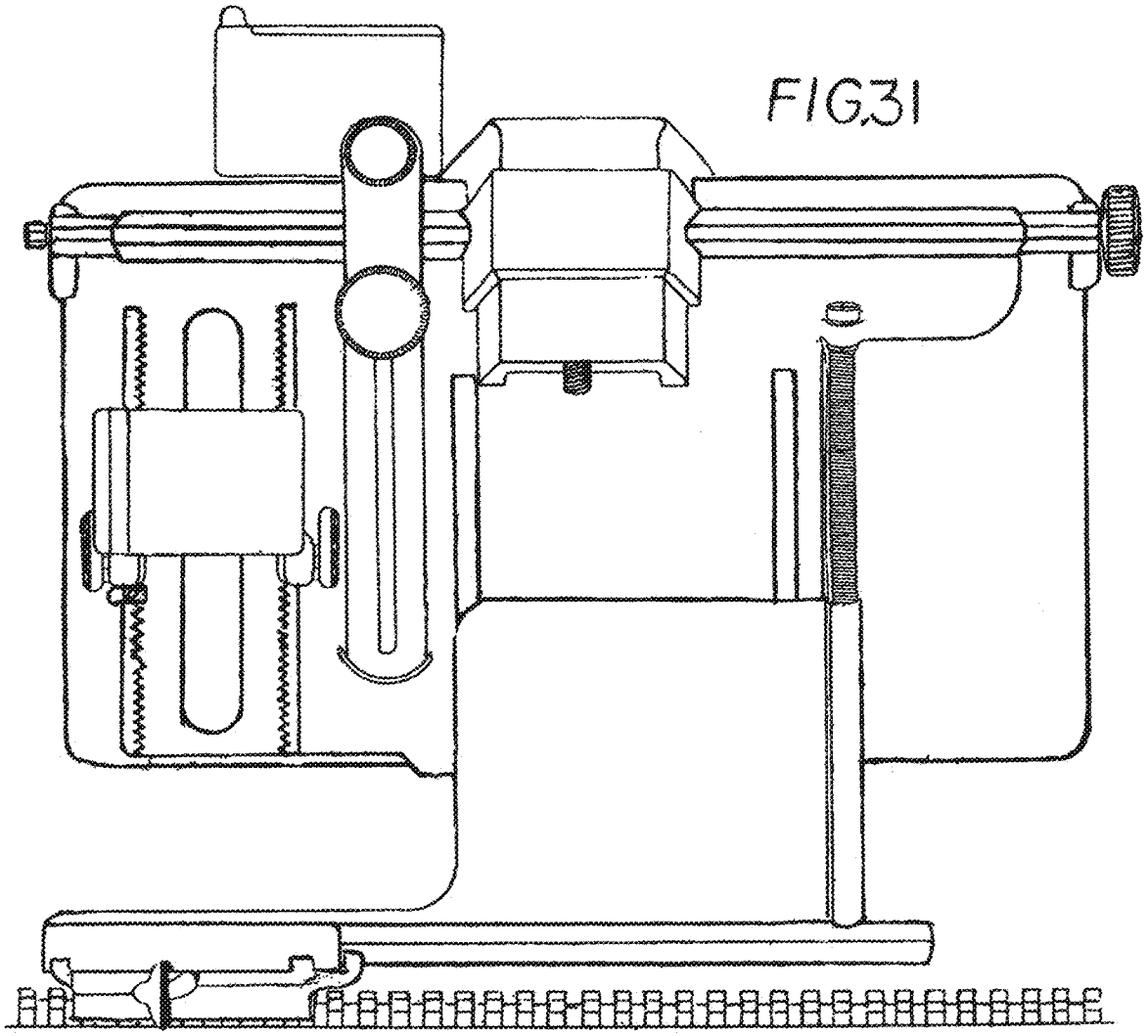
FIG. 31 is a drawing of the forward view of the display device mount rotated to the left side and raised to a position to acquire targeting images from a very high profile scope, mounted on the firearm (not shown) equipped with a second design of a rail car and tracks.

FIG. 31 is a frontal view of a tactical smart device mount with an iPhone or other display device with the lens portion camera thereof positionally oriented on the left back side portion thereof, presently the only type of smart phones with the camera lens positionally oriented in this manner. This drawing simply showing the unrestricted employment thereof. This device is devised and engineered in a manner to employ broad range and sizes of various types of smart devices, the more conventional dedicated digital displays employable by our armed forces, as well as to be mounted behind and adjustable to heights adequate to acquire targeting and surveilled images from the highest profile scopes mounted on the firearm as well, in accordance with the principles of the present embodiment.

Figure 32:
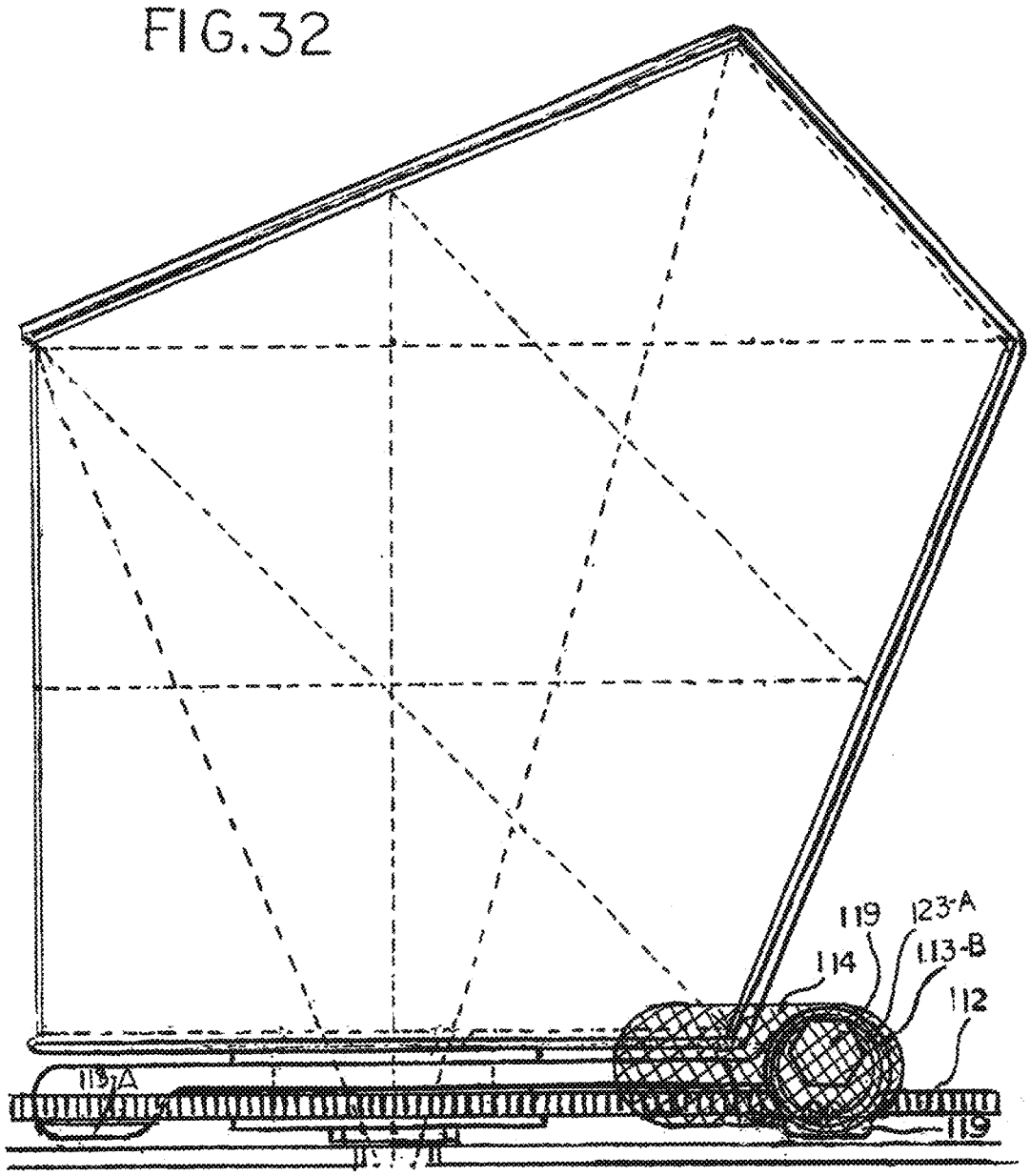
FIG. 32 is a drawing, a profile view of a non reversing reflective device of FIG. 11-A and rail car of FIG. 29-through FIG. 36 as if transparent to view inner components thereof.

FIG. 32 is a profile view of the track car accessory, as complete with the non-reversing reflective device of FIG. 11-A, installed therein the track car accessory and mounted on tracks 112. This drawing is drawn as if all outer housing portions thereof were transparent, enabling the inner positional orientation of components and their relationship with each other. This track car accessory employs the exact same non-reversing reflective devices, and employs same in the exact same manner as all aforementioned track cars included in this application. Underneath the latch button #114 the outer edge portion of the latch housing portion of #113-B can be viewed along with the C-clip #123-A that retains the spring and other internal latch components inside said latch housing portion of #113-B.

Both the portion of the sliding latch #119 that inserts into and is mechanically fasted into an aft inside portion of the latch button #114 as well as a very small portion of the bottom of the latching portion of #119 that comprises teeth (not shown) that interlock with the teeth located on the inner facia portion of track #112, in accordance with the principles of the present embodiment.

Figure 33:
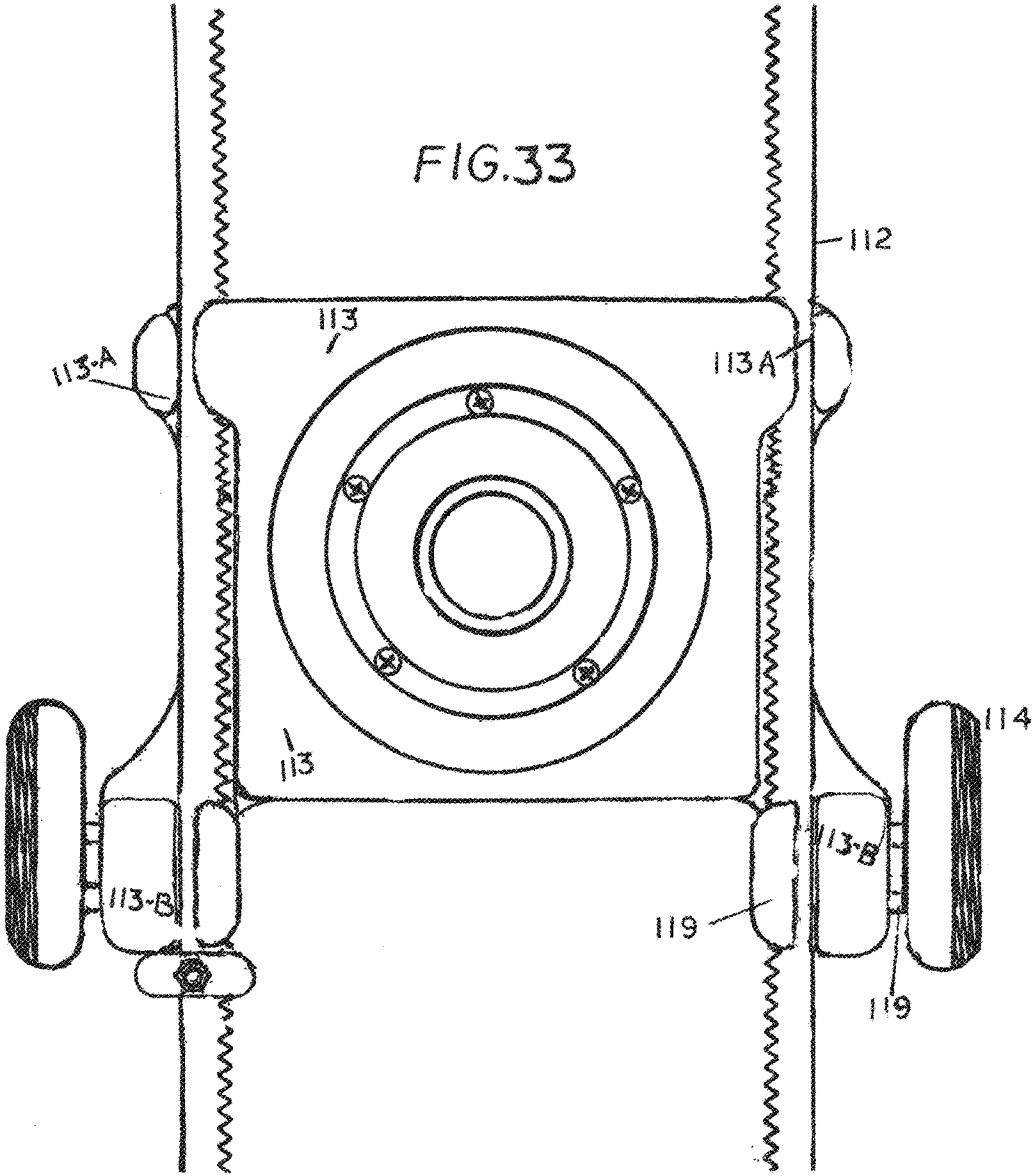
FIG. 33 is a drawing of the bottom of the second design of the track car and tracks seen in FIG. 29 through FIG. 36.

FIG. 33. is a view of the bottom portion of #113 being the track car accessory, so that all of the lower operational portions thereof can be viewed. #113-A is actually just a portion of #113 that serves a very important service in that its shaped or configured in a manner that provides both a very solid mounting of the upper portion the track car #113 as well as a very fast and easy mounting and removal of same to track #112. These track car accessory tracks are actually a portion of the back side of the smart device mount itself. Notice the outer entry portions of #113-A create a very fair lead to the center portions thereof that encompasses the upper portion of #112 the track car accessory tracks at very close tolerances.

The mounting process of these track car accessories would achieved in a very fast and easy manner simply by means of compressing the two compression button portions #114 of the track car accessory, track latch #119 that extends just beyond its normal opening point which intern opens the inner notched or toothed portion of #119 beyond the inner toothed or notched facia portion of #112 the optical accessory tracks, so that the installment or removal thereof is simply achieved by means of sliding the track car accessory to the very top of the upper portion of #112, the track car accessory tracks and just past the open portion thereof the compression of latch buttons #114, at the same time the accessory is grasped for the means of installment of same.

Then simply by means of placing the accessory at the very upper portion of the car accessory tracks #112 while placing the lower latch portion thereof over the outer portion of the tracks #112 while #113-A the upper bottom portion of 113 is still above the end or open upper portions of 112 the optical accessory tracks so that installment of same is accomplished by means of sliding the accessory down the tracks and centering same over the camera lens of the smart device, or until the bottom portion of #113-B lower track latch portion of #113, comprising a housing, housing a spring and other latch activating components (not shown) abuts #88 the optical accessory car track stop if preset. Then simply by means of the release of the compressible pressure to #114 the compression of both compression button portions of the track car accessory.

The track car accessory is then solidly locked back into place. The removal of same would be accomplished simply by means of a reversal of this process and the temporary commissioning of same is simply accomplished by means of the compression of both compression button portions #114 of the accessory that deactivates the track latch #119 and re-positioning the accessory out of the camera in the display device's line of view, then releasing button portions #114 leaving the accessory simply mounted out of the way until which time the accessory is once again needed. Then once again compressing the button portions of #114 that deactivates the track latches and the accessory can simply be either slid down the tracks until the bottom portion of #113-B the lower track latch portion of #113 abuts #88 the optical accessory car track stop if preset. Or simply directly over the display device's camera lens if not, in that the correct positioning of the accessory can be easily accomplished by viewing same in the screen if the display device during the initial set up.

Figure 34:
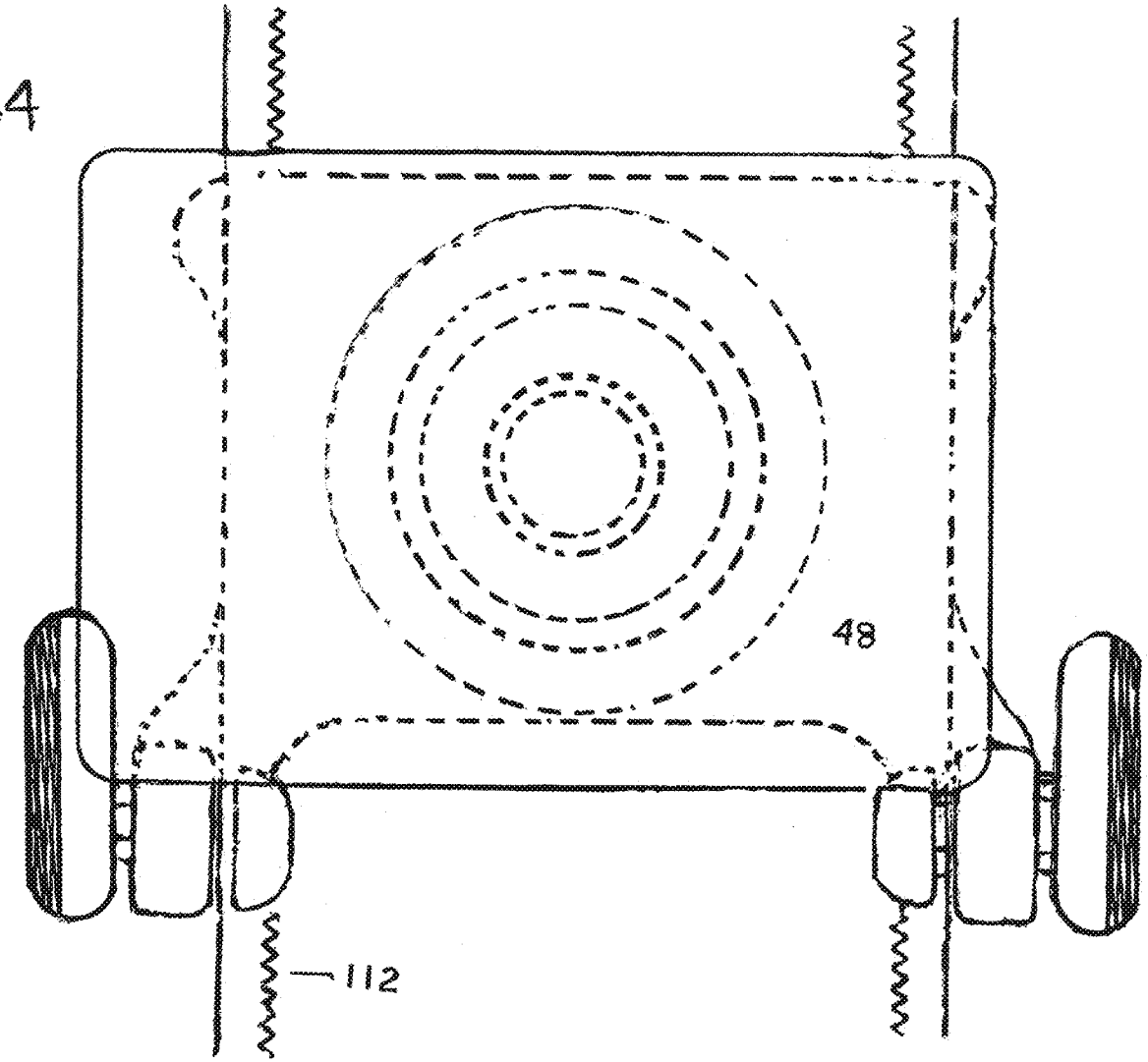
FIG. 34 is a drawing of the top view of the second design of the track car and tracks seen in FIG. 29 through FIG. 36

FIG. 34 is an overhead view of #113 being the track car accessory fully equipped with an 180 degree angularly adjustable non-reversing reflective device, and drawn as if the housing thereof was transparent as to see the outline of other components thereof and their positional relationship with this newly designed track car as it would be viewable from overhead mounted and locked into a desired position on #112, the track car accessory tracks. Other numbered references are included simply to reference positional orientation of components in relation to said nor-reversing mirrored device #48, in accordance with the principles of the present embodiment.

Figure 35:
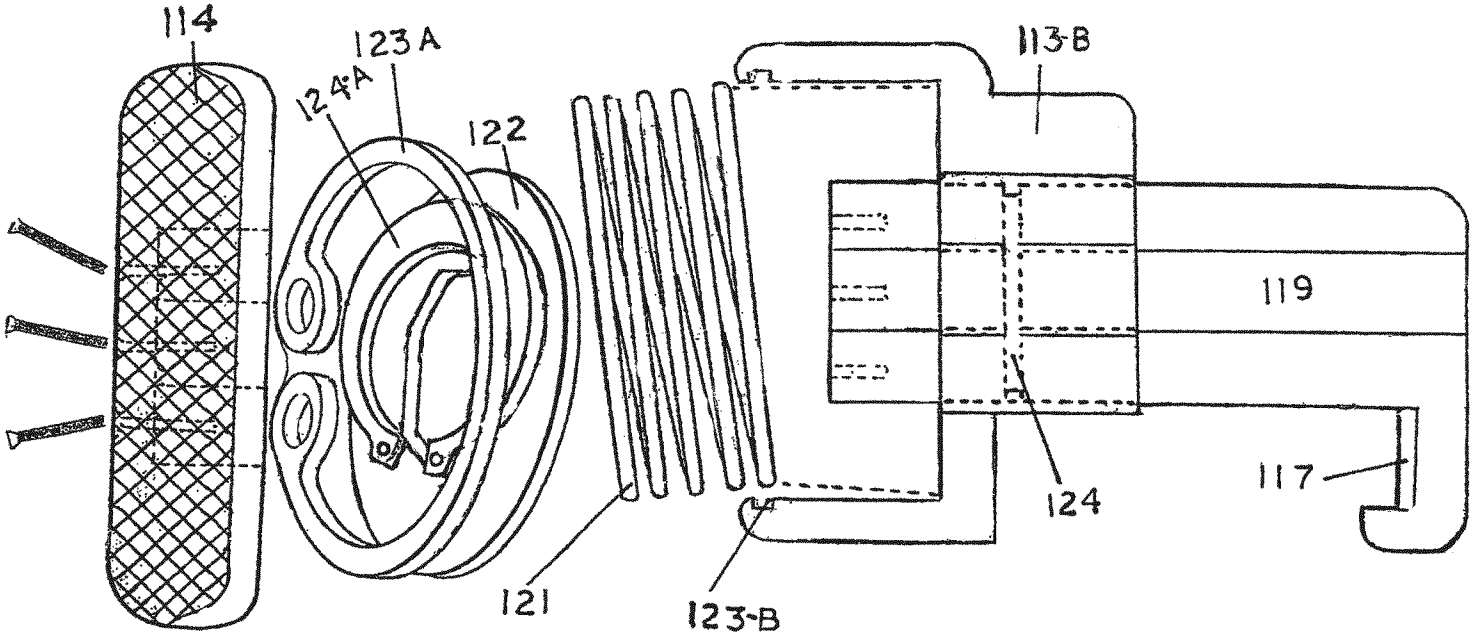
FIG. 35 is a drawing of one of the latch assemblies dissembled of the second design of the track car and tracks seen in FIG. 29 through FIG. 36.

FIG. 35 is a profile view of the bottom portion of #113 being #113-B which is one of the two track latch portions of #113 that protrudes beyond the main body of #113 and is drawn as if the rest of #113 was removed for the easy viewing thereof and is also drawn as if this portion of the device had been fully disassembled, so the inner components and workings thereof, can be fully viewed. In this drawing only the portion of #113-B are shown that houses #119. The sliding latch portion and #121 the compression spring, #122 is the compression spring washer, #123-A is a standard C-clip or Cir-clip, #124-A being a standard E-clip, and #114 being the spring compression button.

The assemblage of which is as follows. First #119 the sliding latch portion of this latch is inserted into the latch housing portion of #113-B, from in between the two latch portions of #113-B with the non-latching portion actually entering into the latch housing portion of #113-B, and with the latching portion thereof remaining inboard and angled downward. The outer shape thereof as well as the inner shape of this portion of #113-B of a shape that would not allow the rotation thereof this drawing shows these components as being octagonal in shape although this being only one of numerous options. Once #119 the sliding latch portion of this latch is inserted all of the way into the housing of #113-B the rest of the assemblage thereof can be affected first by means of the installment of #124-A being a standard E-clip, which is opened enough to fit over the end octagonal shank portion of #119 and slid down same until it pops into the milled-out grove encompassing same.

Then comes the insertion of the compression spring, #121 into the spring housing portion of #113-B that abutts the uttermost inner wall portion thereof. The octagonal inner portion of the compression spring washer #122 is inserted over the end portion of #119, the sliding latch portion of this latch. The compression spring #121 is secured in the spring housing portion of #113-B under the compression spring retainment washer #122 by means of #123-A which is a standard C-clip or Cir-clip that compress-ably clips and locks into the inner grove portion #123-B, of the spring housing #113-B, which securely locks the compression spring and the compression spring retainment washer therein. This in turn ties all of these components together as one functioning unit. #114, the compression button, is affixed to the outermost end portion or #119 by means of compress ably inserting same into the inset portion of #114 referenced by means of the dotted lines.

The compression button, #114 is mechanically attached to #119 by means of machine screws, that mechanically fastens #114 the compression button that deactivates the track latch portion of #119, the sliding latch portion of this latch, which is the final portion of the assemblage process of #113, being the lower track latch portion of #113 the housing of which also being a portion of the track car accessory, in accordance with the principles of the present embodiment.

Figure 36:
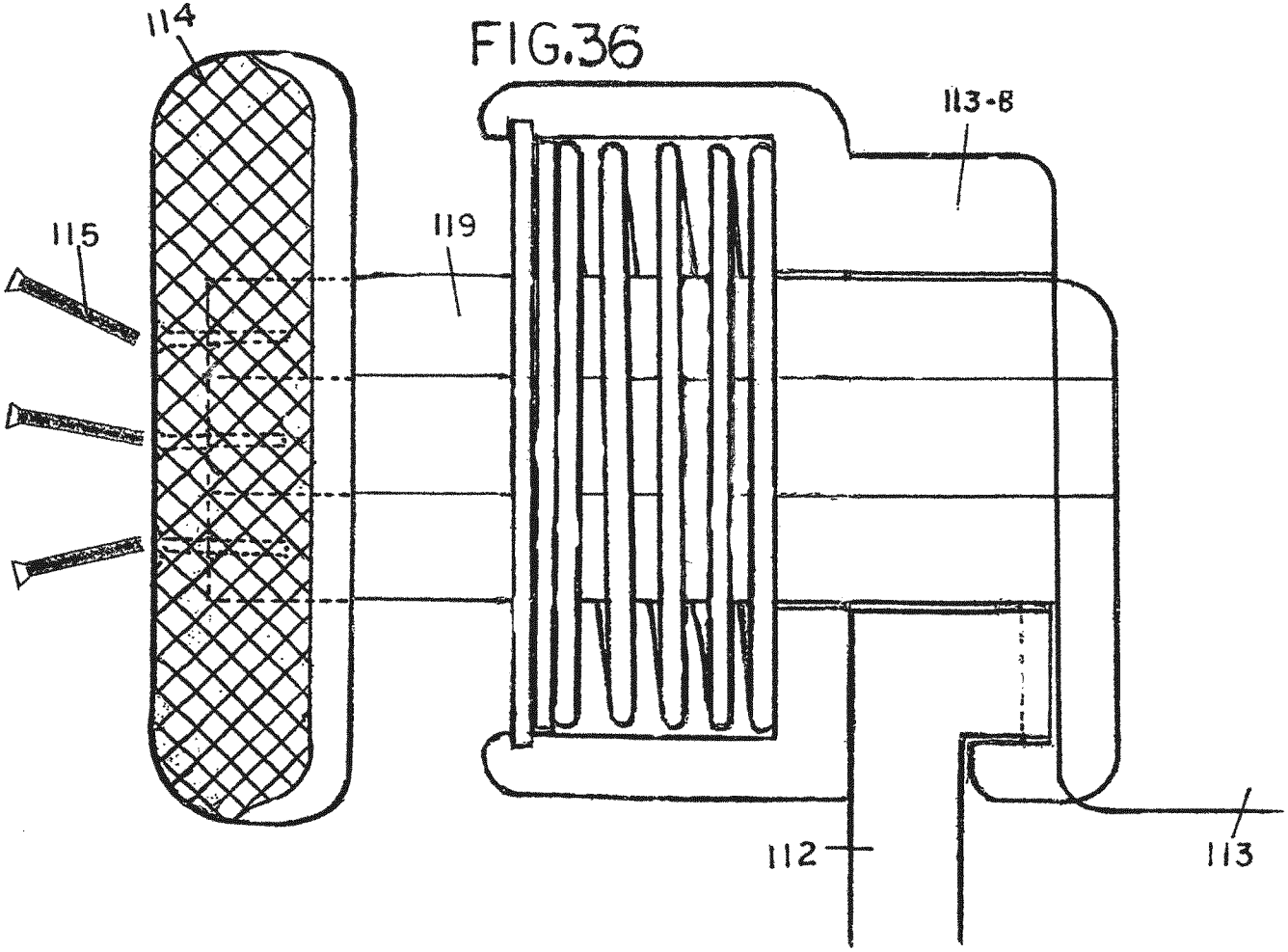
FIG. 36 is a drawing of one of the latch assemblies re-assembled of the second design of the track car and tracks seen in FIG. 29 through FIG. 36.

FIG. 36 is a profile view of the bottom portion of #113 being #113-B which is one of the two lower track latch portions of #113 that protrudes beyond the main body of #113 and is drawn as if a portion of the housing thereof was cut away, in the same manner as the drawing of FIG. 11 so the assembled workings thereof can be fully viewed. #115 are mechanical fasteners that mechanically fastens #114 the compression button, to the outermost end portion or #119 once compress ably inserted into the inset portion thereof which could also be easily achieved by means of adhesives, but the employment of mechanical fasteners simply allows for the disassembling of same for the possible future maintenance of these track latch portions of these accessories, in accordance with the principles of the present embodiment.

Figure 37:
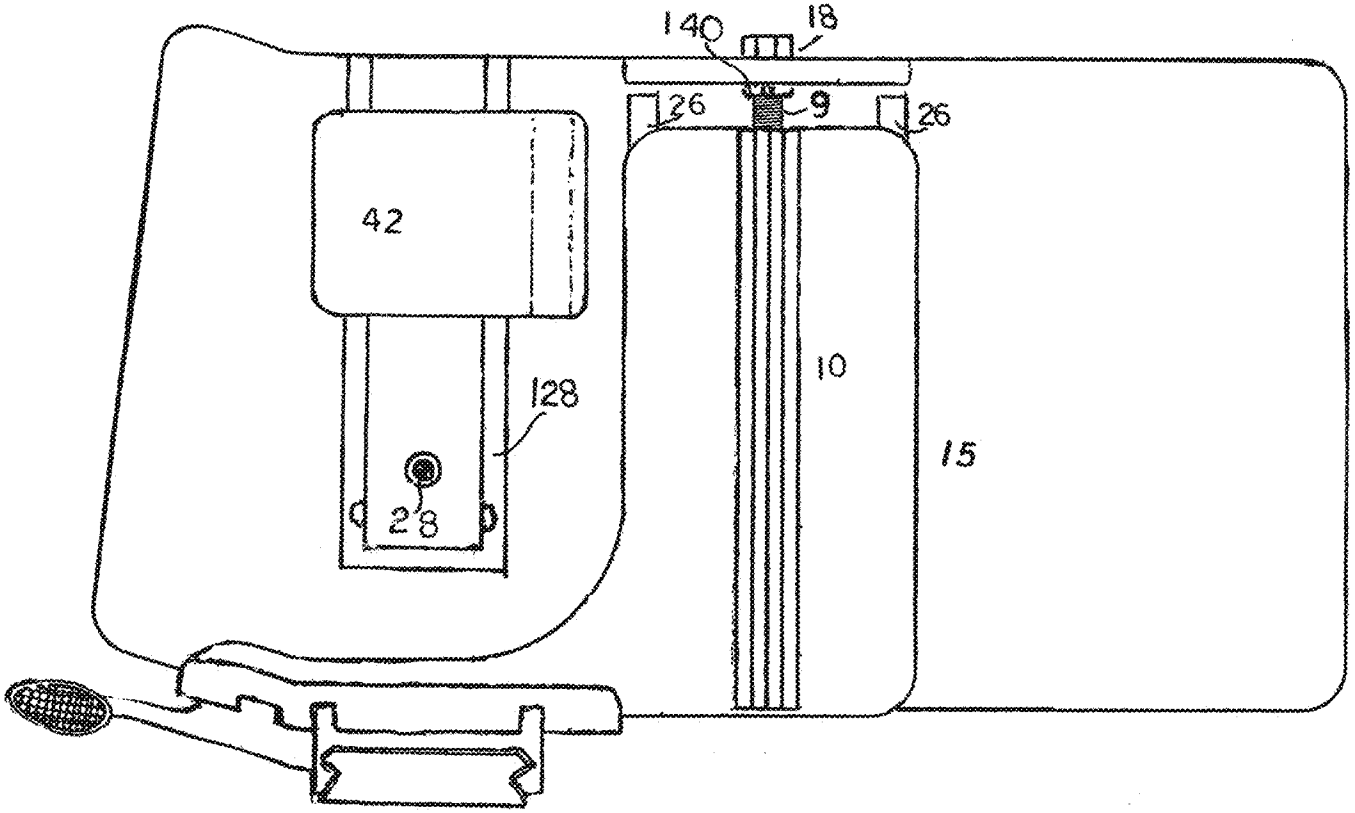
FIG. 37 is a drawing of a new type of height and angularly adjustable display device with its own track and tracks with the track cars thereof made as a portion of the display housing.

FIG. 37 comprises a drawing of a height and angularly adjustable combination camera and display device. in which with the track car and non-reversing mirrored accessory #42 portion thereof adjusted up into a position of non employment out of the field if view of the camera portion of the display #28 thereof.

Figure 41:
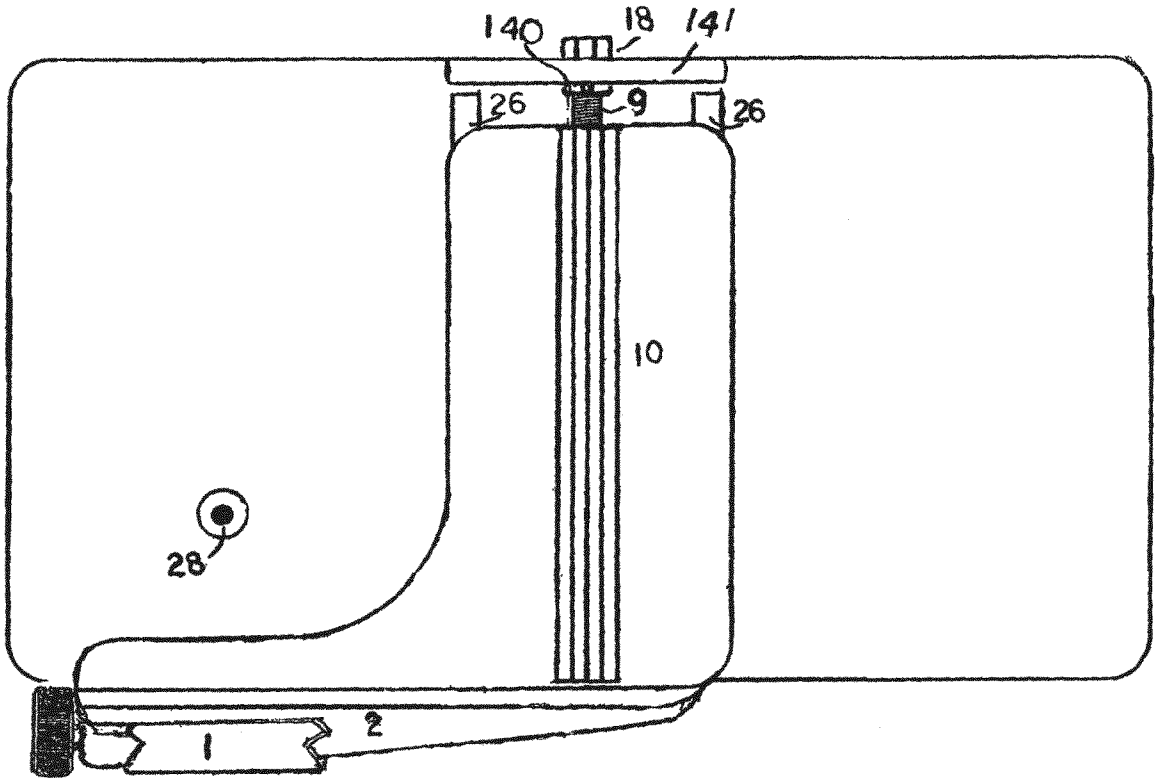
FIG. 41 is simply the non-tactical version of FIG. 37 through FIG. 40.

This device would be employed much in the same manner as all other tactical display device mounts employed with a smart device or other display device with a camera. The main differences being that this devise comprises a vertically adjustable display in which there is no actual display mount included in that the display housing and display with a camera portion of this device itself is vertically adjustable in relation to the rail mountable portion thereof. a top portion of the display housing #141 extends outward perpendicular to a top portion of the display housing a threaded member #9 extends through #141 and is maintained therein by means of a C clip, #140 that clips over and around a recessed portion of #9 just under #141, #9 is then threaded into a portion of the plate #10 of which is actually a portion of #10 that is rotatably coupled to an upper platform portion the rail mount portion of the device. Said plate #10 and a back portion of the display device are slidably coupled to gather by means of interlocking tracks #26 that mate together and interlock with each other with very close tolerances with each other, and are vertically adjustable in relation to each other by means of the clockwise and counter clockwise rotation of #18 which is the very top portion the said threaded member #9, The camera being an integral portion of the display housing. with the lens portion thereof #28 is positionally oriented in said housing perfectly centered over the rail mounting portion of the device, thus eliminating the need for lateral adjustments of any kind to be made to the actual display device enabling the centering of the lens of a camera portion of a display device simply by means of the mounting of the device on the rail of the firearm. all aforementioned. also holding true Meaning that the only actual adjustment needing to be done to the display itself being for the vertical adjustment to a point in which the camera lens portion thereof is vertically adjusted to a position of the same height above the mounting rail of the firearm, in which both are mounted, as the target reticle or crosshairs of the target viewing device that the camera portion of the display is acquiring its surveilled and targeting images from, which results in the camera lens thereof being in perfect leaner alignment with same. All of the aforementioned. also holding true for non-tactical version of his device as seen in FIG. 41. This as well as all components enabling same except for the actual rail mounting portion of the non-tactical version thereof actually being a portion of #10 and of which is hard mounted to said mounting rail of the firearm as seen in FIG. 41.

The applicant fully understands that there are numerous modes and components employable to effect the vertical adjustability of the display as well as the angler adjustability of the display portion of this device which holds true for all display device mounts included in this application, but simply to effect the ease of understanding and illustration, his drawing shows many of the same basic type of components enabling vertical adjustability of the display as well as for the angular adjustability of the rail mount portion of the device.

These similarities beginning with inter locking male and female tracks #26 enabling plate portion of #10 to be firmly attached to the back housing portion of the display while enabling vertical adjustability to the display portion of the device in relation to the plate portion of the mount, with the precise vertical adjustments thereof made as well as maintained by the threaded member #9 and the rotational adjustment thereof accomplished by means of the clockwise and counterclockwise rotation of the adjusting portion thereof #18.

This drawing also shows this device employing track car tracks made as an integral portion of the back side of the display housing, however these tracks are different than those of the other two variations thereof, included in this application, in that these tracks have no teeth of any kind, and instead, the track car tracks have indented inside portions on both the top and bottom inside facia portion of the track car tracks #128 and although employing the same variations of non reversing reflective devices, #42 the track car that it rides in and is angularly adjusted to each side of the firearm in, although employing the same components enabling same, being the same as employed in all other track cars included in this application.

The track cars and their mode of vertical adjustability, as well as the mechanisms and components, that enable same, are quite different as well in that they comprise no buttons or latches of any kind. These differences explained and thoroughly understood in the drawing and descriptions included for FIG. 39.

The various non-reversing mirrored devices as well as the employment of same, as well as all components and modes of the employment of enabling the angular adjustability of the display being the same as employed by all other tactical display device mounts included in this application as well, although may or may not be employed at the time of production, in that the applicant has already devised alternative modes of doing so that may or may not need to be included in an additional continuation in part application.

Figure 38:
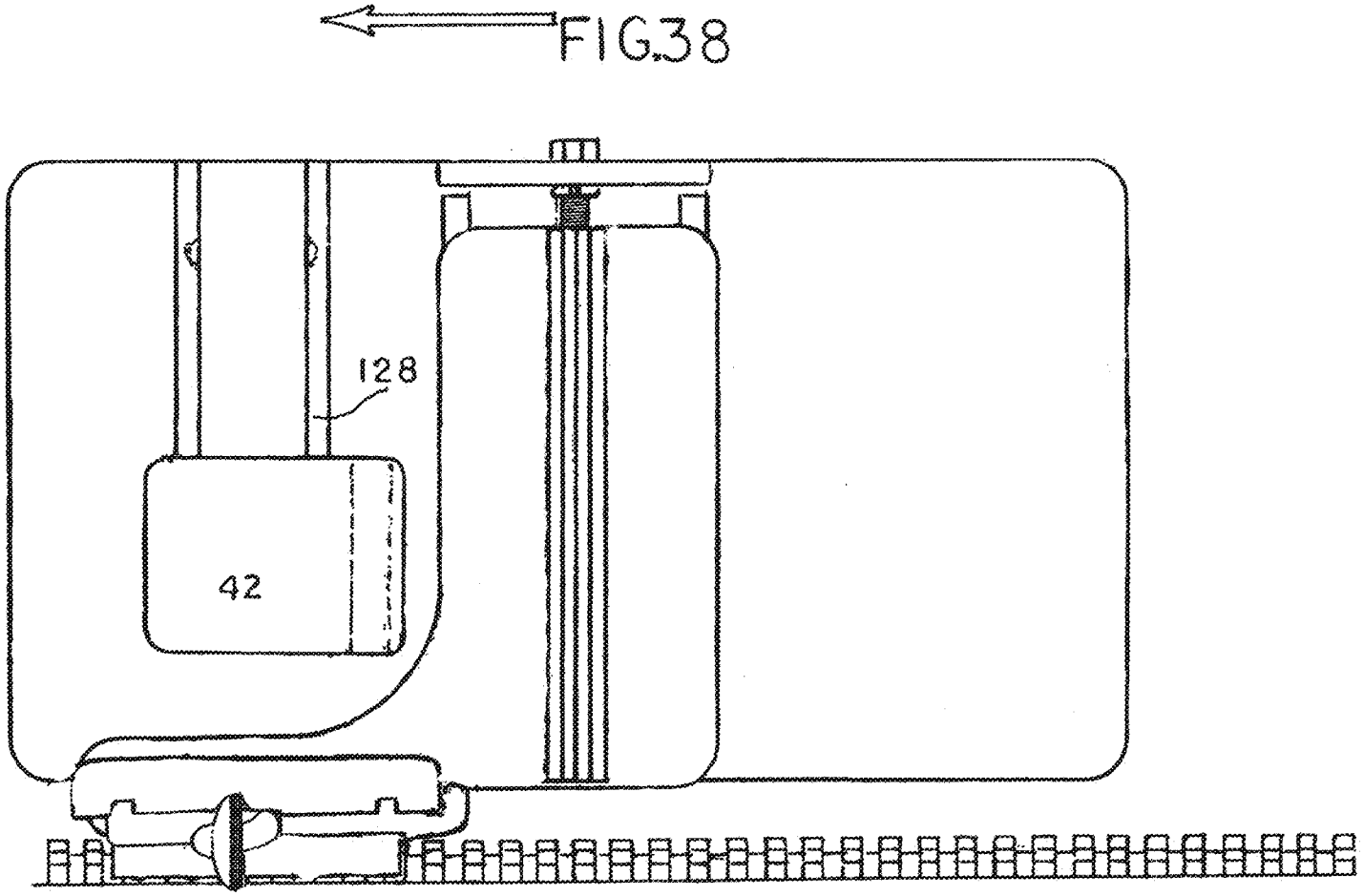
FIG. 38 is a drawings of a new type of height and angularly adjustable display device with its own track and tracks with the track cars thereof made as a portion of the display housing.

FIG. 38 is a drawing of this height and angularity adjustable display device, as if rotated and latched into position with the screen of the display device facing to the left side of the firearm, to acquire targeting and surveil images from a sight or scope mounted in front of same (not shown) and view same from the left side of the firearm. #129 are indented inside portions on both the top and bottom inside facia portion of the track car tracks of which will be described in FIG. #39.

Figure 39:
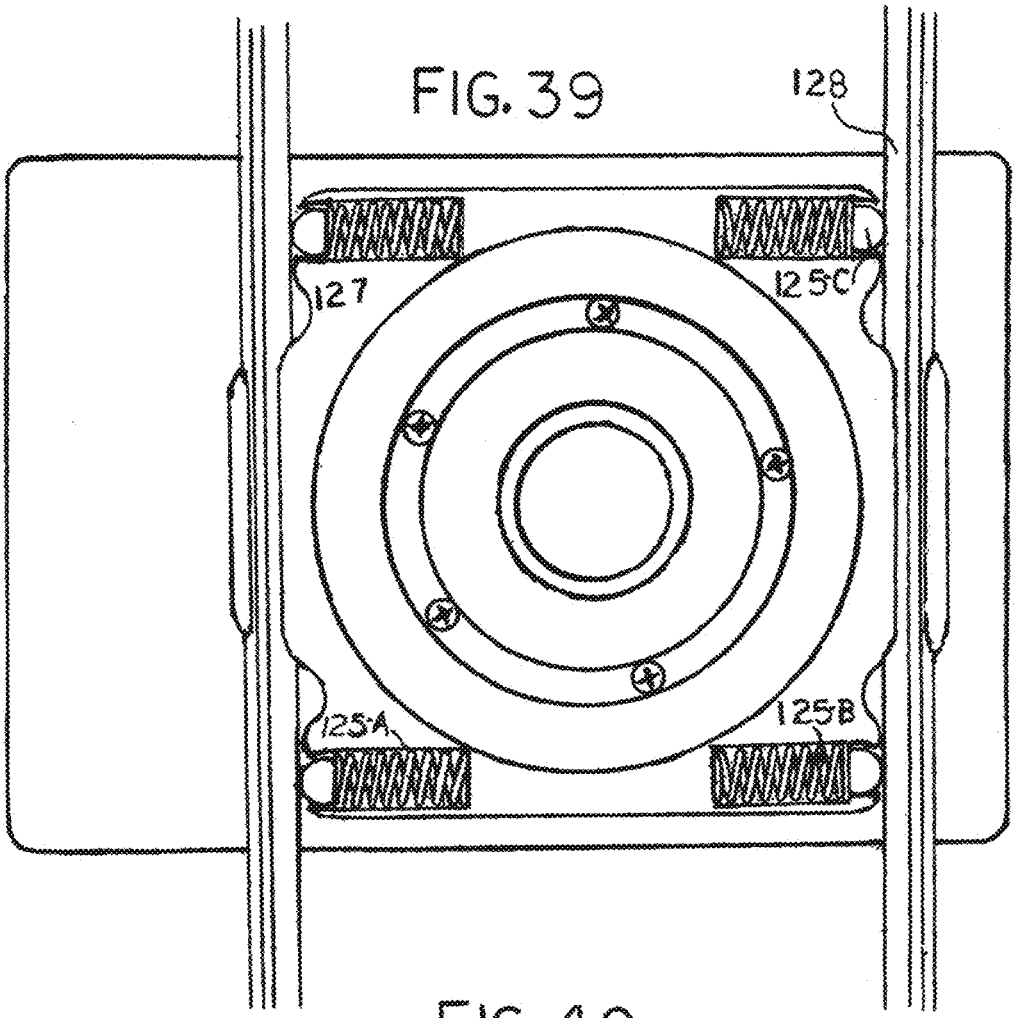
FIGS. 39 and 40 are drawings a third type of height and angularly adjustable track car and tracks that requires no latches of any kind as well as well as the inner components thereof with the track car tracks thereof made as a portion of the display housing.
Figure 40:
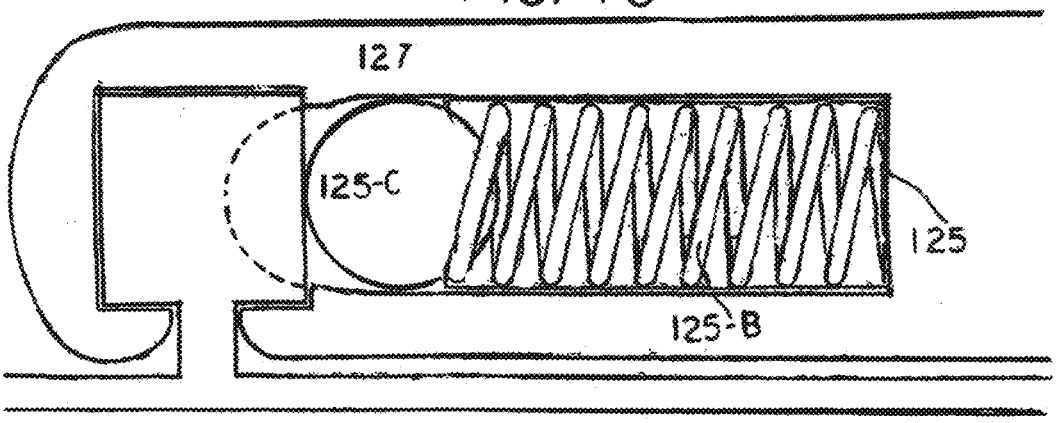

FIG. 39 is a view of the bottom side of the track car #127 and tracks #128 for the height and angularly adjustable combination camera and display device. Said tracks being a portion of the back side of the housing thereof as seen in FIG. 40 which is a profile view of a portion of the track car and track Both FIG. 39 and FIG. 40 are drawn as if portions of the track car were transparent, enabling four spring housings #125-A to be viewed. These spring housings comprising milled out bottom corner portions of the track car housing #127. Said spring housings contain springs #125-B. These springs maintain constant pressure to a stainless steel balls #125-C, housed therein with the periphery of the very outer edge of said spring and ball housings knurled to maintain both inside said spring and ball housings #125-A, whenever the track car is removed from the track car tracks.

This height and angularly adjustable combination camera and display device being a complete unit that mounts on the mounting rail of the firearm with the lens portion of the camera thereof always perfectly centered over the mounting rail of the firearm when mounted thereon, as well as the track car tracks being a portion of the back side of the device's housing, meaning that the track car and non-reversing reflective device mounted thereon, in turn always remaining positionally oriented in the same position in relation to the lens of the camera portion of the device. These things simply meaning that there need be only two positions that the track car needs to ever be orientated on the track car tracks.

The first position thereof being that of employment which is achieved by means of simply sliding the track car and non-reversing reflective device mounted thereon all of the way down said track car tracks until the lower back side portion of said track car abuts a cross bar portion of the tracks that creates a stop for the track car in which the exact center of the non-reversing reflective device mounted thereon, where same provides its non-reversed images to the lens of the camera portion of the device.

This is also the first position in which the said spring housings contain springs #125-B that maintain constant pressure to a stainless steel balls #125-C housed therein are automatically employed. Said stainless steel balls ride on the inside surface portion of the track car tracks #128 and pop in and out of dished out portions of the tracks #129, and further referenced by means of the dotted lines in FIG. 40. These dished out portions of the tracks maintain the positional orientations as the track car and non-reversing reflective device mounted therein in their positions of service and non-service by means of the said stainless steel balls #125-C, popping in and out of the track cars positions of service and non-service.

This track car is positionally taken in and out of service or optionally removed from the device altogether on track car tracks #128 simply by means of grasping the non-reversing mirrored accessory and sliding same up and down said track car tracks #128, along with said track car accessory popping same into either its position of employment or non-deployment, much in the same way that the non-reversing mirrored device #42 is rotated and popped in and out of its two positions of employment one hundred and eighty degrees in relation to each other.

FIG. 41 is a frontal view of the non-tactical version of the same invention, included in FIG. 37 through FIG. 40. that comprises all of the same non tactical enabling components thereof. and all corresponding numbed references included in FIG. 37 are the same those referenced in this the non tactical version of the device with the only component not included in the tactical version that is actually included in this the non tactical version thereof, comprising the rail mounting portion of the device referenced as #2 which is actually a portion of #10 consisting of except the rail mounting portion In other words this non-tactical version thereof simply employs a regular non rotating rail mount instead of a rotatable and angularly adjustable rail mount portion of the device, nor does this non tactical version thereof employ or include the track car rails or cars or any reflective devices of any kind, and of which like the aforementioned tactical version, of this firearm mountable and height adjustable display with a camera, included in FIG. 37 through FIG. 40. this non tactical version thereof also mounts on the mounting rail of firearm behind target viewing devices also mounted thereon, and acquires its targeting images by means of the camera lens portion of the display device, of which always remains perfectly centered over the mounting rail thereof simply due to the positional orientation of the camera portion of the vertically adjustable display device, housing being manufactured in a position in which the lens portion of the camera is positionally orientated directly over the center of the rail mount portion of the device, meaning that the only adjustment needful to perfectly align the lens of the camera portion of the device with the target reticle or crosshairs is that of the single adjustment mechanism portion of the device this being the vertical adjustment of the display device portion of the device.

I claim:

1. A device comprising:

a mount adapted for coupling the device to a firearm;

a plate extending laterally and vertically relative to the mount;

a display mount for receiving a display device, the display mount extending laterally and vertically relative to the mount and parallel to the plate, and slidably attached to the plate;

a first adjustment mechanism enabling positional adjustment of the display mount in a first direction relative to the plate; and a second adjustment mechanism enabling positional adjustment of the display device in a second direction relative to the display mount.

2. The device of claim 1 wherein the attachment of the display mount to the plate comprises interlocking tracks.

3. The device of claim 1 wherein the display mount further comprises a cradle portion.

4. The device of claim 1 wherein at least one of the first and second adjustment mechanisms comprises a threaded member.

5. The device of claim 1 wherein the display mount is adapted for the mounting of a smart display device.

6. A device comprising:

a mount adapted for coupling with a firearm;

a plate extending laterally and vertically relative to the mount;

a display mount for receiving a display device, the display mount extending laterally and vertically relative to the mount and parallel to the plate, and slidably attached to the plate; and a first adjustment mechanism enabling positional adjustment of the display mount in a first direction relative to the mount;

wherein the first direction is in a lateral direction relative to the mount.

7. The device of claim 6, further comprising a second adjustment mechanism enabling positional adjustment of the display device in a second direction relative to the mount, wherein the second direction is in a lateral vertical direction relative to the mount.

8. The device of claim 6, wherein the attachment of the display mount to the plate comprises interlocking tracks.

9. The device of claim 8, wherein the first adjustment mechanism comprises a track channel and threaded member, such that a camera of the display device mounted within the display mount can be laterally aligned with a sight of the firearm.

10. The device of claim 9 wherein the first adjustment mechanism further comprises a track that fits within the track channel, the track having a stop for securing the end of the display device mounted within the display mount.

11. The device of claim 6, wherein the display mount comprises a second plate and the first adjustment mechanism is disposed on the second plate.

12. The device of claim 11, further comprising a second adjustment mechanism enabling positional adjustment of the display device in a second direction relative to the mount, wherein the second direction is in a vertical direction relative to the mount; and wherein the second adjustment mechanism comprises a threaded member that vertically positions the second plate relative to the first plate using a threaded member, such that a camera can be vertically aligned with a sight of the firearm.

13. The device of claim 12 wherein the threaded member engages both the plate and the second plate.

14. The device of claim 6 wherein the display mount further comprises a clamp for securing the display device to the display mount.

15. The device of claim 6 wherein the display mount further comprises a cradle portion.

16. The device of claim 6 wherein the plate is rotatable relative to a base portion of the mount.

17. A device comprising:

a mount adapted for coupling with a firearm;

a plate extending laterally and vertically relative to the mount;

a display mount for receiving a display, the display mount extending laterally and vertically relative to the mount and parallel to the plate, and slidably attached to the plate;

wherein the attachment of the display mount to the plate comprises interlocking tracks.

* * * * *